US011235959B2

(12) United States Patent
Mayfield

(10) Patent No.: US 11,235,959 B2
(45) Date of Patent: Feb. 1, 2022

(54) TOWER HOIST, PLATFORM AND DAVIT SYSTEM

(71) Applicant: Matt's Arm, LLC, Murfreesboro, TN (US)

(72) Inventor: James S. Mayfield, Murfreesboro, TN (US)

(73) Assignee: MATT'S ARM, LLC, Murfreesboro, TN (US)

( * ) Notice: Subject to any disclaimer, the term of this patent is extended or adjusted under 35 U.S.C. 154(b) by 0 days.

(21) Appl. No.: 17/170,177

(22) Filed: Feb. 8, 2021

(65) Prior Publication Data

US 2021/0246002 A1 Aug. 12, 2021

Related U.S. Application Data

(60) Provisional application No. 62/971,587, filed on Feb. 7, 2020.

(51) Int. Cl.

| | |
|---|---|
| ***B66C 23/20*** | (2006.01) |
| ***B66C 23/26*** | (2006.01) |
| ***E04H 12/34*** | (2006.01) |
| ***B66C 23/88*** | (2006.01) |
| ***B66C 23/58*** | (2006.01) |
| ***B66C 23/62*** | (2006.01) |
| *E04H 12/18* | (2006.01) |

(52) U.S. Cl.

CPC ..... *B66C 23/26* (2013.01); *B66C 23/203* (2013.01); *B66C 23/58* (2013.01); *B66C 23/62* (2013.01); *B66C 23/88* (2013.01); *E04H 12/345* (2013.01); *E04H 12/187* (2013.01)

(58) Field of Classification Search

CPC ..... B66C 23/203; B66C 23/26; B66C 23/58; B66C 23/62; B66C 23/88; E04H 12/345

See application file for complete search history.

(56) References Cited

U.S. PATENT DOCUMENTS

| | | | | |
|---|---|---|---|---|
| 1,547,915 A * | 7/1925 | Hirn | B66C 23/203 52/40 |
| 2,153,803 A * | 4/1939 | Jerabek | B66C 23/203 212/179 |
| 2,309,769 A * | 2/1943 | Hubbard | B66C 23/203 248/230.9 |
| 3,136,519 A * | 6/1964 | Spriggle | B66C 23/203 248/230.8 |
| 3,568,797 A * | 3/1971 | Hardy | A01M 31/02 182/142 |
| 3,746,294 A * | 7/1973 | Johnston | F21V 21/116 248/219.4 |
| 6,138,964 A * | 10/2000 | Rose | F16M 11/2014 248/123.11 |
| 6,663,065 B1 * | 12/2003 | Whittenburg | B66C 23/203 182/187 |

(Continued)

*Primary Examiner* — Michael R Mansen
*Assistant Examiner* — Juan J Campos, Jr.
(74) *Attorney, Agent, or Firm* — Shane Cortesi

(57) ABSTRACT

Hoists, platforms and davits are described as well as methods of securing same to telecommunication and other towers. The hoists, platforms and davits may be secured to the towers on a temporary basis using clamps. The clamps may include brackets and cables. The cables may be attached to the brackets, may wrap around the outer surface/perimeter of the tower pole/leg and may use tension to keep the bracket in place.

27 Claims, 51 Drawing Sheets

(56) References Cited

U.S. PATENT DOCUMENTS

| | | | | |
|---|---|---|---|---|
| 6,983,856 | B1 * | 1/2006 | Burks | B66C 23/20 212/179 |
| 7,341,507 | B1 * | 3/2008 | Julian, Sr. | A22B 5/06 452/192 |
| 7,913,980 | B1 * | 3/2011 | Cipriano | B66D 3/08 254/393 |
| 10,112,806 | B1 * | 10/2018 | Dahl | F16M 13/022 |
| 10,464,788 | B1 * | 11/2019 | Bonifas | B66C 23/48 |

* cited by examiner

TOWER HOIST, PLATFORM AND DAVIT SYSTEM

RELATED APPLICATIONS

This application claims priority under 35 U.S.C. 119 to U.S. Provisional Application No. 62/971,587, the entire contents of which are incorporated herein by reference.

BACKGROUND

Technical Field

The present application relates to platforms, hoists and davits for working on towers. The tower may be a cell phone or other telecommunication tower containing antennas or alternatively may be a structural column in a building.

Background of the Invention

There are different types of cell phone towers, including monopole, lattice, guyed, and camouflaged. For example, the monopole tower requires one foundation and height does not exceed about 200 feet. In this type, antennas are mounted on the exterior of the tower. Next, lattice towers are usually seen along the highways. They are three and four sided. Guyed towers are cheap to construct but cover large areas. Radio and TV stations use this type of cell phone tower. This tower uses guy wires connected to the ground to provide the support to the straight tower in the middle. It is about 300 feet or more in height. Finally, camouflaged towers are more expensive compared to other cell tower types. They are often required by zoning.

Unfortunately, due to the quick growth of cell phones and data demands, which necessitate that the towers be located near populated areas, working on cell phone towers has become very expensive (necessitating expensive lifts) and dangerous. In addition, tower maintenance can require Class IV rigging plans requiring engineering sign off, resulting in delays and expenses.

U.S. Pat. No. 10,464,788 describes a portable hoisting system having an upright pole for tower repair. However, among other things, the product is bulky, has a high center of gravity above the tower, and involves loading the pulley with the load line through the piping.

Thus, there is a need for improved systems to work on telecommunication towers.

BRIEF SUMMARY

In some embodiments, the present disclosure provides a hoist, platform and davit for towers such as telecommunications towers and columns in a building. In some embodiments, the method may include attaching a hoist to a monopole. In other embodiments, the hoist may attach to towers having multiple legs, such as guyed or self-support towers. In further embodiments, the hoist may have a mast that extends above the tower.

More particularly, in some embodiments, the present disclosure provides a method of securing a hoist to a tower pole comprising a tower pole top located above the ground, a tower pole bottom and a tower pole height extending from the tower pole top to the tower pole bottom may include assembling a hoist system by performing the following steps in any suitable order including simultaneously: securing a first clamp bracket system to the tower pole by placing the first clamp bracket system at least partially around the tower pole; and providing a hoist comprising a hoist beam comprising a forward end, a rear end, a hoist beam length extending from the forward end to the rear end. Optionally, at least after complete installation of the system (i.e., at least after all parts are installed if not prior to all parts being installed), the first clamp bracket system connects the hoist beam rear end to the tower pole; the hoist beam extends laterally from the tower pole and the first clamp bracket system; the hoist further comprises at least one sheave connected to the hoist beam and receiving a load line; and/or a brace cable connects the hoist beam to the tower pole and extends at an angle relative to the tower pole height and comprises an upper end connected to the tower pole and a lower end connected to the hoist beam.

Optionally, at least after complete installation of the system, the hoist beam comprises at least one load-end sheave and at least one return sheave, wherein the return sheave is located between the at least one load-end sheave and the hoist beam rear end. Optionally. a load line extends from below the hoist beam, at least partially around the at least one load-end sheave and at least partially around the at least one return sheave and then below the hoist beam. Optionally, the at least one load end sheave and return sheave are each configured to rotate about axes extending generally perpendicular to the hoist beam length. Optionally, the load line is connected to a load located below the hoist beam. Optionally, the load line is connected to a heel block and a winch, the heel block located below the hoist beam and connected to the tower pole, the winch located below the hoist beam, and further wherein the load line extends from the heel block upwards to the at least one return sheave. Optionally, the hoist beam comprises a plurality of load-end sheaves spaced about the hoist beam length. Optionally, the hoist beam comprises a top, a bottom, a hoist beam height extending from the top to the rear bottom, a hoist beam channel extending from the hoist beam top to hoist beam bottom, the hoist beam channel dividing the hoist beam into a hoist beam left side and hoist beam right side, and further wherein the least one load-end sheave, the at least one return sheave and at least a segment/section of the load line are located in the channel. Optionally, the hoist beam further comprises a termination bracket, the termination bracket having an upper end located in the hoist beam channel and a lower end extending downward from the hoist beam and comprising a hole. Optionally, a tie-off cable connected to a human is secured to the termination bracket. Optionally, the load line runs from below the hoist beam, up through the hoist beam channel between the at least one return sheave and the hoist beam rear end, at least partially around the at least one return sheave and the at least one load-end sheave, and back down through the hoist beam channel between the at least one load-end sheave and the forward end of the hoist beam, and further wherein, the load line runs down to a sheave connected to a load and back up to the termination bracket. Optionally, the hoist beam further comprises a plurality of rope guides located on the hoist beam bottom on each of the hoist beam left side and hoist beam right side between the at least one return sheave and the hoist beam rear end and adjacent to the hoist beam channel, the rope guides configured to protect the hoist beam and the load line from wear caused by the load line making contact with the hoist beam as a load is raised or lowered. Optionally, the tower pole comprises a portion of a telecommunications tower further comprising an antenna. Optionally, the tower pole is a structural column in a building comprising an interior, and optionally the first clamp bracket system faces the interior of the building. Optionally, the tower pole is a leg of the telecommunications tower.

Optionally, at least after complete installation of the system, the first clamp bracket system comprises a first clamp central bracket comprising a front side connected to the rear side of the hoist beam, a rear side facing the tower pole (and preferably engaging the tower pole) and opposite the front side, a left side and a right side and a u-shaped cable system extending partially around the tower pole and comprising a first end connected to the left side and a second end connected to the right side. Optionally, the u-shaped cable system is comprised of one or more chain tensioners and one or more chains, said one or more chain tensioners connected to the central bracket and the chains and chain tensioners engage the perimeter of the tower pole. Optionally, the u-shaped cable system is comprised of a left chain, a left chain tensioner, a flexible clamp cable, a right chain, and a right chain tensioner, the left chain tensioner having a forward end connected to the first clamp central bracket left side and a rear end connected to a forward end of the left chain, the left chain having a rear end connected to a left end of the flexible clamp cable, the flexible clamp cable having a right end connected to a rear end of the right chain, the right chain having a forward end connected to a rear end of the right chain tensioner, the right chain tensioner having a forward end connected to the right side of the first clamp central bracket.

Optionally, at least after complete installation of the system, the hoist beam is pivotally connected to the first clamp central bracket via at least two pivots such that the hoist beam can at least partially rotate around the tower pole in the plane perpendicular to the tower pole height and the hoist beam forward end can move relative to the hoist beam rear end between a raised position in which the hoist beam forward end is located higher than the hoist beam rear end and a lowered position in which the hoist beam forward end is located at the same height or lower than the hoist beam rear end. Optionally, the two pivots have perpendicular pivot axes so that the hoist beam may simultaneously move in two planes that are perpendicular to each other. Optionally, a horizontally-oriented pivot bolt pivotably connects the hoist beam to the first clamp central bracket, the horizontally-oriented pivot bolt configured to allow the hoist beam to rotate clockwise and/or counter-clockwise about a horizontally-oriented pivot bolt pivot axis extending generally perpendicular to the tower pole height, wherein rotation of the hoist beam about the horizontally-oriented pivot bolt pivot axis allows the hoist beam forward end to move upward and downward and toward and away from the tower pole top. Optionally, the horizontally-oriented pivot bolt rotates with the hoist beam about the horizontally-oriented pivot bolt pivot axis. Optionally, the horizontally-oriented pivot bolt does not rotate with the hoist beam about the horizontally-oriented pivot bolt pivot axis. Optionally, a lower vertically-oriented pivot bolt pivotably connects the hoist beam to the first clamp central bracket, the lower vertically-oriented pivot bolt located rearwardly relative to the horizontally-oriented pivot bolt, the lower vertically-oriented pivot bolt configured to allow the hoist beam to rotate clockwise and/or counter-clockwise about a lower vertically-oriented pivot bolt pivot axis extending generally parallel to the tower pole height, wherein rotation of the hoist beam about the lower vertically-oriented pivot bolt pivot axis allows the hoist beam to rotate at least partially around said tower pole in the plane perpendicular to the tower pole height. Optionally, the lower vertically-oriented pivot bolt rotates with the hoist beam about the lower vertically-oriented pivot bolt pivot axis. Optionally, the lower vertically-oriented pivot bolt does not rotate with the hoist beam about the lower vertically-oriented pivot bolt pivot axis. Optionally, the first clamp bracket system further comprises a brake, the brake, when engaged, configured to prevent rotation of the hoist beam clockwise and/or counter-clockwise about the lower vertically-oriented pivot bolt pivot axis. Optionally, the first clamp central bracket further comprises a movable bridge, the movable bridge comprising a forward section comprising the horizontally-oriented pivot bolt and a rear section comprising the lower vertically-oriented pivot bolt, the movable bridge configured to rotate around the lower vertically-oriented pivot bolt pivot axis with the hoist beam (to allow the hoist beam to move in the plane perpendicular to the pole height). Optionally, the movable bridge remains stationary while the hoist beam rotates about the horizontally-oriented pivot bolt pivot axis. Optionally, the first clamp central bracket further comprises an upper plate comprising an upper plate bolt hole and a lower plate comprising a lower plate bolt hole, wherein the movable bridge is positioned between the upper plate and the lower plate and further wherein the lower vertically-oriented pivot bolt extends vertically through the movable bridge and is positioned in and rotates in the upper plate bolt hole and lower plate bolt hole as the hoist beam rotates about the lower vertically-oriented pivot bolt pivot axis. Optionally, the first clamp bracket system further comprises a brake, the brake, when engaged, configured to releasably engage the movable bridge so to prevent the movable bridge (and hence the hoist beam) from rotating around the lower vertically-oriented pivot bolt pivot axis.

Optionally, the method further comprises securing a second clamp bracket system to the tower pole by placing the second bracket system at least partially around the tower pole. Optionally, at least after complete installation of the system, the second clamp bracket system is located above the first clamp bracket system and the second clamp bracket system comprises a second clamp central bracket comprising a front side connected to the upper end of the brace cable, a rear side facing the tower pole and opposite the front side, a left side and a right side. Optionally, the upper end of the brace cable is pivotally connected to the second clamp central bracket via at least one pivot such that the hoist beam can at least partially rotate around the tower pole in the plane perpendicular to the pole height. Optionally, an upper vertically-oriented pivot bolt pivotably connects the upper end of the brace cable to the second clamp central bracket, the upper vertically-oriented pivot bolt configured to allow the brace cable to rotate clockwise and/or counter clockwise about a upper vertically-oriented pivot bolt pivot axis extending generally parallel to the tower pole height, wherein rotation of the brace cable about the upper vertically-oriented pivot bolt pivot axis allows the hoist beam to rotate at least partially around the tower pole in the plane perpendicular to the pole height, and further wherein the brace cable rotates about the upper vertically-oriented pivot bolt axis in coordination with the hoist beam as the hoist beam rotates about the lower vertically-oriented pivot bolt axis. Optionally, the upper vertically-oriented pivot bolt rotates with the brace cable about the upper vertically-oriented pivot bolt pivot axis. Optionally, the upper vertically-oriented pivot bolt does not rotate with the brace cable about the upper vertically-oriented pivot bolt pivot axis. Optionally, the upper vertically-oriented pivot bolt is located directly above the lower vertically-oriented pivot bolt (such that the upper and lower vertically-oriented pivot bolt axes are aligned). Optionally, at least one vertical brace extends generally parallel to the tower pole height and connects the first clamp central bracket to the second clamp central bracket. Optionally, a pair of vertical braces spaced apart by a distance extend between the first and second clamp central brackets and connect the first clamp central bracket to the second clamp central bracket, wherein each vertical brace comprises an upper end and a lower end, and further wherein the distance between the vertical braces is less at the lower end of the vertical braces as compared to the upper end of the vertical braces to form a V-shape. Optionally, the brace cable comprises an upper chain, a turnbuckle, and a lower chain, the upper chain having an upper end connected to the upper vertically-oriented pivot bolt and a lower end connected to an upper end of the turnbuckle and further wherein the lower chain comprises an upper end connected to a lower end of the turnbuckle and a lower end connected to the hoist beam. Optionally, the hoist beam is configured to move into the raised position when the turnbuckle is shortened. Optionally, the first and second clamp brackets are vertically aligned.

Optionally, a plurality of adjustable (preferably threaded) jack bolts extend through a portion of at least one of the first clamp central bracket and the second clamp central bracket and engage a surface of the tower pole (preferably without extending into the tower pole), and said engagement is configured to prevent the first clamp central bracket and/or the second clamp central bracket from rotating or sliding relative to the tower pole. In other words, the connection is preferably not a mechanical interconnection of a bolt extending into a hole in the tower pole but instead part of a bolt engaging the surface of the tower pole creates sufficient friction to prevent rotation or sliding. Optionally, the adjustable jack bolts are oriented generally perpendicular to the tower pole height. Optionally, the adjustable jack bolts are spaced partially about a perimeter of the tower pole. Optionally, each adjustable jack bolt comprises a proximal end facing the tower pole and a distal end opposite the proximal end and further wherein adjustment of the jack bolt (e.g., turning the adjustable jack bolts clockwise and counter-clockwise) allows the jack bolt proximal end (and attached first and second clamp brackets) to move toward and away from the tower pole. Optionally, at least one of the first clamp central bracket and the second clamp central bracket comprises a plurality of jack brackets spaced partially about a perimeter of the tower pole, each jack bracket comprising a side facing the tower pole, each of the respective sides comprising a hole oriented generally perpendicular to the tower pole height, each of the respective holes comprising an adjustable (preferably threaded) jack bolt extending laterally through the respective hole perpendicular to the tower pole height, the adjustable jack bolt engaging the tower pole and preferably preventing the first and/or second central brackets from rotating or sliding relative to the tower pole (and preferably also allowing the hoist beam to rotate about the lower vertically-oriented pivot bolt axis in a true horizontal arc). Optionally, the tower pole is a monopole, said monopole being in the shape of a polygon comprising a plurality of tapered sides, each side wider at the bottom of the side as compared to the top, each adjustable jack bolt engaging (but preferably not extending into) a side and spaced partially about a perimeter of the monopole. Optionally, at least after complete installation of the system, the first clamp central bracket further comprises a removable insert. Optionally, said first clamp bracket system forms a complete loop about said pole. Optionally, a removable lug connects the hoist beam to the brace cable lower end. Optionally, the hoist beam is connected to a man basket configured to carry a human.

In still further embodiments, the present disclosure provides a method of securing a clamp bracket system to a monopole tower, the method comprising the steps of a) providing a monopole; and b) securing a clamp bracket system to the tower, where the clamp bracket system comprises a clamp central bracket comprising a front side, a rear side facing the tower pole (and preferably engaging the monopole) and opposite the front side, a left side and a right side and a u-shaped cable system extending partially around the tower pole and comprising a first end connected to the left side and a second end connected to the right side. Optionally, as previously described, the u-shaped cable system is comprised of one or more chain tensioners and one or more chains, said one or more chain tensioners connected to the central bracket and the chains and chain tensioners engage the perimeter of the monopole. Optionally, the u-shaped cable system is comprised of a left chain, a left chain tensioner, a flexible clamp cable, a right chain, and a right chain tensioner, the left chain tensioner having a forward end connected to the first clamp central bracket left side and a rear end connected to a forward end of the left chain, the left chain having a rear end connected to a left end of the flexible clamp cable, the flexible clamp cable having a right end connected to a rear end of the right chain, the right chain having a forward end connected to a rear end of the right chain tensioner, the right chain tensioner having a forward end connected to the right side of the first clamp central bracket. The clamp central bracket may be attached to a beam (as described above) or a mast as described below. In addition, the system may include one or more features described above.

In further embodiments, the present disclosure provides a method of securing a hoist to a tower pole comprising a tower pole top located above the ground, a tower pole bottom and a tower pole height extending from the tower pole top to the tower pole bottom, the method comprising assembling a hoist system by performing the following steps in any suitable order including simultaneously: securing a first clamp bracket system to the tower pole by placing the first clamp bracket system at least partially around the tower pole; securing a mast to the first clamp bracket system, the mast comprising a top, a bottom, and a height extending from the top to the bottom; providing a first mast bracket system; and providing a hoist comprising a hoist beam comprising a forward end, a rear end, a hoist beam length extending from the forward end to the rear end. Optionally, at least after complete installation of the system, the first clamp bracket system connects the mast to the tower pole; the first mast bracket is located above the first clamp bracket system and connects the hoist beam rear end to the mast and wraps at least partially around the mast; the hoist beam extends laterally from the mast and the first mast bracket system; the hoist further comprises at least one sheave connected to the hoist beam and receiving a pulley cable; a brace cable connects the hoist beam to the mast above the first mast bracket system and extends at an angle relative to the tower pole height and comprises an upper end connected to the mast and a lower end connected to the hoist beam; and/or the mast height is generally parallel to the tower pole height.

Optionally, a second mast bracket system connects the upper an x-shaped vertical brace extends between the first and second mast bracket systems end of the brace cable to the mast. Optionally, at least one bolt extends from the second mast bracket system into an interior of the mast, the at least one bolt configured to prevent rotation of the second mast bracket system relative to the mast. Optionally, the mast top (and the hoist beam rear end) is located above the tower pole top. Optionally, the mast comprises at least one bearing system configured to allow the mast to rotate relative to a mast central/longitudinal axis which runs generally parallel to the tower pole height. Optionally, the bearing system further comprises a brake, the brake, when engaged, configured to prevent the mast from rotating relative to the mast central/longitudinal axis. Optionally, the bearing system comprises a bearing bolt passing through the at least one bearing and is aligned with the mast central/longitudinal axis, wherein a nut is attached to the bearing bolt and forms said brake, and further wherein tightening of said nut is configured to prevent the mast from rotating relative to the mast central/longitudinal axis.

Optionally, the mast may comprise one or more of the following features (or any combination thereof): a cylindrical upper mast pipe comprising a top end, a bottom end, a upper mast pipe height extending from the top to the bottom, an interior, an interior surface, an inner diameter, an exterior surface, an exterior diameter, and a plurality of holes adjacent the top end configured to allow a bolt to be inserted through the upper mast pipe; a cylindrical lower mast pipe having a lower mast pipe top, a lower mast pipe bottom, a height extending from the lower mast pipe top to the lower mast pipe bottom, an interior, an interior surface, an inner diameter, an exterior surface, an exterior diameter, and a plurality of holes adjacent the top end configured to allow a rod to be inserted through the lower mast pipe; a circular stabilizer plate having an upper face, a lower face opposite the upper face, a center hole extending from the upper face through the lower face, a plurality of outer holes along a perimeter of the stabilizer plate, and a stabilizer plate diameter; a first bearing plate having a top comprising an upper face, a bottom comprising a lower face opposite the upper face, a center hole extending from the upper face through the lower face, an outer edge, and a first bearing plate diameter, wherein the first bearing plate diameter is substantially equal to the inner diameter of the upper mast pipe; a second bearing plate having a top comprising an upper face, a bottom comprising a lower face opposite the upper face, a center hole extending from the upper face through the lower face, an outer edge, and a second bearing plate diameter, wherein the second bearing plate diameter is substantially equal to the inner diameter of the upper mast pipe; a third bearing plate having a top comprising an upper face, a bottom comprising a lower face opposite the upper face, a center hole extending from the upper face through the lower face, an upper face edge, a lower face edge, an upper face diameter, a lower face diameter, wherein the upper face diameter is less than the upper mast pipe inner diameter and the lower face diameter is substantially equal to the lower mast pipe inner diameter, and further wherein the upper face diameter is greater than the lower face diameter so as to create a ledge/recess extending around the lower face edge; a fourth bearing plate having top comprising an upper face, a bottom comprising a lower face opposite the upper face, a center hole extending from the upper face through the lower face, an outer edge, and a fourth bearing plate diameter, wherein the fourth bearing plate diameter is substantially equal to the lower mast pipe inner diameter. Optionally, at least after complete installation of the system, the upper faces of the circular stabilizer plate and the first, second, third and four bearing plates face upwards and the lower faces of the of the circular stabilizer plate and the first, second, third and four bearing plates face downwards; the lower mast pipe top is located within the upper mast pipe interior and the lower mast pipe exterior surface does not contact the upper mast pipe interior surface; the stabilizer plate lower face contacts the upper mast pipe top; the first bearing plate is located below the stabilizer plate and within the upper mast pipe interior, the first bearing plate outer edge contacting the upper mast pipe interior surface, the first bearing plate upper face facing the stabilizer plate lower face; the second bearing plate is located below the first bearing plate and within the upper mast pipe interior, the second bearing plate outer edge contacting the upper mast pipe interior surface, the second bearing plate upper face facing the first bearing plate lower face; the fourth bearing plate is located below the third bearing plate and within the lower mast pipe interior, the fourth bearing plate outer edge contacting the lower mast pipe interior surface, the fourth bearing plate upper face facing the third bearing plate lower face; an top washer is positioned below the third bearing plate, the top washer comprising a center hole, an upper face confronting the third bearing plate lower face and a lower face; a bottom washer is positioned below the top washer and comprising a center hole, an upper face confronting the lower face of the top washer and a lower face confronting the upper face of the fourth bearing plate, wherein the bottom washer is rotatable relative to the top washer; a bearing bolt passes through the center holes of the first, second, third, and fourth bearing plates and the upper and the center holes of the upper and lower washer; at least one bolt passes through the plurality of holes in the top of the upper mast pipe and between the first and second bearing plates; wherein at least one rod passes through the plurality of holes in the top of the lower mast pipe and between the third and fourth bearing plates. Optionally, the system of paragraph 17 may include one or more features described in paragraphs 8-13 described above.

In still further embodiments, the present disclosure provides a method of securing a hoist to a tower comprising a left tower leg and a right tower leg, the left tower leg connected to the right tower leg by a plurality of tower braces, the tower, the left tower leg and the right tower leg each having a top located above the ground, a bottom and a height extending from the top to the bottom, the method comprising assembling a hoist system by performing the following steps in any suitable order including simultaneously: securing a lower right clamp bracket system to the right tower leg/pole by placing the lower right clamp bracket system at least partially around the right tower leg/pole; securing an upper right clamp bracket system to the right tower leg/pole by placing the upper right clamp bracket system at least partially around the right tower leg/pole; securing a lower left clamp bracket system to the left tower leg/pole by placing the lower left clamp bracket system at least partially around the left tower leg/pole; securing an upper left clamp bracket system to the left tower leg/pole by placing the upper left clamp bracket system at least partially around the left tower leg/pole; providing a hoist comprising a hoist beam comprising a forward end, a rear end, a hoist beam length extending from the hoist beam forward end to the hoist rear end; providing an upper cross beam and a lower cross beam. Optionally, at least after complete installation of the system, the lower left clamp bracket system is at substantially the same height as the lower right clamp bracket system; the lower cross beam extends between the lower left clamp bracket system and the lower right clamp bracket system and is oriented generally parallel to the ground and perpendicular to the left and right pole heights;

the upper left clamp bracket system is at substantially the same height as the upper right clamp bracket system; the upper cross beam extends between the upper left clamp bracket system and the upper right clamp bracket system and is oriented generally parallel to the ground and perpendicular to the left and right pole heights; the upper cross beam, the upper left clamp bracket system and the upper right clamp bracket system are located above the lower cross beam, the lower left clamp bracket system and the lower right clamp bracket system; the hoist beam is connected to the lower cross beam and extends laterally from the lower cross beam; the hoist further comprises at least one sheave connected to the hoist beam and receiving a pulley cable (also referred to in the art as a load line); and/or a brace cable connects the hoist beam to the upper cross beam and extends at an angle relative to the left and right tower pole heights and comprises an upper end connected to the upper cross beam and a lower end connected to the hoist beam.

Optionally, the tower is in the form of a guyed or self-support tower and further comprises a rear pole located rearwardly relative to the left pole and right pole and connected to the left and right pole by a plurality of tower braces. Optionally, at least after complete installation of the system, a lower cross beam bracket is connected to the lower cross beam between the lower left clamp bracket system and the lower right clamp bracket system, wherein a horizontally-oriented pivot bolt connects the hoist beam to the lower cross beam bracket, the hoist beam configured to rotate clockwise and counter-clockwise about a horizontally-oriented pivot bolt pivot axis extending generally perpendicular to the tower pole height, wherein rotation of the hoist beam about the horizontally-oriented pivot bolt pivot axis allows the hoist beam forward end to move upward and downward and toward and away from the tower (to allow the hoist beam to move between the raised and lowered positions). Optionally, at least after complete installation of the system, a lower vertically-oriented pivot bolt connects the hoist beam to the lower cross beam bracket, the lower vertically-oriented pivot bolt located rearwardly relative to the horizontally-oriented pivot bolt and configured to allow the hoist beam to rotate clockwise and/or counter-clockwise about a lower vertically-oriented pivot bolt pivot axis extending generally parallel to the tower pole height. Optionally, rotation of the hoist beam about the lower vertically-oriented pivot bolt pivot axis allows the hoist beam to move toward and away from the lower cross beam (to allow the hoist beam to move in a plane perpendicular to the tower pole height). Optionally, the lower cross beam bracket further comprises a movable bridge, as described previously. Optionally, at least after complete installation of the system, an upper cross beam bracket is connected to the upper cross beam between the upper left clamp bracket system and the upper right clamp bracket system, the upper cross beam bracket located above the lower cross beam bracket, an upper vertically-oriented pivot bolt connects the upper end of the brace cable to the upper cross beam bracket, the brace cable configured to rotate (in a coordinated fashion with the hoist beam) clockwise and/or counter-clockwise about a upper vertically-oriented pivot bolt pivot axis extending generally parallel to the tower pole height, and rotation of the brace cable about the upper vertically-oriented pivot bolt pivot axis allows the hoist beam to move toward and away from the lower cross beam (to allow the hoist beam to move in the plane perpendicular to the tower pole height). Optionally, a lower vertically-oriented pivot bolt connects the hoist beam to the lower cross beam bracket, the lower vertically-oriented pivot bolt located rearwardly relative to the horizontally-oriented pivot bolt and configured to allow the hoist beam to rotate clockwise and/or counter-clockwise about a lower vertically-oriented pivot bolt pivot axis extending generally parallel to the tower pole height, and rotation of the hoist beam about the lower vertically-oriented pivot bolt pivot axis allows the hoist beam to move toward and away from the lower cross beam (to allow the hoist beam to move in a plane perpendicular to the tower pole height). Optionally, the lower cross beam bracket further comprises a movable bridge, as described previously. Optionally, an upper cross beam bracket is connected to the upper cross beam between the upper left clamp bracket system and the upper right clamp bracket system, the upper cross beam bracket located above the lower cross beam bracket, an upper vertically-oriented pivot bolt connects the upper end of the brace cable to the upper cross beam bracket, the brace cable configured to rotate (in a coordinated fashion with the hoist beam) clockwise and/or counter-clockwise about a upper vertically-oriented pivot bolt pivot axis extending generally parallel to the tower pole height, and rotation of the brace cable about the upper vertically-oriented pivot bolt pivot axis allows the hoist beam to move toward and away from the lower cross beam (to allow the hoist beam to move in the plane perpendicular to the tower pole height). Optionally, the system of paragraphs 18 and 19 may include one or more features described in paragraphs 8-13 described above.

In still further embodiments, the present disclosure provides a method of securing a hoist to a tower comprising a left tower pole and a right tower pole, the left tower pole connected to the right tower pole by a plurality of tower braces, the tower, the left tower pole and the right tower pole each having a top located above the ground, a bottom and a height extending from the top to the bottom, the method comprising assembling a hoist system by performing the following steps in any suitable order including simultaneously: securing a lower right clamp bracket system to the right tower pole by placing the lower right clamp bracket system at least partially around the right tower pole; securing an upper right clamp bracket system to the right tower pole by placing the upper right clamp bracket system at least partially around the right tower pole; securing a lower left clamp bracket system to the left tower pole by placing the lower left clamp bracket system at least partially around the left tower pole; securing an upper left clamp bracket system to the left tower pole by placing the upper left clamp bracket system at least partially around the left tower pole; providing a hoist comprising a hoist beam comprising a forward end, a rear end, a hoist beam length extending from the hoist beam forward end to the hoist rear end; providing an upper cross beam and a lower cross beam; providing a mast. Optionally, at least after complete installation of the system, the lower left clamp bracket system is at substantially the same height as the lower right clamp bracket system; the lower cross beam extends between the lower left clamp bracket system and the lower right clamp bracket system and is oriented generally parallel to the ground (and perpendicular to the left and right pole heights); the upper left clamp bracket system is at substantially the same height as the upper right clamp bracket system; the upper cross beam extends between the upper left clamp bracket system and the upper right clamp bracket system and is oriented generally parallel to the ground (and perpendicular to the left and right pole heights); the upper cross beam, the upper left clamp bracket system and the upper right clamp bracket system are located above the lower cross beam, the lower left clamp bracket system and the lower right clamp bracket system; the mast is connected to the lower cross beam by a lower cross beam bracket located between the lower left clamp bracket system and the lower right clamp bracket, the mast is connected to the upper cross beam by an upper cross beam bracket located between the upper left clamp bracket system and the upper right clamp bracket system, and the mast comprises a mast height extending generally parallel to the tower pole height; the hoist beam is connected to the mast and extends laterally from the mast; the hoist further comprises at least one sheave connected to the hoist beam and receiving a pulley cable (also referred to in the art as a load line); and/or a brace cable connects the hoist beam to the mast and extends at an angle relative to the left and right tower pole heights and comprises an upper end connected to the mast and a lower end connected to the hoist beam.

Optionally, at least after complete installation of the system, first mast clamp bracket is located above the upper cross beam bracket and connects the hoist beam rear end to the mast and wraps at least partially around the mast. Optionally, the mast top (and hoist beam rear end) is located above the tower top. Optionally, the mast comprises at least one bearing as described previously. Optionally, the system may include one or more features described in paragraphs 8-13 described above.

In still further embodiments, the present disclosure provides a method of securing a hoist to a tower comprising securing a hoist comprising one or more components described herein to the tower. In other embodiments, the present disclosure provides a method of securing a hoist to a tower comprising securing a hoist comprising one or more components described herein to the tower. In another embodiment, the present disclosure provides a method of securing a clamp bracket system comprising one or more components described herein to the tower. In still further embodiments, the present disclosure provides a method of securing a hoist to a tower comprising a tower top, a tower bottom and a tower pole height extending from the top to the bottom, the method comprising: securing a davit comprising a sheave to the tower using a clamp bracket so that the davit comprises a davit height generally parallel to the tower pole height; and securing a mast to the tower using the clamp bracket. Optionally, at least after complete installation of the system, the mast is connected to a hoist comprising a hoist beam and the hoist beam extends downwardly along the mast (as opposed to laterally). Optionally, the hoist beam is connected to the mast as described above and/or illustrated in the figures. Optionally, the davit comprises an upper davit pole partially nested in an interior of a lower davit pole. Optionally, the davit sheave is adjacent to a top end of the davit.

In another embodiment, the tower may include a right tower leg/pole and a rear left tower leg/pole that are connected by a plurality of tower braces. Optionally, the rear right tower leg/pole may comprise a rear right tower leg/pole top, a rear right tower leg/pole bottom, a rear right tower leg/pole height extending from the rear right tower leg/pole top and rear right tower leg/pole bottom. Optionally, the rear left tower leg/pole may comprise a rear left tower leg/pole top, a rear left tower pole/leg bottom, a rear left tower/leg pole height extending from the rear left tower/leg pole top and rear left tower pole/leg bottom. Optionally, the first clamp bracket system may be connected to the rear left tower pole/leg by a lower left horizontal brace and/or connected to the rear right tower pole/leg by a lower right horizontal brace. Optionally, the lower left horizontal brace may be connected to the left rear tower pole/leg by a lower left horizontal brace clamp. Optionally, the lower right horizontal brace may be connected to the rear left tower pole/leg by a lower right horizontal brace clamp. Optionally, the second clamp bracket system may be connected to the rear left tower pole/leg by an upper left horizontal brace and/or connected to the rear right tower pole by an upper right horizontal brace. Optionally, the upper left horizontal brace may be connected to the rear tower pole by an upper left horizontal brace clamp. Optionally, the upper right horizontal brace may be connected to the rear right tower pole by an upper right horizontal brace clamp.

In still further embodiments, the present disclosure provides a method of securing a platform to a tower pole comprising a tower pole top located above the ground, a tower pole bottom and a tower pole height extending from the tower pole top to the tower pole bottom, the method comprising assembling a platform system by performing the following steps in any suitable order including simultaneously: securing a first clamp bracket system to the tower pole by placing the first clamp bracket system at least partially around the tower pole; and providing a platform comprising a platform beam comprising a forward end, a rear end, a platform beam length extending from the forward end to the rear end. Optionally, at least after complete installation of the system, the first clamp bracket system connects the platform beam rear end to the tower pole; the platform beam extends laterally from the tower pole and the first clamp bracket system; and/or a brace cable connects the platform beam to the tower pole and extends at an angle relative to the tower pole height and comprises an upper end connected to the tower pole and a lower end connected to the platform beam.

Optionally, the platform comprises a substantially solid floor, the substantially solid floor configured to allow a human to stand thereon. Optionally, the platform comprises a horizontal rail and a vertical rail. Optionally, the horizontal rail is located generally perpendicular to the tower pole height and the vertical rail is located generally parallel to the tower pole height. Optionally, the platform length is generally perpendicular to the tower pole height and the method further comprises walking on the platform. Optionally, the platform beam is located at a bottom of the platform. Optionally, the platform comprises two parallel platform beams the platform beam extending laterally from the tower pole and the first clamp bracket system and two parallel brace cables connect the two platform beams to the tower pole and extending at an angle relative to the tower pole height and comprising an upper end connected to the tower pole and a lower end connected to a platform beam. Optionally, the system of paragraphs 23 and 24 may include one or more features described in paragraphs 8-13 described above.

In still further embodiments, the present disclosure provides a method of securing a platform to a tower comprising a left tower pole and a right tower pole, the left tower pole connected to the right tower pole by a plurality of tower braces, the tower, the left tower pole and the right tower pole each having a top located above the ground, a bottom and a height extending from the top to the bottom, the method comprising assembling a platform system by performing the following steps in any suitable order including simultaneously: securing a lower right clamp bracket system to the right tower pole by placing the lower right clamp bracket system at least partially around the right tower pole; securing an upper right clamp bracket system to the right tower pole by placing the upper right clamp bracket system at least partially around the right tower pole; securing a lower left clamp bracket system to the left tower pole by placing the lower left clamp bracket system at least partially around the left tower pole; securing an upper left clamp bracket system to the left tower pole by placing the upper left clamp bracket system at least partially around the left tower pole; providing a platform comprising a platform beam comprising a forward end, a rear end, a platform beam length extending from the platform beam forward end to the platform rear end; providing an upper cross beam and a lower cross beam. Optionally, at least after complete installation of the system, the lower left clamp bracket system is at substantially the same height as the lower right clamp bracket system; the lower cross beam extends between the lower left clamp bracket system and the lower right clamp bracket system and is oriented generally parallel to the ground and perpendicular to the left and right pole heights; the upper left clamp bracket system is at substantially the same height as the upper right clamp bracket system; the upper cross beam extends between the upper left clamp bracket system and the upper right clamp bracket system and is oriented generally parallel to the ground and perpendicular the left and right pole heights; the upper cross beam, the upper left clamp bracket system and the upper right clamp bracket system are located above the lower cross beam, the lower left clamp bracket system and the lower right clamp bracket system; the platform beam is connected to the lower cross beam and extends laterally from the lower cross beam; and/or a brace cable connects the platform beam to the upper cross beam and extends at an angle relative to the left and right tower pole heights and comprises an upper end connected to the upper cross beam and a lower end connected to the platform beam. Optionally, the system of paragraph 25 may include one or more features described in paragraphs 8-13 described above.

In still another embodiment, the present disclosure provides a method of securing a hoist to a tower comprising a rectangular tower pole, the rectangular tower pole having a top located above the ground, a bottom and a height extending from the top to the bottom, the method comprising assembling a hoist system by performing the following steps in any suitable order including simultaneously: providing an upper forward cross beam, an upper rear cross beam, a lower forward cross beam, and an lower rear cross beam; securing the upper forward cross beam and the upper rear cross beam to the rectangular tower pole by having a upper left rod extend and an upper right rod extend between the upper forward cross beam and the upper rear cross beam, the upper left and upper right rods are configured to draw the upper forward cross beam toward the upper rear cross beam to compress the tower pole between the upper forward cross beam and the upper rear cross beam; securing the lower forward cross beam and the lower rear cross beam to the rectangular tower pole by having a lower left rod extend and an lower right rod extend between the lower forward cross beam and the lower rear cross beam, the lower left and lower right rods are configured to draw the lower forward cross beam toward the lower rear cross beam to compress the tower pole between the lower forward cross beam and the lower rear cross beam; providing a hoist comprising a hoist beam comprising a forward end, a rear end, a hoist beam length extending from the hoist beam forward end to the hoist rear end. Optionally at least after complete installation of the system, the upper rear cross beam and upper forward cross beam are at substantially the same height; the lower rear cross beam and lower forward cross beam are at substantially the same height; the upper rear cross beam and the upper forward cross beam are above the lower rear cross beam and lower forward cross beam; the upper forward cross beam and lower forward cross beams extended laterally out from the tower pole on at least one side; the upper rear cross beam, the upper forward cross beam, the lower rear cross beam, and lower forward cross beam are oriented substantially parallel to the ground and perpendicular to the tower pole; the hoist beam is connected to the lower forward cross beam on an end of the lower forward cross beam extending to the side of the tower pole, the hoist beam extending forward from the lower cross beam; the hoist further comprises at least one sheave connected to the hoist beam and receiving a load line; a brace cable connects the hoist beam to the upper forward cross beam on an end of the upper forward cross beam extending to the side of the tower pole, the brace cable extends at an angle relative to the left and right tower pole heights and comprises an upper end connected to the upper forward cross beam and a lower end connected to the hoist beam.

Optionally, at least after complete installation of the system, a lower cross beam bracket is connected to the lower cross beam to the outside of, as opposed to between, the left and right lower rods, wherein a horizontally-oriented pivot bolt connects the hoist beam to the lower cross beam bracket, the hoist beam configured to rotate clockwise and counter-clockwise about a horizontally-oriented pivot bolt pivot axis extending generally perpendicular to the tower pole height, and rotation of the hoist beam about the horizontally-oriented pivot bolt pivot axis allows the hoist beam forward end to move upward and downward and toward and away from the tower (to allow the hoist beam to move between a raised and lowered positions). Optionally, a lower vertically-oriented pivot bolt connects the hoist beam to the lower cross beam bracket, the lower vertically-oriented pivot bolt located rearwardly relative to the horizontally-oriented pivot bolt and configured to allow the hoist beam to rotate clockwise and/or counter-clockwise about a lower vertically-oriented pivot bolt pivot axis extending generally parallel to the tower pole height, wherein rotation of the hoist beam about the lower vertically-oriented pivot bolt pivot axis allows the hoist beam to move toward and away from the lower forward cross beam (to allow the hoist beam to move in a plane perpendicular to the tower pole height). Optionally, the lower cross beam bracket further comprises a movable bridge, as described previously. Optionally, an upper cross beam bracket is connected to the upper cross beam outside of, as opposed to between, the left and right upper rods, the upper cross beam bracket located above the lower cross beam bracket, an upper vertically-oriented pivot bolt connects the upper end of the brace cable to the upper cross beam bracket, the brace cable configured to rotate (in a coordinated fashion with the hoist beam) clockwise and/or counter-clockwise about a upper vertically-oriented pivot bolt pivot axis extending generally parallel to the tower pole height, and rotation of the brace cable about the upper vertically-oriented pivot bolt pivot axis allows the hoist beam to move toward and away from the lower cross beam (to allow the hoist beam to move in the plane perpendicular to the tower pole height). Optionally, the system of paragraphs 26 and 27 may include one or more features described in paragraphs 8-13 described above.

BRIEF DESCRIPTION OF THE DRAWINGS

in FIG. 8, not all components of the first clamp bracket system are shown.

in FIG. 31A, a portion of the upper mast pipe is removed to show the internal components.

DETAILED DESCRIPTION

Figure 1:
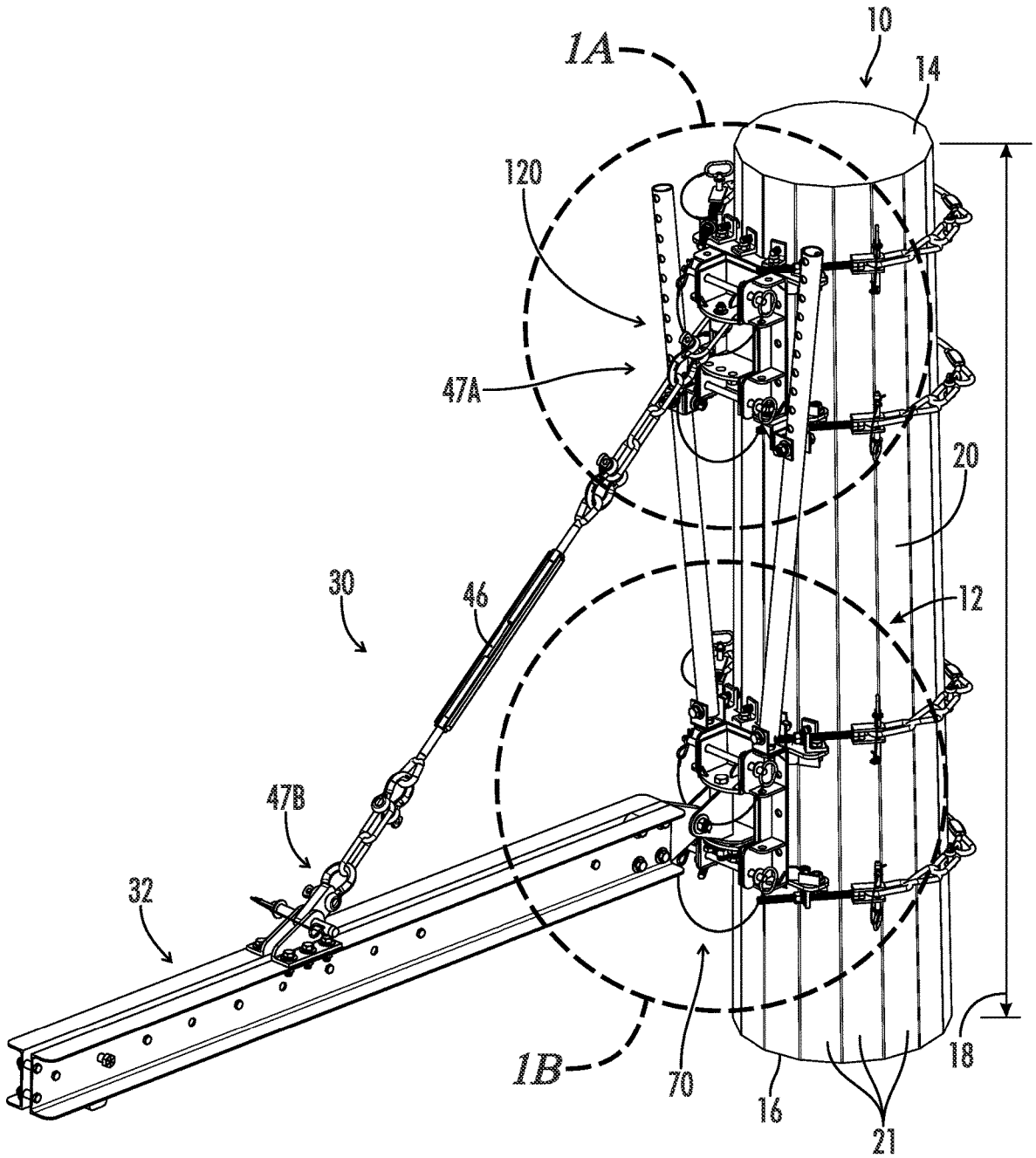
FIG. 1. illustrates a front top side perspective view of a hoist of one embodiment of the present invention attached to a monopole.

With reference to FIGS. 1-47, the present disclosure provides hoists, platforms and davits that may be secured to a tower 10, such as a telecommunications tower (e.g., a monopole, self-support tower or guyed tower) or a column of a building, preferably on a temporary basis, for example, to allow operators to maintain equipment and add to equipment on the tower 10. In the drawings, not all reference numbers are included in each of the drawings for the sake of clarity. FIGS. 1-47 are CAD drawings drawn to scale, however, it will be appreciated that other dimensions are possible.

More particularly, in one embodiment, the present disclosure describes a method of securing a hoist 30 to a tower pole 12 of a tower 10.

The tower 10 may be comprised of a tower pole 12 having any desired shape or structure known or later developed. For example, as known to those of ordinary skill, the tower pole 12 may comprise a tower pole top 14 located above the ground, a tower pole bottom 16 which may be connected directly or indirectly to the ground, a tower pole height 18 extending from the tower pole top 14 to the tower pole bottom 16, and a tower pole outer surface/outer wall/perimeter 20.

The hoist 30 may be secured to the tower pole 12 by performing one or more steps in any suitable order including simultaneously. One step may comprise securing a first clamp bracket system to the tower pole 12 by placing the first clamp bracket system at least partially around the tower pole 12. Another step may comprise providing a hoist 30 comprising a hoist beam 32. Optionally, the hoist beam 32 comprises a forward end 34, a rear end 36, and a hoist beam length 38 extending from the forward end 34 to the rear end 36.

Figure 36:
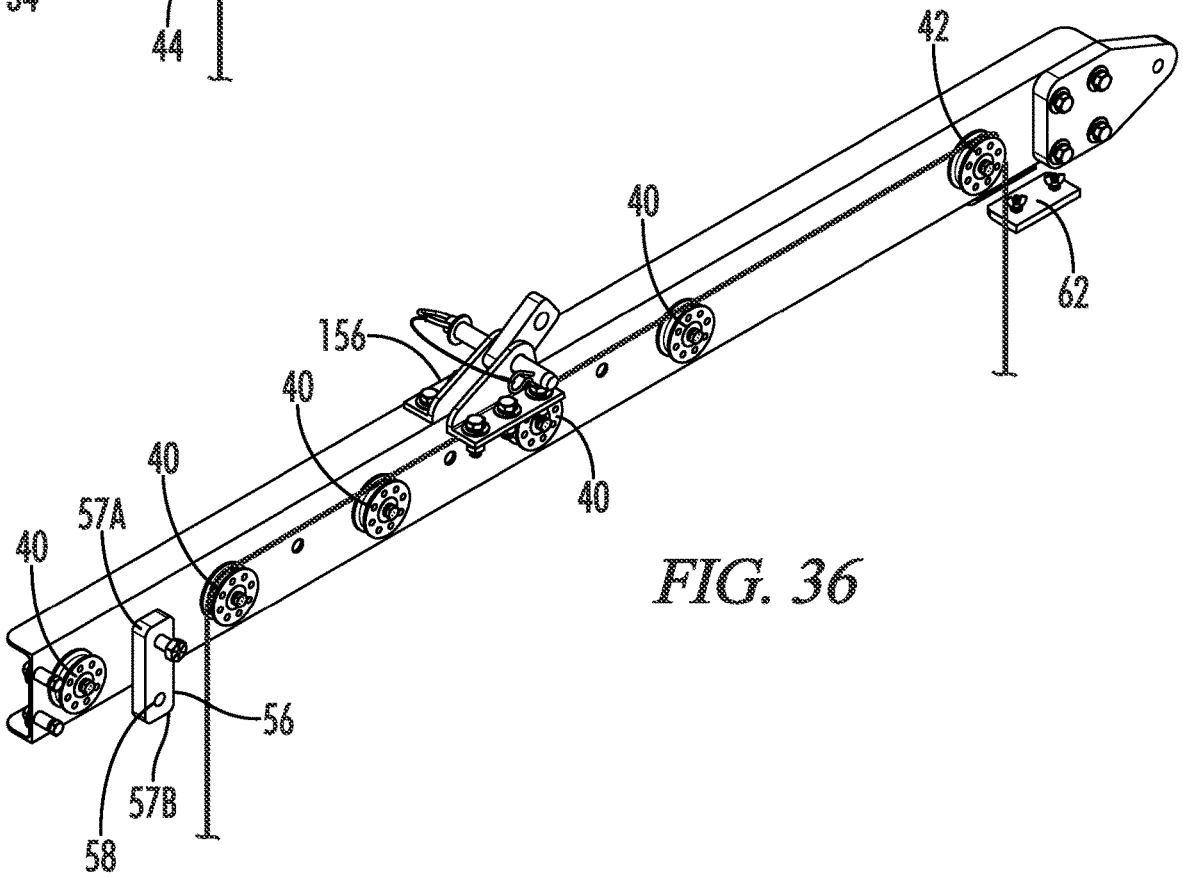
FIG. 36 illustrates a front top side perspective view of a portion of the hoist beam of FIG. 35.

At least after complete installation of the system (i.e., at least after all parts are installed if not prior to), the hoist 30 may have one or more of the features described below. For example, optionally, the first clamp bracket system connects the hoist beam rear end 36 to the tower pole 12. Further, the hoist beam 32 may extend laterally from the tower pole 12 and the first clamp bracket system, as seen in FIG. 1 for example. Optionally, as best seen in FIG. 36, the hoist 30 may comprise at least one sheave 40, 42 connected to the hoist beam 32 and receiving a pulley cable/load line 44. Optionally, the hoist 30 may also comprise a brace cable 46 connecting the hoist beam 32 to the tower pole 12 and extending at an angle relative to the tower pole height 18, as seen in FIG. 1 for example. The brace cable 46 may further comprise an upper end 47A connected to the tower pole 12 and a lower end 47B connected to the hoist beam 32, as seen in FIG. 1 for example.

The hoist beam 32 may further comprise at least one load-end sheave 40 and at least one return sheave 42, as best seen in FIG. 36. Preferably, the at least one load-end sheave 40 and at least one return sheave 42 are located between the hoist beam forward end 34 and hoist beam rear end 36. Preferably, the at least one return sheave 42 is located between the at least one load-end sheave 40 and the hoist beam rear end 36. The at least one load end sheave 40 and return sheave 42 are optionally configured to rotate about axes extending generally perpendicular to the hoist beam length 38. Preferably, a load line 44 attached to a load (e.g., an antenna) runs upwards from below the hoist beam 32, runs at least partially around at least one load-end sheave 40 and the at least one return sheave 42, and then returns below the hoist beam 32.

The load line 44 may be connected to a load located below the hoist beam 32. Preferably, the end of the load line 44 running at least partially around the at least one load end sheave 40 is the end connected to load. In some embodiments, the other end of the load line 44 (i.e., the end running at least partially around the return sheave 42), may run through a heel block and connect to a winch (not shown). Optionally, the heel block is located below the hoist beam 32 and connected to the tower pole 12. The load line 44 optionally runs upwards from the heel block to the at least one return sheave 42. The segment/section of the load line 44 running between the heel block and the at least one return sheave 42 may optionally be oriented substantially parallel with the tower pole height 18.

In some embodiments, the hoist beam 32 comprises a plurality of load-end sheaves 40 spaced about the hoist beam length 38. Each load-end sheave 40 in the plurality of load-end sheaves 40 is capable of lifting loads at different distances from the tower pole 12 and has a different maximum weight capacity based on the location of the load-end sheave 40 along the hoist beam length 38. An operator will be capable of selecting the correct load-end sheave 40 to use to lift a particular load based on the weight of the load and the distance from the tower pole 12 at which the load is before lifting and/or the distance at which the load will need to be after lifting.

Figure 37:
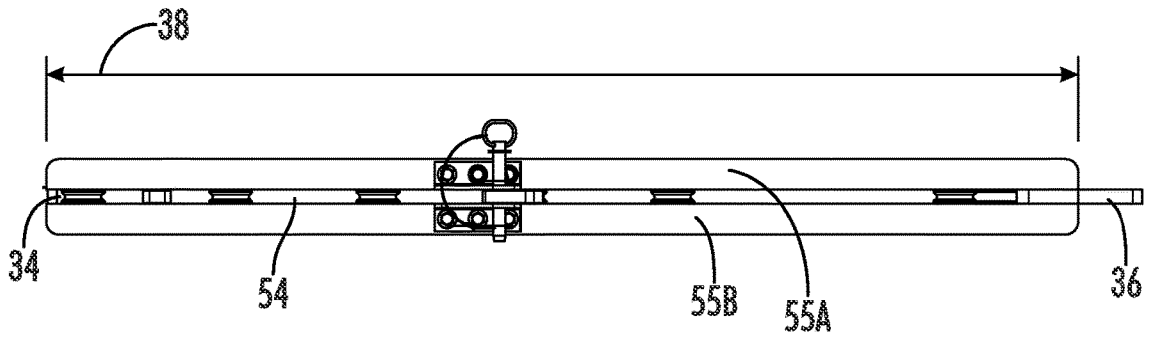
FIG. 37 illustrates a top plan view of the hoist beam of FIG. 35.
Figure 38:
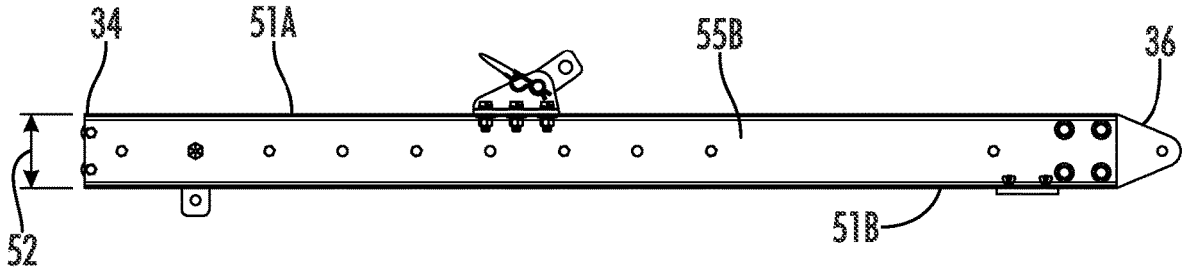
FIG. 38 illustrates a side elevation view of the hoist beam of FIG. 35.
Figure 39:
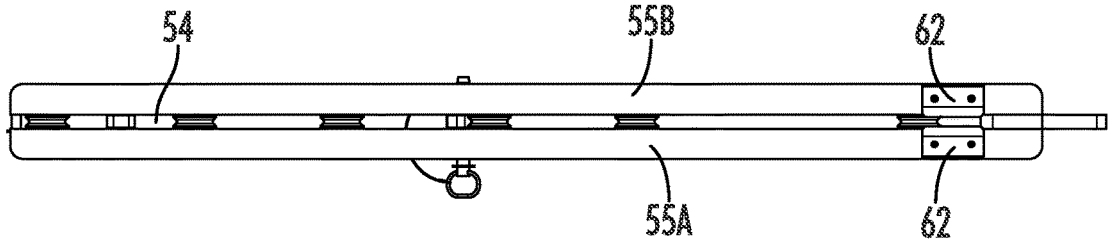
FIG. 39 illustrates a bottom plan view of the hoist beam of FIG. 35.

In some embodiments, the hoist beam 32 may optionally comprise one or more of the following features. For example, as best seen in FIGS. 35-37 and 39, the hoist beam 32 may comprise a top 51A, a bottom 51B, a hoist beam height 52 extending from the top 51A to the bottom 51B, and/or a hoist beam channel 54 extending from the hoist beam top 51A to hoist beam bottom 51B. Optionally, the hoist beam channel 54 divides the hoist beam 32 into a hoist beam left side 55A and hoist beam right side 55B. Preferably, at least after complete installation of the hoist 30, the least one load-end sheave 40, the at least one return sheave 42, and at least a section of the load line 44 are located in the hoist beam channel 54, as best seen in FIGS. 37 and 39. Preferably, the hoist beam 32 is generally straight along the hoist beam length 38.

In some embodiments, the hoist 30 may further comprise a termination bracket 56, as best seen in FIG. 36. Optionally, the termination bracket 56 may have an upper end 57A located in the hoist beam channel 54 and a lower end 57B extending downward from the hoist beam 32. Further, the termination bracket 56 may be generally rectangular in shape. Preferably, the lower end 57B comprises a termination bracket hole 59. Optionally, one end of a tie-off cable/rope/wire (not shown) is secured to the termination bracket 56 and a second end of the tie-off cable/rope/wire is secured to a human.

Figure 35:
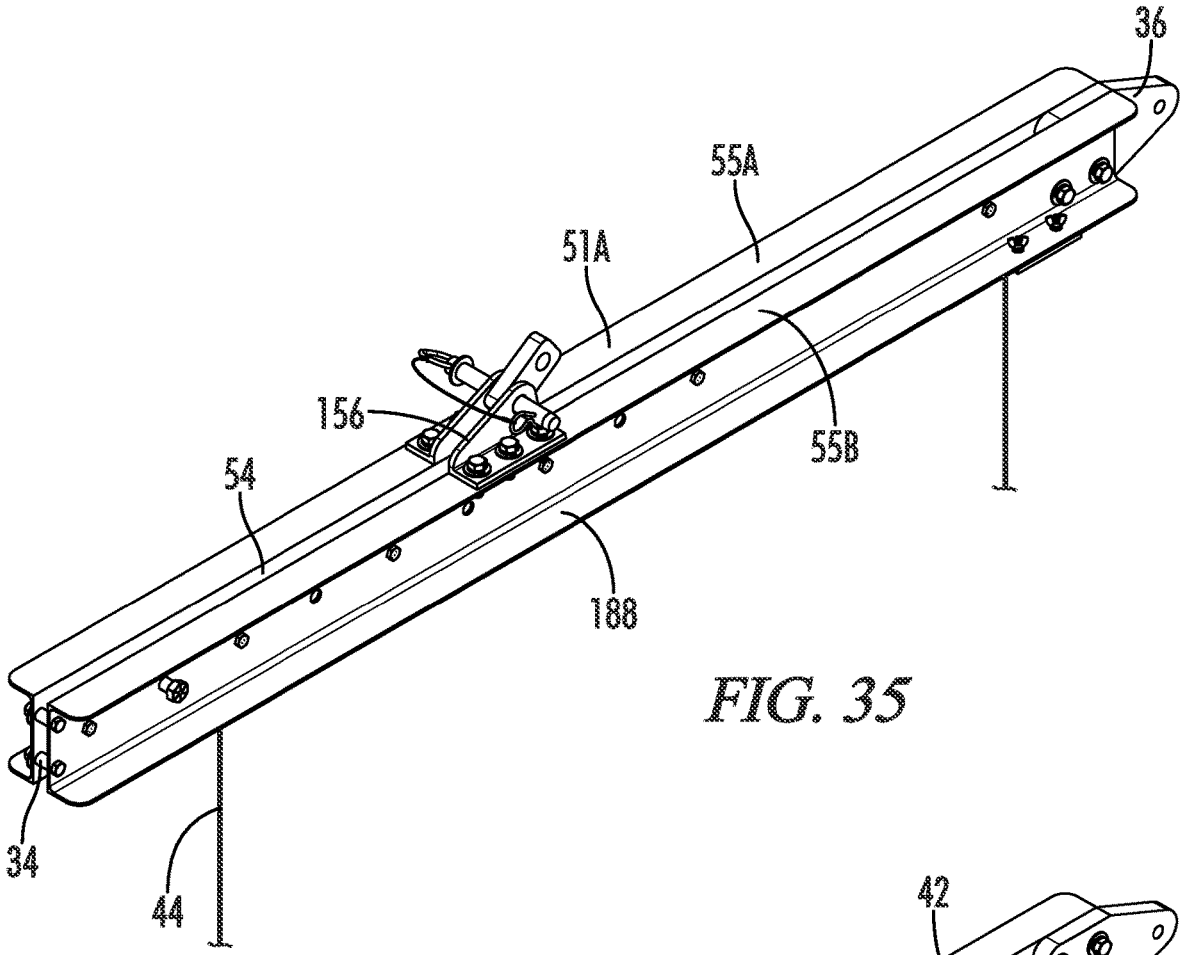
FIG. 35 illustrates a front top side perspective view of a hoist beam of another embodiment of the present invention.

The load line 44 may be configured in one or more of the following ways. In some embodiments, the load line 44 may run from below the hoist beam 32, up through the hoist beam channel 54 between the at least one return sheave 42 and the hoist beam rear end 36, at least partially around the at least one return sheave 42 and the at least one load-end sheave 40, and back down through the hoist beam channel 54 between the at least one load-end sheave 40 and the hoist beam forward end 34. Optionally, the load line 44 may further run down to a load sheave (not shown) connected to a load (not shown), through the load sheave, and back up to the hoist beam 32, as shown in FIGS. 35-36 for example. In some cases, the end of the load line 44 running back up from the load sheave may be secured to the termination bracket 56. This configuration may be referred to in the industry as 2-part line termination. Such a configuration may reduce the force that must be applied to a load line 44 to lift a load. Those having ordinary skill in the art will understand how to attach further sheaves to the load and hoist beam 32 to further reduce the force necessary to lift a load.

The load line 44 may be any rope, wire, or cable now known or later developed that is suitable for lifting. Preferably, the load line 44 is a fiber rope or a wire rope.

Optionally, the hoist beam 32 further comprises one or more of rope guides 62, as best seen in FIGS. 36 and 39. The rope guides 62 may have one or more of the features described below. For example, the rope guides 62 may be located on the hoist beam bottom 51B on either or both the hoist beam left side 55A and hoist beam right side 55B. Preferably, the rope guides 62 are adjacent to the hoist beam channel 54. Optionally, the rope guides 62 are located along the hoist beam length 38 between the hoist beam rear end 36 and the at least one return sheave 42. Preferably, the rope guides 62 are configured to prevent wear on the hoist beam 32 and load line 44 caused by the load line 44 making contact with the hoist beam 32 as a load is raised or lowered. Contact between the hoist beam 32 and load line 44 may occur, for example, if the heel block (not shown) is not directly below the hoist beam 32 or if the hoist beam 32 is rotated around the tower pole 12 horizontally in a plane substantially perpendicular to the tower pole height 18. The ropes guides 62 may be configured to be sacrificial, i.e., designed to suffer the wear caused by contact with the load line 44 and be replaced once the wear reaches a particular level.

In some cases, the tower 10 may be a telecommunications tower. For example, the hoist 30 may be attached to cell phone towers including monopole, guyed, or self-support towers. In the case of a monopole tower or other similar tower, the tower pole 12 is the monopole. In the case of guyed, self-support, or similar towers, the tower pole 12 may be one or more of the tower legs. Optionally, the telecommunications tower may further comprise an antenna. In other embodiments, the tower pole may be a structural column in a building 64 comprising an interior 66, in which case, optionally, the first clamp bracket system 70 faces the building interior 66 when the tower pole 12 is a structural column in a building 64.

Further, at least after complete installation of the system, the first clamp bracket system 70 may have one or more of the following features. The first clamp bracket system 70 may comprise a first clamp central bracket 72, best seen in FIGS. 1A and 1B. Optionally, the first clamp central bracket 72 may comprise a front side 74 connected to the hoist beam rear end 36, a rear side 76 facing the tower pole 12, a left side 77A, and a right side 77B. Preferably, the first clamp central bracket rear side 76 engages the tower pole 12 and is opposite the front side 74.

In some embodiments, as seen in FIG. 1 and throughout the drawings, the first clamp bracket system 70 may comprise a u-shaped/circular cable system 78 extending partially around the tower pole 12. The u-shaped/circular cable system 78 may comprise a first end 80 connected to the first bracket clamp left side 77A and a second end 82 connected to the first bracket clamp right side 77B. Optionally, the u-shaped/circular cable system 78 comprises one or more chain tensioners 88, 96 and one or more chains 84, 100 that engage the outer wall/outer surface/perimeter 20 of the tower 10 and fix the first clamp central bracket 72 to the tower pole 12 via tension. The chain tensioners 88, 96 may connect the one or more chains 84, 100 to the first clamp central bracket 72.

For example, as shown in FIG. 1 and throughout the drawings, the u-shaped cable system 78 may have one or more of the features described below. The u-shaped cable system 78 may have a left chain 84, a left chain tensioner 88, a flexible clamp cable 92, a right chain 100, and/or a right chain tensioner 96. Optionally, the left chain tensioner 88 may have a forward end 90A connected to the first clamp central bracket left side 77A and/or a rear end 86B connected to a left chain forward end 86A. The left chain 84 may optionally have a rear end 86B connected to a flexible clamp cable left end 94B. Optionally, the flexible clamp cable 92 may have a right end 94A connected to a right chain rear end 102B, the right chain 100 may have a forward end 102A connected to a right chain tensioner rear end 98B, and the right chain tensioner 96 may have a forward end 98A connected to the first clamp central bracket right side 77B. Without being bound to any particular theory, the flexible cable 92 may prevent slippage and rotation of the hoist 30 on the tower pole 12 by increasing the friction and making greater contact with the tower pole surface 20 than a chain. At least after complete installation, the first clamp bracket system 70 may form a complete loop about said tower pole 12.

Figure 4:
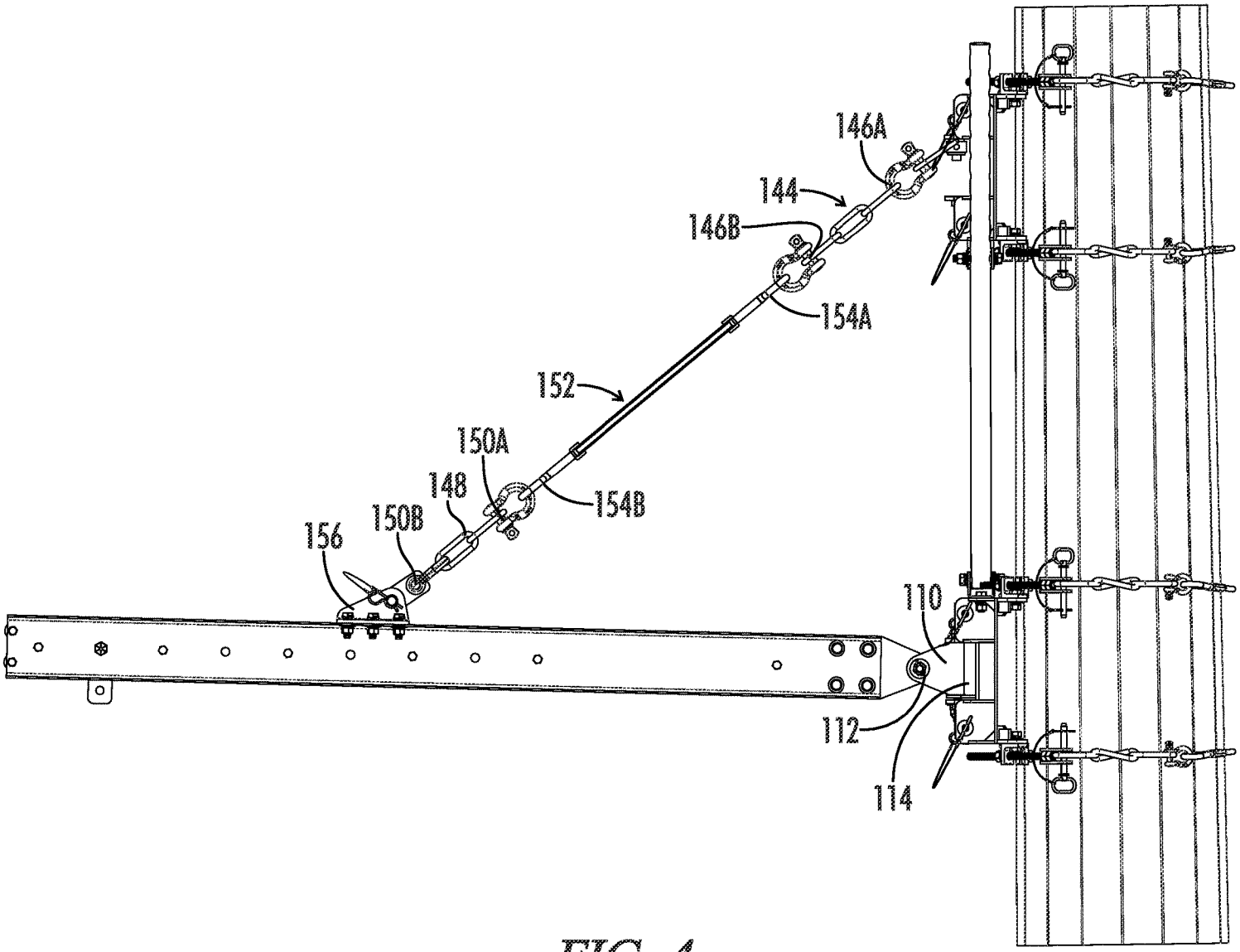
FIG. 4 illustrates a side elevation view of the hoist of FIG. 1 with the hoist beam in a lowered position.
Figure 5:
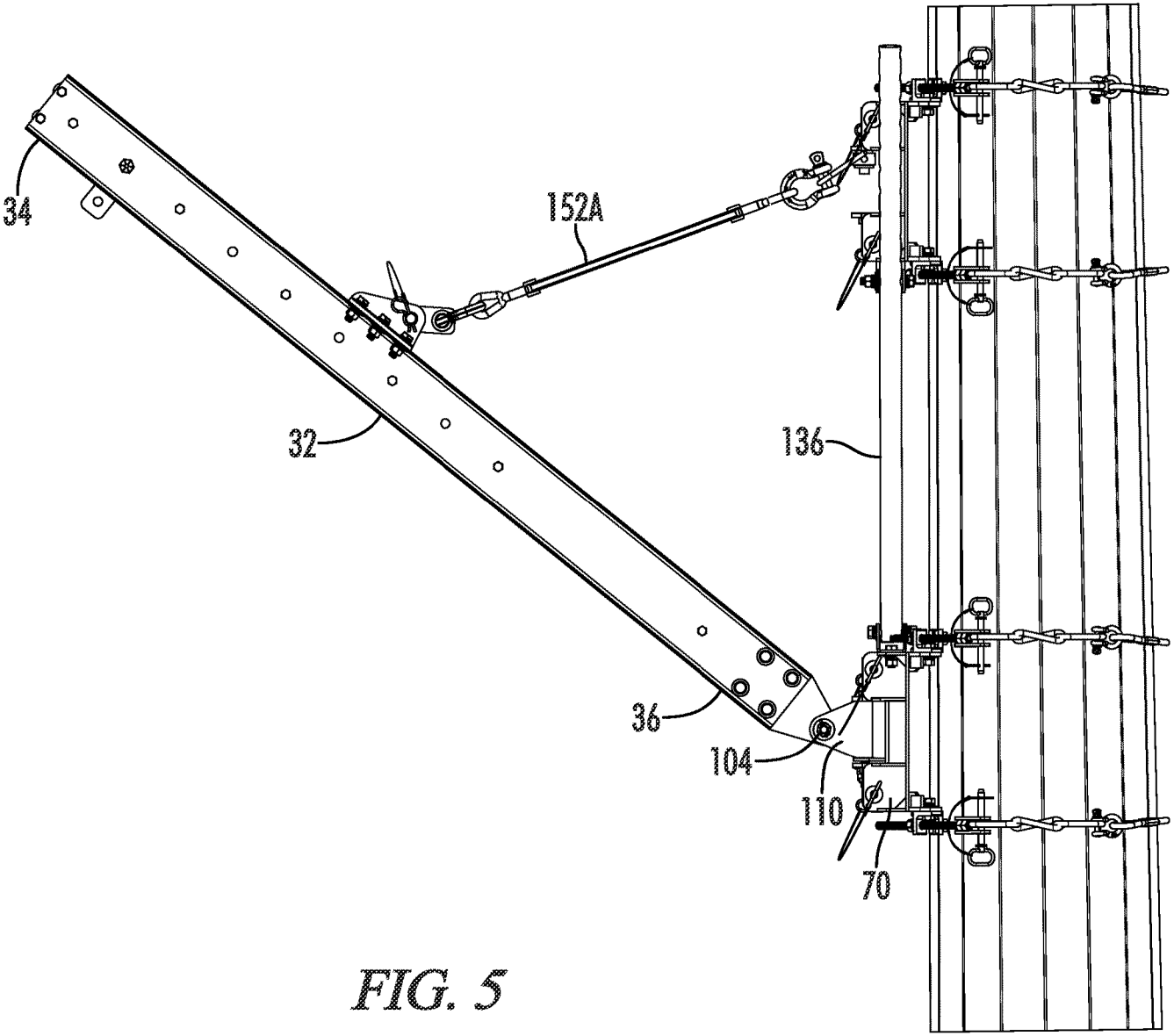
FIG. 5 illustrates a side elevation view of the hoist of FIG. 1 with the hoist beam in a raised position.

In some embodiments, at least after complete installation of the system, the hoist beam 32 is pivotally connected to the first clamp central bracket 72 by at least two pivots such that the hoist beam 32 can at least partially rotate around the tower pole 12 in the plane perpendicular to the tower pole height 18 and/or the hoist beam forward end 34 can move relative to the hoist beam rear end 36 between a raised position (shown in FIG. 5 for example) and a lowered position (shown in FIG. 4 for example). In the raised position, the hoist beam forward end 34 is located higher than the hoist beam rear end 36. In the lowered position, the hoist beam forward end 34 may be located at the same height or lower than the hoist beam rear end 36. In some cases, the two pivots may have perpendicular pivot axes so that the hoist beam 32 may simultaneously move in two planes that are perpendicular to each other.

Figure 1A:
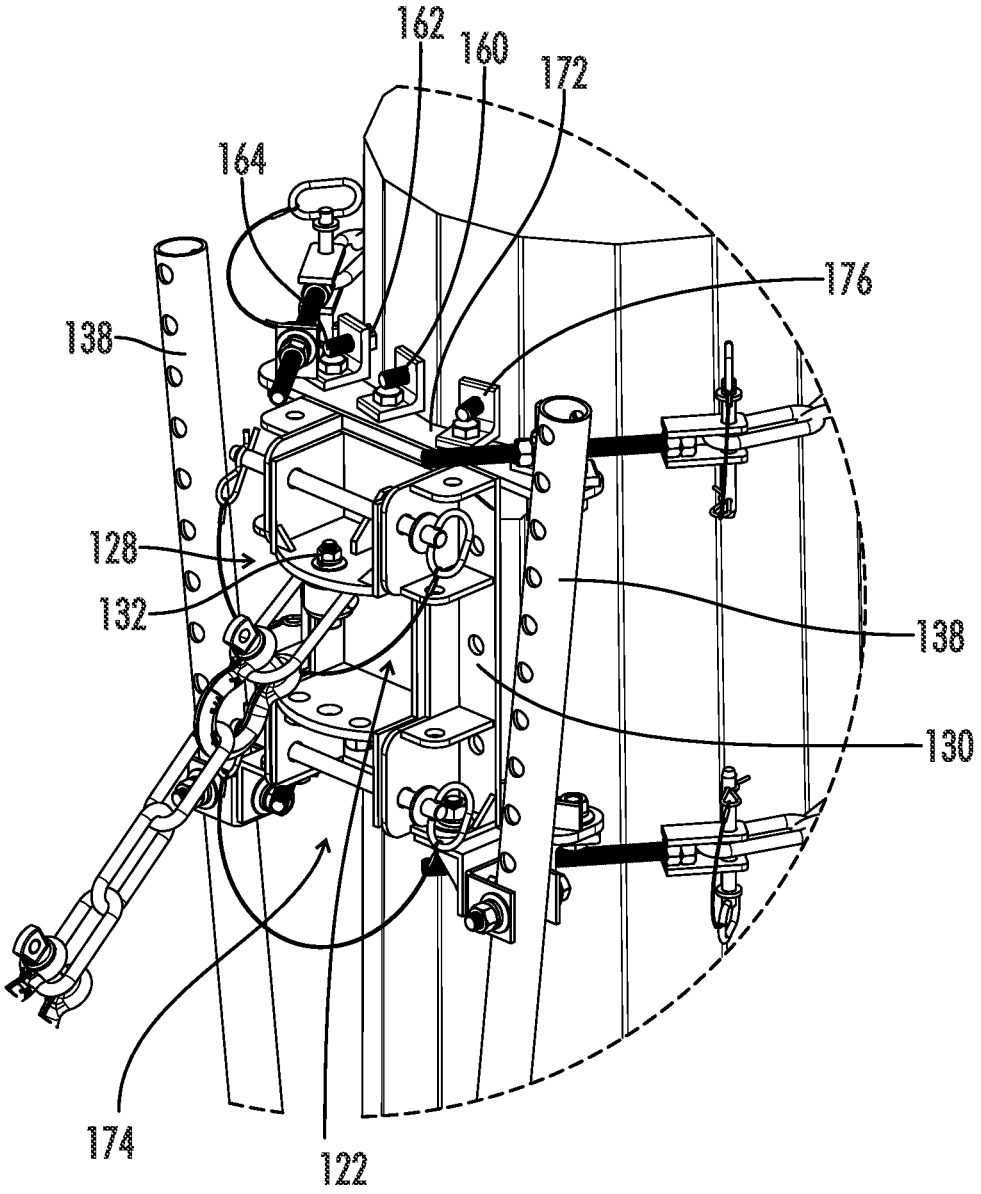
FIG. 1A illustrates a closeup view of the circled area labelled 1A in FIG. 1.
Figure 1B:
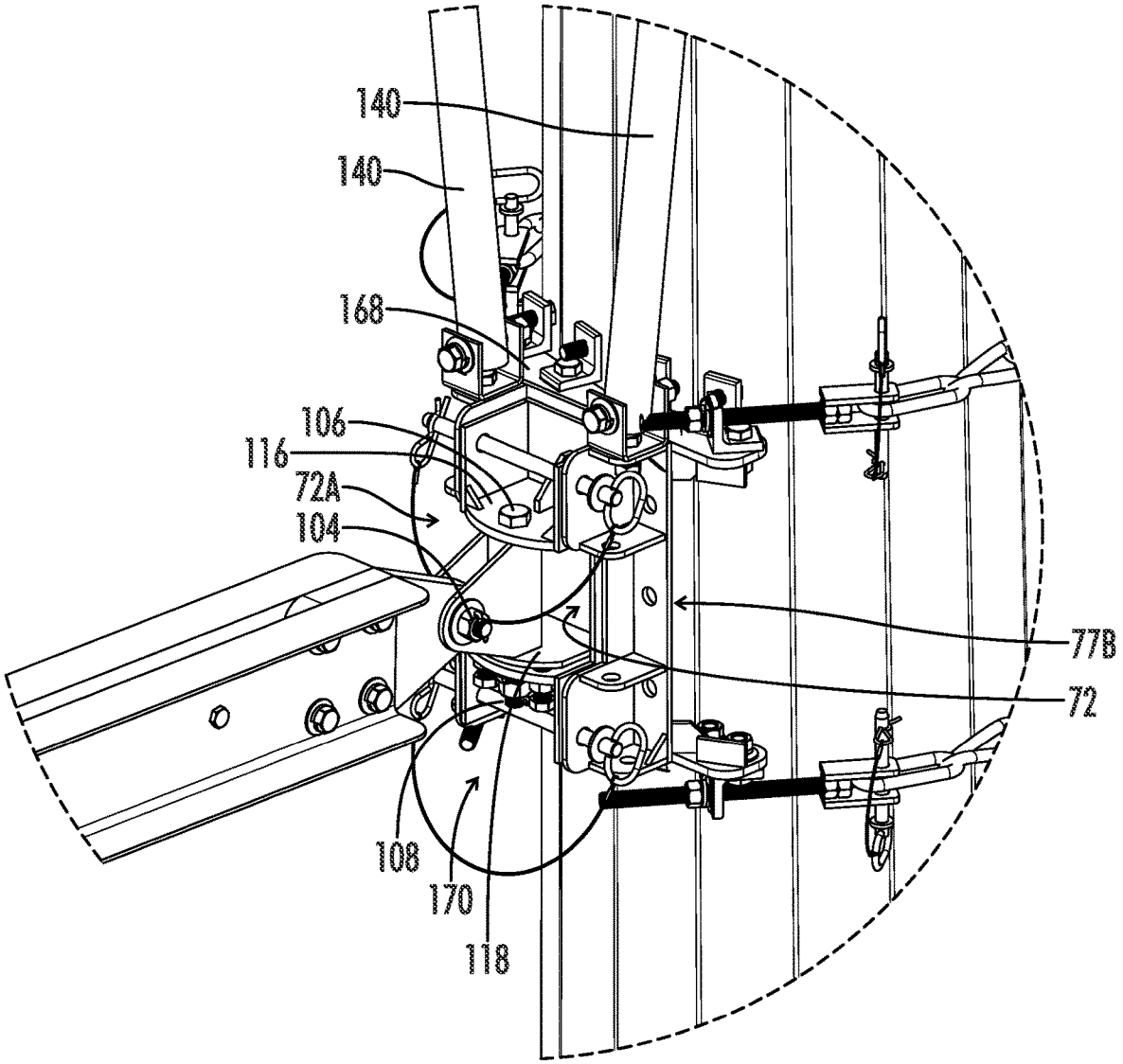
FIG. 1B illustrates a closeup view of the circled area labelled 1B in FIG. 1.
Figure 1C:
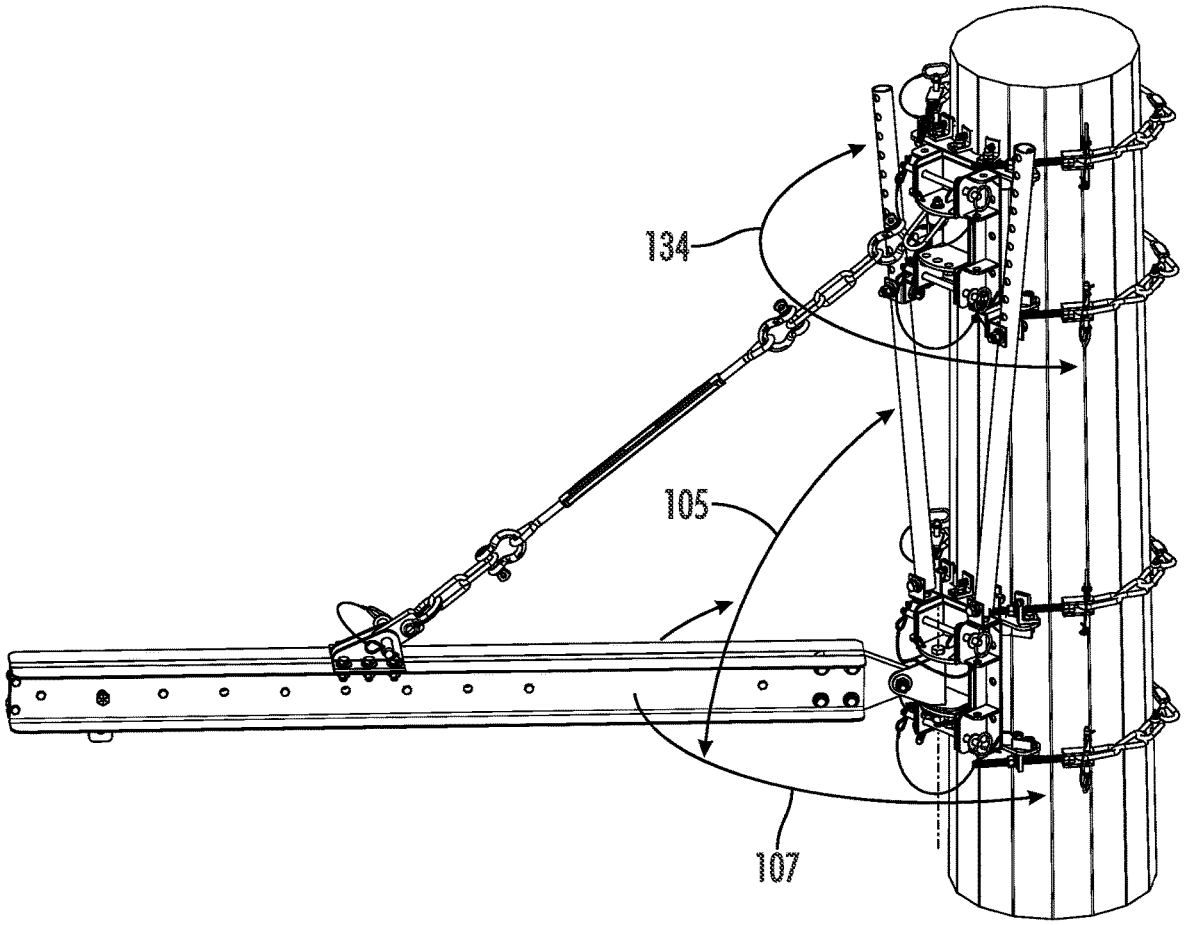
FIG. 1C illustrates a front top side perspective view of the hoist of FIG. 1 with arrows showing how the hoist beam moves up and down (between the raised and lowered position) and laterally (i.e., in the plane perpendicular to the pole height).
Figure 2:
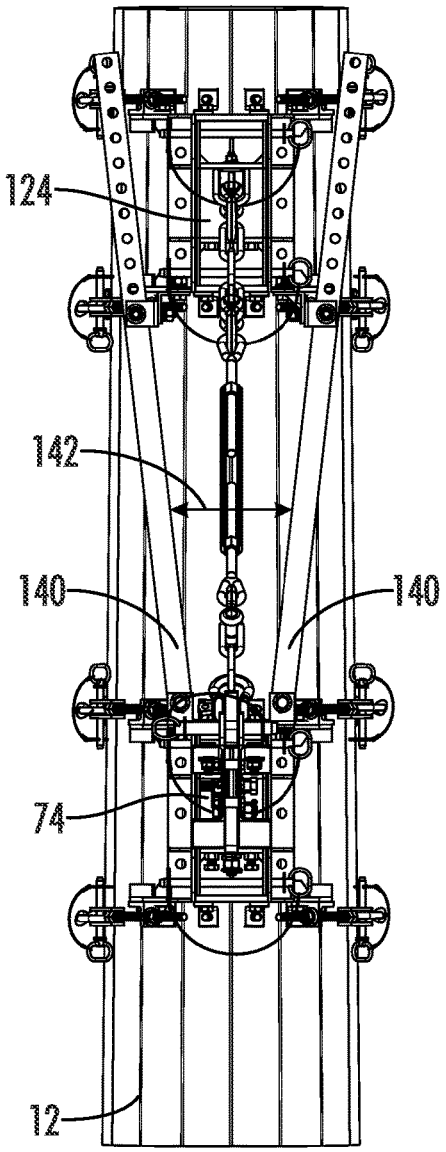
FIG. 2 illustrates a front elevation view of the hoist of FIG. 1.
Figure 3:
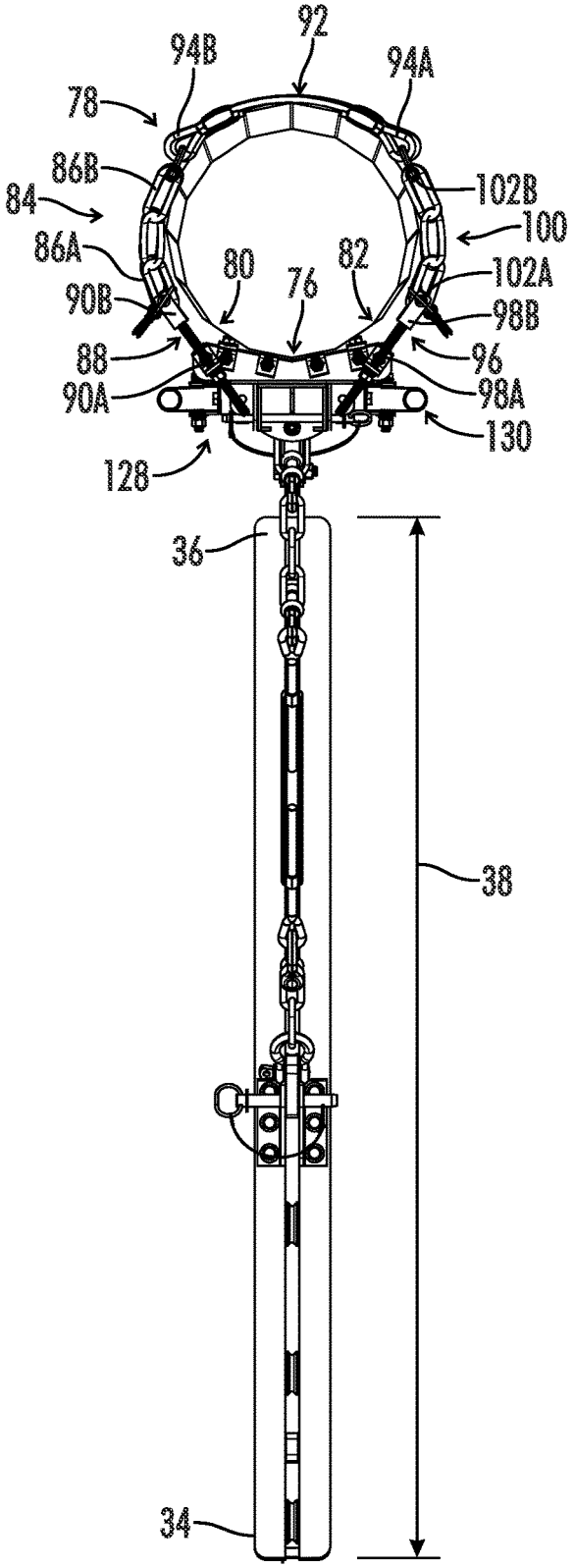
FIG. 3 illustrates a top plan view of the hoist of FIG. 1.

For example, at least after complete installation of the system, as best seen in FIG. 1B, a horizontally-oriented pivot bolt may pivotably connect the hoist beam 32 to the first clamp central bracket 72. Optionally, the horizontally-oriented pivot bolt 104 may be configured to allow the hoist beam 32 to rotate clockwise and/or counter-clockwise about a horizontally-oriented pivot bolt pivot axis 105 extending generally perpendicular to the tower pole height 18. Thus, the rotation of the hoist beam 32 about the horizontally-oriented pivot bolt pivot axis 105 may allow the hoist beam forward end 34 to move upward and downward and toward and away from the tower pole top 14. In other words, the rotation of the hoist beam 32 about the horizontally-oriented pivot bolt pivot axis 105 may allow the hoist beam 32 to move between the raised and lowered positions. The horizontally-oriented pivot bolt 104 may or may not rotate with the hoist beam 32 about the horizontally-oriented pivot bolt pivot axis 105.

As shown in FIG. 1B, a lower vertically-oriented pivot bolt 106 may also pivotably connect the hoist beam 32 to the first clamp central bracket 72. Optionally, the lower vertically-oriented pivot bolt 106 may be configured to allow the hoist beam 32 to rotate clockwise and/or counter-clockwise about a lower vertically-oriented pivot bolt pivot axis 107 extending generally parallel to the tower pole height 18. Thus, rotation of the hoist beam 32 about the lower vertically-oriented pivot bolt pivot axis 107 may allow the hoist beam 32 to rotate at least partially around said tower pole 12 in the plane perpendicular to the tower pole height 18. Optionally, the lower vertically-oriented pivot bolt 106 may or may not rotate with the hoist beam 32 about the lower vertically-oriented pivot bolt pivot axis 107. In some embodiments, the lower vertically-oriented pivot bolt 106 is located rearwardly relative to the horizontally-oriented pivot bolt 104.

Further, the first clamp bracket system 70 may further comprise a brake 108 configured to prevent rotation of the hoist beam 32 clockwise and/or counter-clockwise about the lower vertically-oriented pivot bolt pivot axis 107 when the brake 108 is engaged.

As shown in FIG. 1B, the first clamp central bracket 72 may further comprise a movable bridge 110. The movable bridge 110 may optionally comprise a forward section 112 comprising the horizontally-oriented pivot bolt 104 and a rear section 114 comprising the lower vertically-oriented pivot bolt 106. The movable bridge 110 may be configured to rotate around the lower vertically-oriented pivot bolt pivot axis 107 with the hoist beam 32 to allow the hoist beam 32 to move in the plane perpendicular to the tower pole height 18. Optionally, the movable bridge 110 may remain stationary while the hoist beam 32 rotates about the horizontally-oriented pivot bolt pivot axis 105.

As shown in FIG. 1B, the first clamp central bracket 72 may further comprises an upper plate 116 comprising an upper plate bolt hole (not shown) and a lower plate 118 comprising a lower plate bolt hole 119. Optionally, the movable bridge 110 may be positioned between the upper plate 116 and the lower plate 118 on the first clamp central bracket 72. Further, the lower vertically-oriented pivot bolt 116 may extend vertically through the movable bridge 110 and/or may be positioned in and rotate in the upper plate bolt hole and lower plate bolt hole 119 as the hoist beam 32 rotates about the lower vertically-oriented pivot bolt pivot axis 119. The first clamp central bracket brake 108 may optionally be configured to prevent rotation of the movable bridge 110 and/or the hoist beam 32 from rotating around the lower vertically oriented pivot bolt axis 107.

Optionally, as shown in FIG. 1, the hoist 30 may be also secured to the tower pole 12 by a second clamp bracket system 120 that is placed at least partially around the tower pole 12 above the first clamp bracket system 72. At least after complete installation of the system, the second clamp bracket system 120 may comprise one or more of the features described below and shown in FIG. 1A. The second clamp bracket system 120 may be located above the first clamp bracket system 70. The second clamp bracket system 120 may comprise a second clamp central bracket 122 comprising a front side 124 connected to the brace cable upper end 47A, a rear side 126 facing the tower pole 12 and opposite the front side 124, a left side 128, and/or a right side 130. Preferably, the second clamp bracket rear side 126 engages the tower pole surface 20. Further, the brace cable upper end 47A may optionally be pivotally connected to the second clamp central bracket 122 via at least one pivot such that the hoist beam 32 can at least partially rotate around the tower pole 12 in the plane perpendicular to the pole height 18.

As shown in FIG. 1A, an upper vertically-oriented pivot bolt 132 may pivotably connect the brace cable upper end 47A to the second clamp central bracket 122. Preferably, the upper vertically-oriented pivot bolt 132 is configured to allow the brace cable 46 to rotate clockwise and/or counter-clockwise about an upper vertically-oriented pivot bolt pivot axis 134 extending generally parallel to the tower pole height 18. In such configuration, rotation of the brace cable 46 about the upper vertically-oriented pivot bolt pivot axis 134 may allow the hoist beam 32 to rotate at least partially around the tower pole 12 in the plane perpendicular to the pole height 18. Preferably, the brace cable 46 rotates about the upper vertically-oriented pivot bolt axis 134 in coordination with the hoist beam 32 as the hoist beam 32 rotates about the lower vertically-oriented pivot bolt axis 107.

Optionally, the upper vertically-oriented pivot bolt 132 may or may not rotate with the brace cable 46 about the upper vertically-oriented pivot bolt pivot axis 134. The upper vertically-oriented pivot bolt 132 may optionally be located directly above the lower vertically-oriented pivot bolt 106 such that the upper and lower vertically-oriented pivot bolt axes 107, 134 are vertically aligned.

As shown in FIG. 1A, the second clamp central bracket 122 may further comprises an upper plate 116 comprising an upper plate bolt hole (not shown) and a lower plate 118 comprising a lower plate bolt hole 119. Optionally, the upper vertically-oriented pivot bolt 132 may be positioned in and rotate in the upper plate bolt hole and lower plate bolt hole 119 as the hoist beam 32 rotates about the upper vertically-oriented pivot bolt pivot axis 132.

As seen in FIG. 1 and throughout, at least one vertical brace 136 may extend generally parallel to the tower pole height 18 and connect the first clamp central bracket 72 to the second clamp central bracket 122. Preferably, a pair of vertical braces 136 spaced apart by a distance 142 extending between the first and second clamp central brackets 72, 122 and connect the first and second clamp central bracket 72, 122. Preferably, each vertical brace 136 comprises an upper end 138 and a lower end 140, and the distance 142 between the vertical braces is less at the vertical brace lower ends 140 as compared to the vertical brace upper ends 138 to form a V-shape, as seen in FIG. 1 for example. Preferably, the first and second clamp central brackets 72, 122 are vertically aligned. Without being bound to any particular theory, the vertical brace 136 may help to increase stability and improve structural integrity. Preferably, the vertical braces 136 may be used for all configuration without a mast 200.

As shown in FIG. 1 and throughout the drawings, the brace cable 46 may comprise an upper chain 144, a turnbuckle 152, and/or a lower chain 148. Optionally, the upper chain 144 may have an upper end 146A connected to the upper vertically-oriented pivot bolt 132 and a lower end 146B connected to an turnbuckle upper end 154A. Optionally, the lower chain 148 may comprise an upper end 150A connected to a turnbuckle lower end 154B and a lower end 150B connected to the hoist beam 32. The turnbuckle 152 may be configured to change the orientation of the hoist beam 32. For example, the turnbuckle 152 may be configured to move the hoist beam 32 into the raised position when the turnbuckle is shortened 152A and the lowered position when the turnbuckle is lengthened 152B. Optionally, a removable bolt/lug 156 connects the hoist beam 32 to the brace cable lower end 47B.

Optionally, the upper and lower brace cable chains 144, 148 may be replaced by a cable, wire, or other suitable component. Similarly, the turnbuckle 152 may optionally be replaced with a ratchet or other suitable mechanism for shortening or elongating the brace cable 46.

In some embodiments, the hoist 30 may comprise a plurality of jack bolts 160 extend through a portion of the first clamp central bracket 72 and/or the second clamp central bracket 122 and engage the tower pole surface 20. Optionally, the plurality of jack bolts 160 may be located on a top 168, 172 of the first and/or second clamp central brackets 72, 122, a bottom 170, 174 the first and/or second clamp central brackets 72, 122, or both the top 168, 172 and bottom 170, 174 of the first and/or second clamp central brackets 72, 122. Preferably, the plurality of jack bolts 160 are threaded and do not extend into the tower pole 12. Without being bound to any particular theory, said engagement between the jack bolt 160 and the tower pole outer surface/outer wall 20 may be configured to allow for optimal spacing, alignment, and orientation of the first and/or the second clamp central bracket 72, 122, especially if the tower pole is tapered. Tapered poles may prevent the clamps from having the correct vertical and horizontal orientation otherwise. Optionally, he connection between the plurality of jack bolts 160 and the tower pole 12 is not a mechanical interconnection of a bolt extending into a hole in the tower pole 12 but rather a part of each jack bolt 160 engages the tower pole outer surface/outer wall 20.

More particularly, the jack bolts 160 may be structured such that each jack bolt 160 comprises a proximal end 162 facing and engaging the tower pole outer surface/outer wall 20 and a distal end 164 opposite the proximal end 162, and a length (not shown) extending from the jack bolt 160 proximal end to the distal end 164. Preferably, the jack bolts 160 are oriented such that the jack bolt length extends generally perpendicular to the tower pole height 18. The jack bolts 160 may be optionally spaced partially about a perimeter of a tower pole 12. Optionally, the jack bolts 160 are adjustable such that adjustment of the jack bolt 160, for example, turning the jack bolts 160 clockwise and/or counter-clockwise, allows the jack bolt proximal end 162 to move toward and away from the tower pole 12. The jack bolts 160 may also be configured, for example, such that adjustment of the jack bolts 160 moves the first and/or second clamp brackets 72, 122 toward or away from the tower pole outer surface/outer wall 20. Optionally, the jack bolt proximal end 162 may stay engaged with the tower pole outer surface/outer wall 20 as the jack bolt 160 is adjusted. Different methods of adjustment, for example, a ratcheting system, are also possible and will be apparent to those skilled in the art.

In some embodiments, the first and second clamp central brackets 72, 122 may comprise a plurality of jack brackets 176 spaced partially about a perimeter of the tower pole 12. Optionally, each jack bracket 176 further comprises a side facing the tower pole 12 with each of the respective sides facing the tower pole outer surface/outer wall 20 comprising a hole (not shown without jack bolt extending through it) oriented generally perpendicular to the tower pole height 18. Each of the respective holes may further comprise an adjustable, preferably threaded, jack bolt 160 extending laterally through the respective hole perpendicular to the tower pole height 18. As above, the adjustable jack bolt 160 may engage the outer surface/outer wall 20 and preferably prevent the first and/or second central brackets 72, 122 from rotating or sliding relative to the tower pole 12 while also preferably allowing for the hoist beam 32 to rotate about the lower vertically-oriented pivot bolt axis 107 in a true horizontal arc. Optionally, the jack brackets 176 are in the shape of a wedge or are L-shaped.

In some cases, the tower pole 12 is a monopole. The monopole may be in the shape of a polygon comprising a plurality of flat tapered sides 21. Optionally, each side 21 is be wider at the tower pole bottom 16 as compared to the tower pole top 14. Optionally, each jack bolt 160 may engage, but preferably not extend into, a side 21 and may be spaced partially about a perimeter of the monopole.

Several other optional configurations are possible for the hoist 30 as described below. For example, at least after complete installation, the first and/or second clamp central bracket 72, 122 may further comprise a removable insert 180. The removable insert 180 may be interchangeable and come in several configurations depending on the configuration of the hoist 30 and the requirements of a particular job. In one such configuration, the removable insert 180 may comprise the upper and lower plates 116, 118 to which the movable bridge 110 is discussed as above. In another configuration, the removable insert 180 is configured to secure a mast 200 to the first and/or second clamp bracket systems 72, 122. Other configurations are discussed below.

Figure 41:
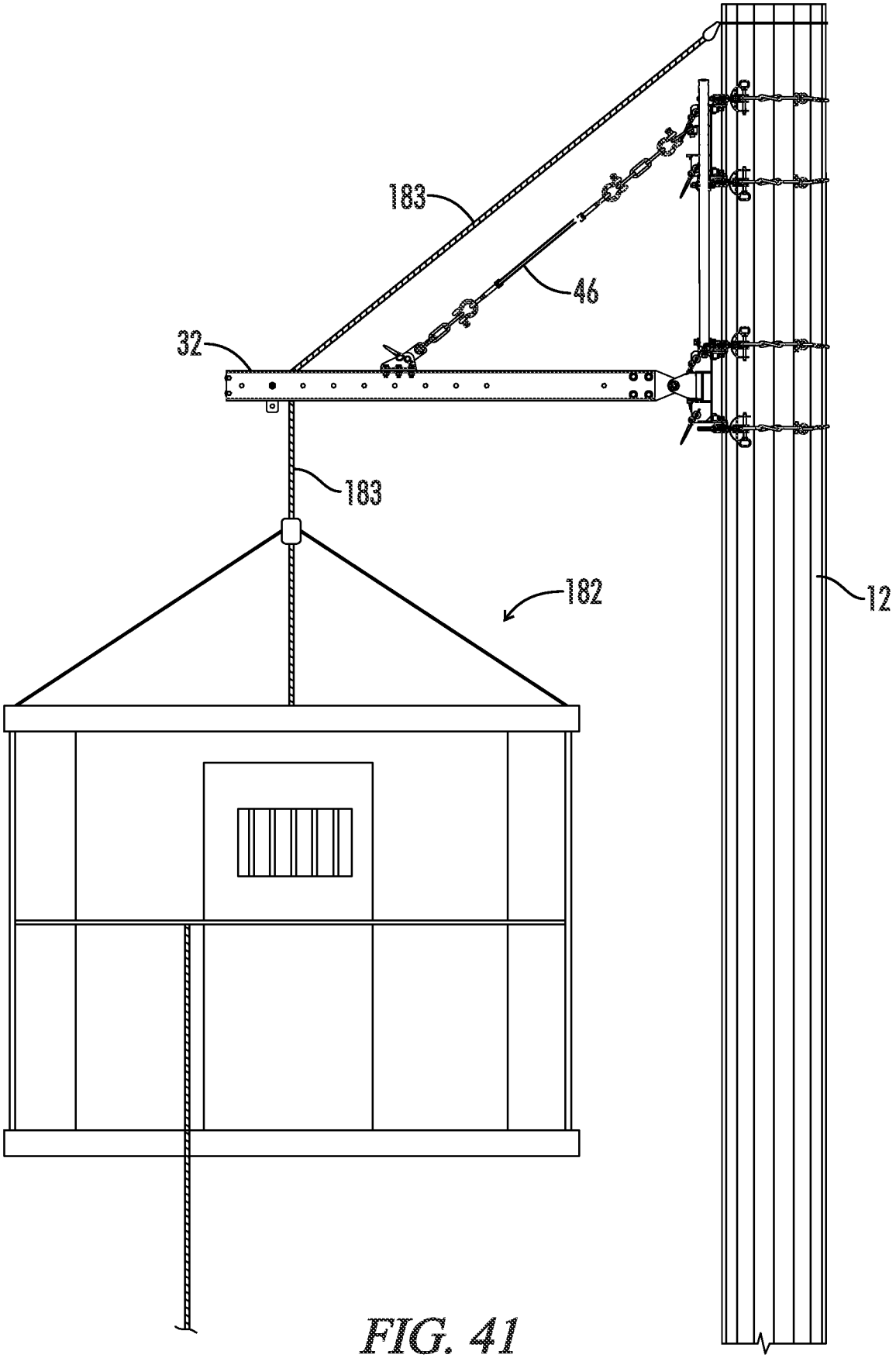
FIG. 41 illustrates a side elevation view of a powered man basket used with a hoist of one embodiment of the present invention.
Figure 42:
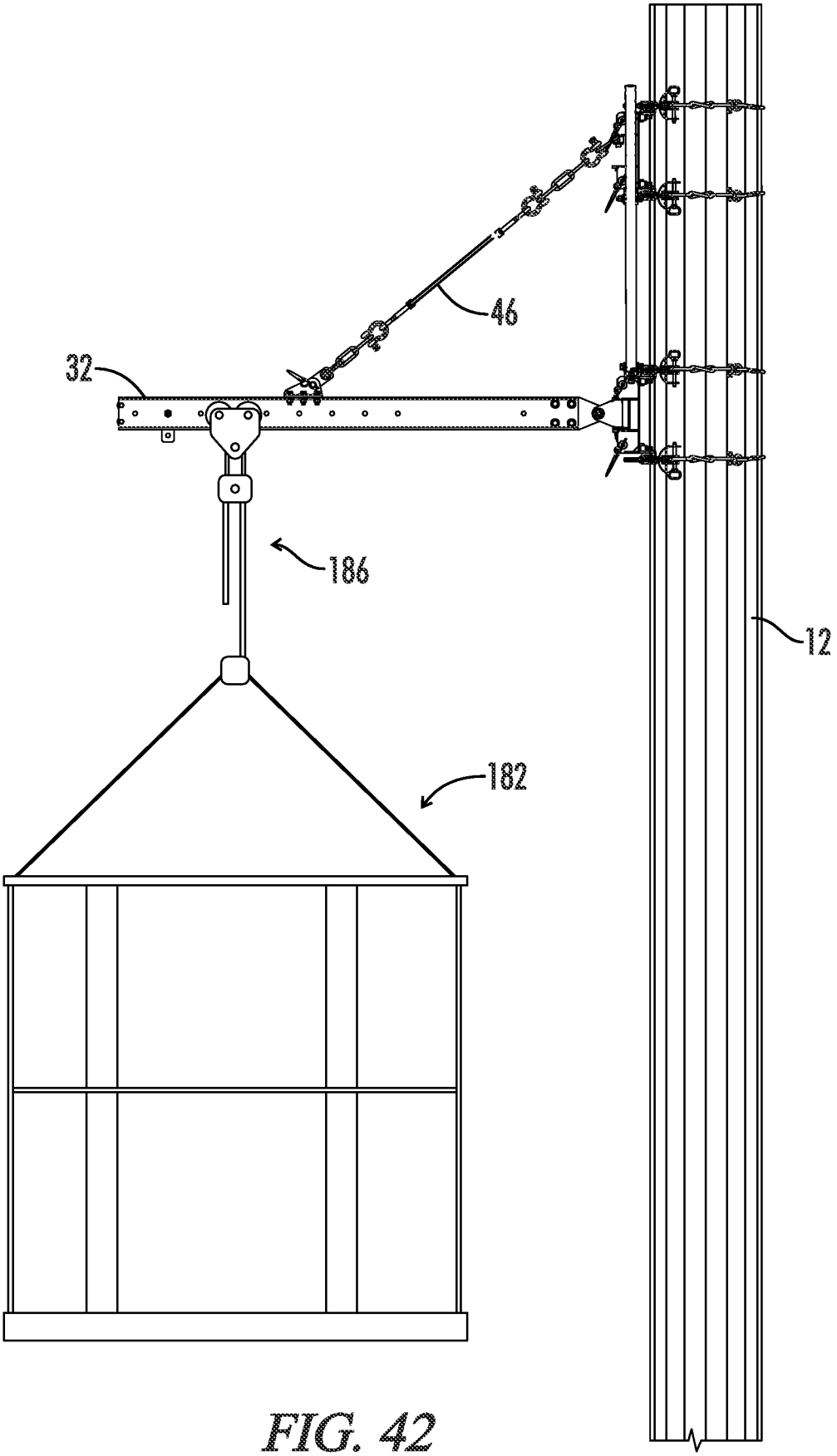
FIG. 42 illustrates a side perspective view of a man basket connected with a trolley used with a hoist of one embodiment of the present invention.

In some cases, a man basket 182 configured to carry a human may be secured to the hoist beam 32, as shown in FIGS. 41 and 42. The man basket 182 may also be attached to a trolley 184 secured to the hoist beam 32. The trolley 184 may be configured to allow the man basket 182 to move along at least a portion of the length 38 of the hoist beam 32. Optionally, a basket hoist 186, such as a chain fall hoist, connects the man basket 182 to the hoist beam 32 or trolley 184 secured to the hoist beam 32 to allow the man basket 182 to be raised and/or lowered during use. In other cases, the man basket 182 may be attached to a man basket cable 183 that runs up through the hoist beam 32 and secures to the tower pole 12. Optionally, the man basket cable 183 may be secured to the tower pole 12 above the first and/or second central clamp brackets 72, 122. A powered lift may be used to allow the man basket 182 to ascend and descend the man basket cable 183.

Figure 43:
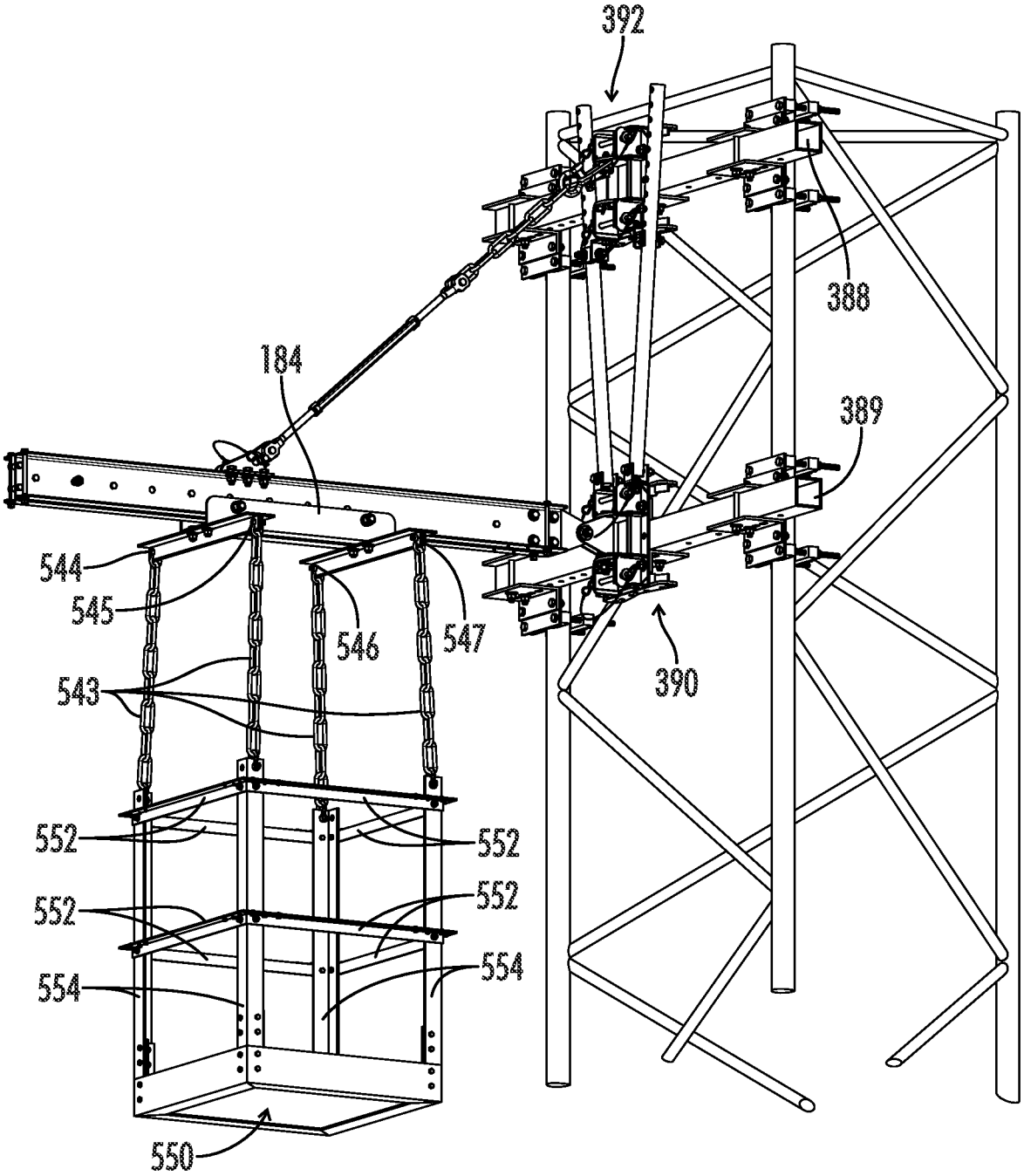
FIG. 43 illustrates a front, bottom, side perspective view of a man basket connected with a trolley used with a hoist of one embodiment of the present invention.
Figure 44:
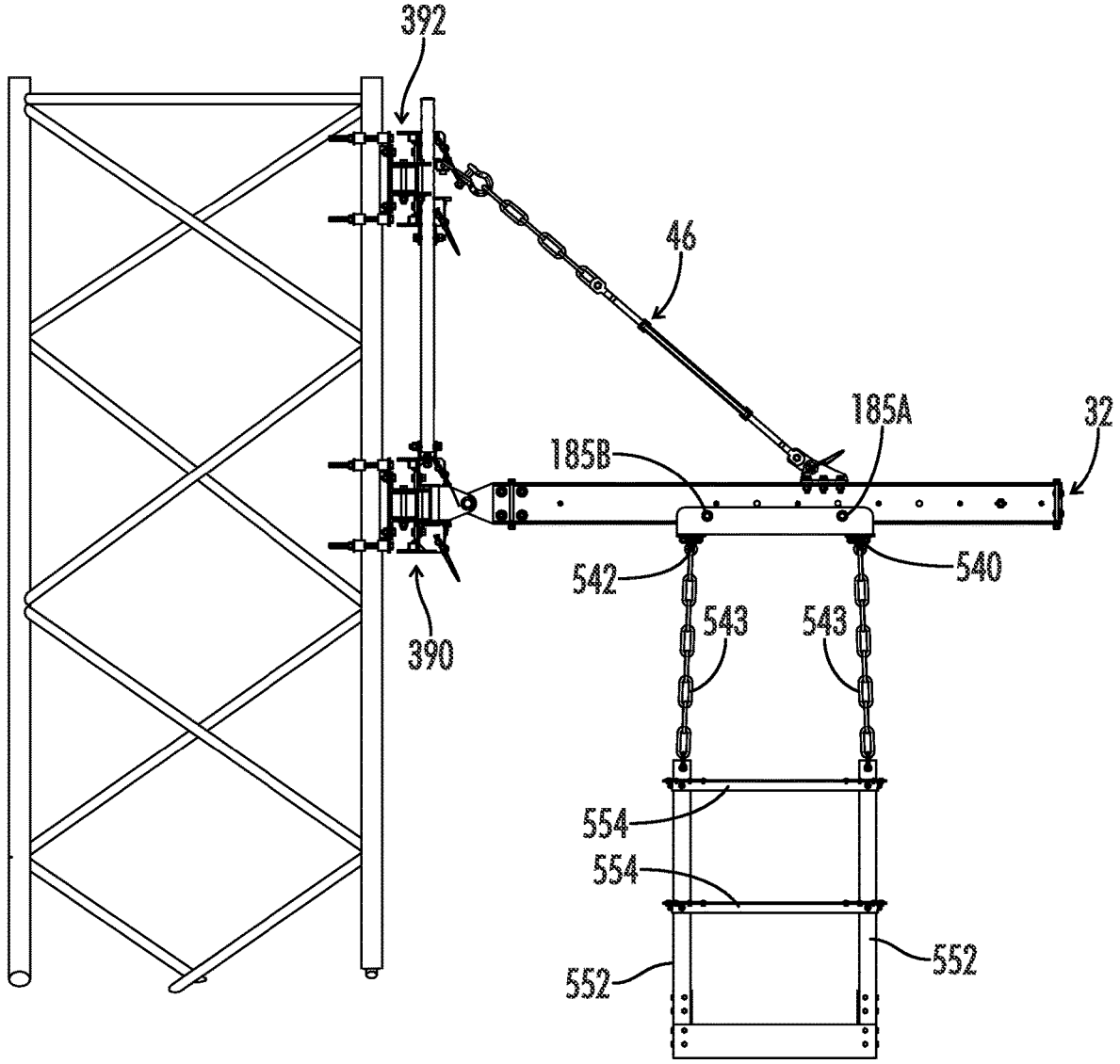
FIG. 44 illustrates a side elevation view of a man basket connected with a trolley used with a hoist of one embodiment of the present invention.

In some embodiments, as best seen in FIGS. 43-44, the man basket 182 may comprise a forward cross bracket 540 and a rear cross bracket 542. Optionally, the forward cross bracket 540 attaches to the trolley 184 at the trolley forward end 185A. Optionally, the rear cross bracket 542 attaches to the trolley 184 at the trolley rear end 185B. The man basket 182 may be secured to the forward cross bracket 540 and rear cross bracket 542 by a plurality of man basket chains 543. The man basket chains 543 may attach to a forward cross bracket left end 544, and forward cross bracket right end 545, a rear cross bracket left end 546, and/or a rear cross bracket right end 547. Optionally, the man basket 182 may further comprise a substantially solid floor 550 which may be configured to allow a human to stand thereon. Optionally, the plane formed by the man basket floor 550 is perpendicular to the tower pole height 18. In some cases, the man basket 182 may comprise a horizontal rail 552 and a vertical rail 554. Optionally, the man basket horizontal rail 552 is located generally perpendicular to the tower pole height 18 and/or the man basket vertical rail 554 is located generally parallel to the tower pole height 18.

Figure 6:
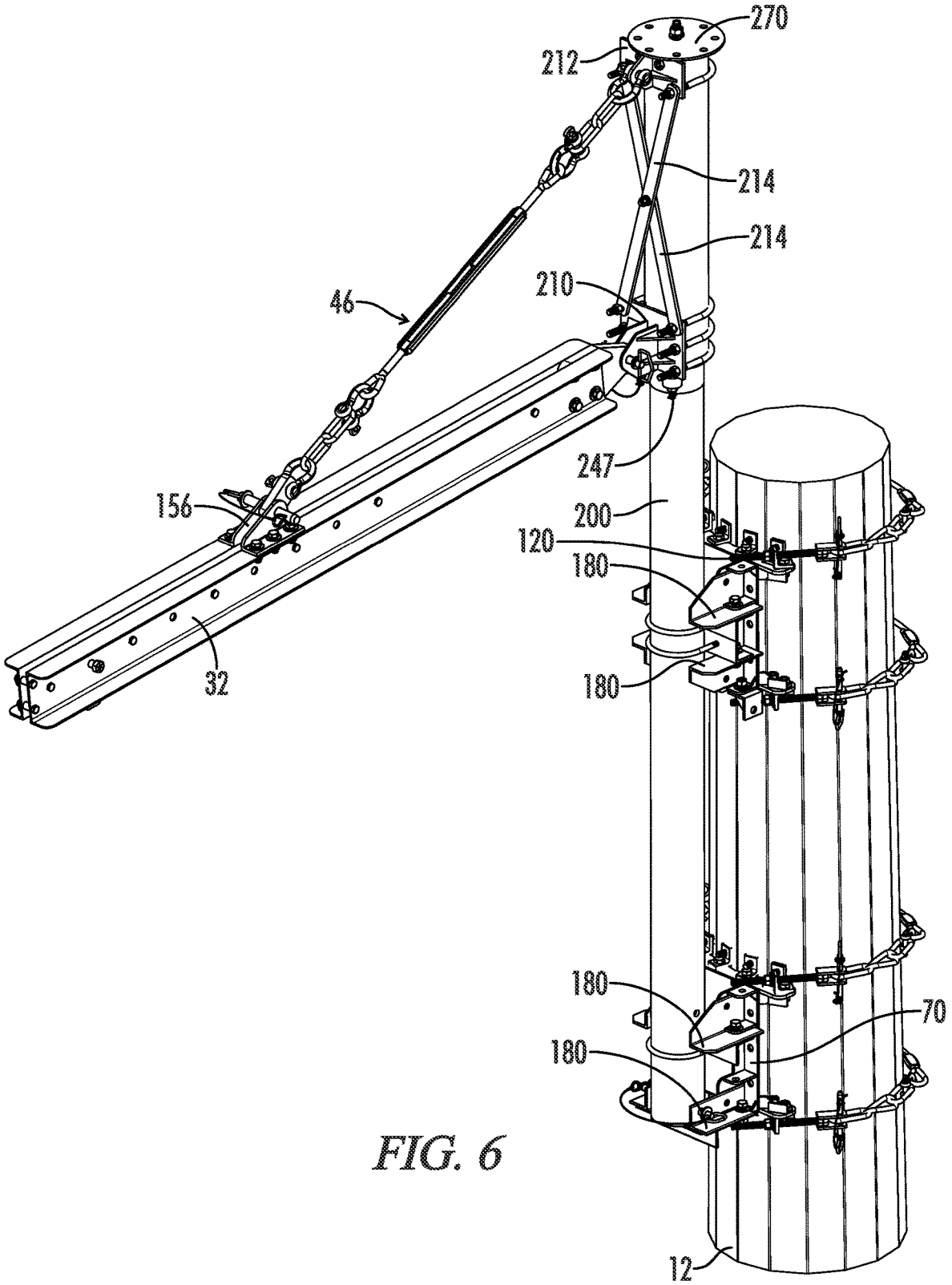
FIG. 6 illustrates a front top side perspective view of a hoist of a second embodiment of the present invention shown attached to a monopole.
Figure 7:
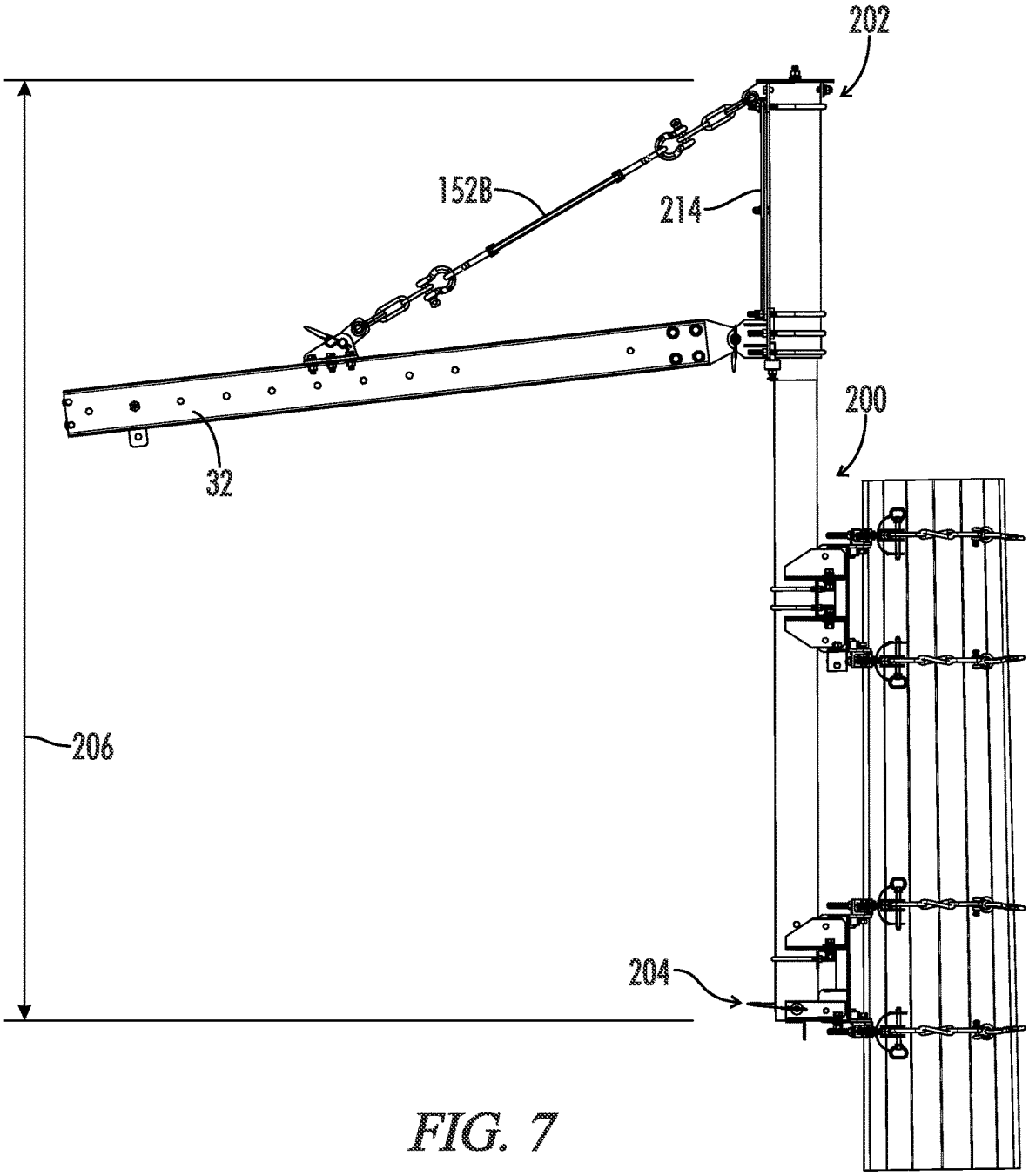
FIG. 7 illustrates a side elevation view of the hoist of FIG. 6 with the hoist beam in a lowered position.
Figure 8:
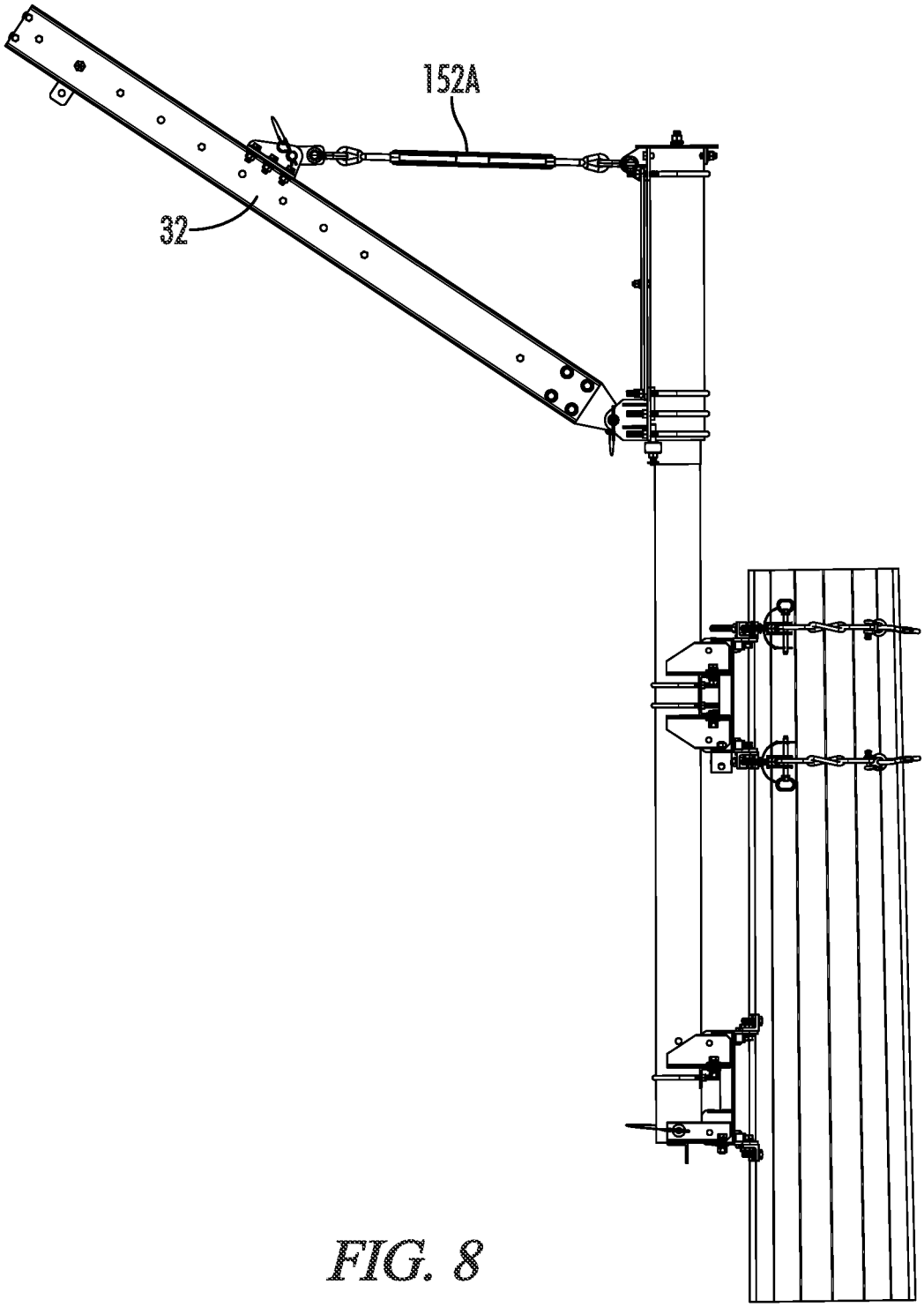
FIG. 8 illustrates a side elevation view of the hoist of FIG. 6 with the hoist beam in a raised position.

As shown in FIGS. 6-8, a mast 200 may be used, if, for example, the operator desires to work on antennas near the tower top. More particularly, as shown in FIGS. 6-8, one step may comprise securing a first clamp bracket system 70 to the tower pole 12 by placing the first clamp bracket system 70 at least partially around the tower pole 12. Another step may comprise securing a mast 200 to the first clamp bracket system 70, the mast 200 comprising a top 202, a bottom 204, and a height 206 extending from the top 202 to the bottom 204. Another step may comprise providing a first mast bracket system 210. Another step may comprise providing a hoist 30 comprising a hoist beam 32 comprising a forward end 34, a rear end 36, and a hoist beam length 38 extending from the forward end 34 to the rear end 36.

Optionally, the hoist 30 may have one or more of the following features: i) the first and/or second clamp bracket system 72, 122 connects the mast 200 to the tower pole 12; ii) the first mast bracket system 212 is located above the first and/or second clamp bracket system 72, 122 and connects the hoist beam rear end 36 to the mast 200 and wraps at least partially around the mast 200; iii) the hoist beam 32 extends laterally from the mast 200 and the first mast bracket system 210; iv) the hoist further comprises at least one sheave 40,42 connected to the hoist beam 32 and receiving a pulley cable/load line 44; v) a brace cable 46 connects the hoist beam 32 to the mast 200 above the second clamp bracket system 120 and extends at an angle relative to the tower pole height 18 and comprises an upper end 47A connected to the mast 200 and a lower end 47A connected to the hoist beam 32; and/or vi) the mast height 206 is generally parallel to the tower pole height 18. At least after complete installation of the system, the mast top 202 and the hoist beam 32 and/or hoist beam rear end 36 is located above the tower pole top 14.

Figure 28:
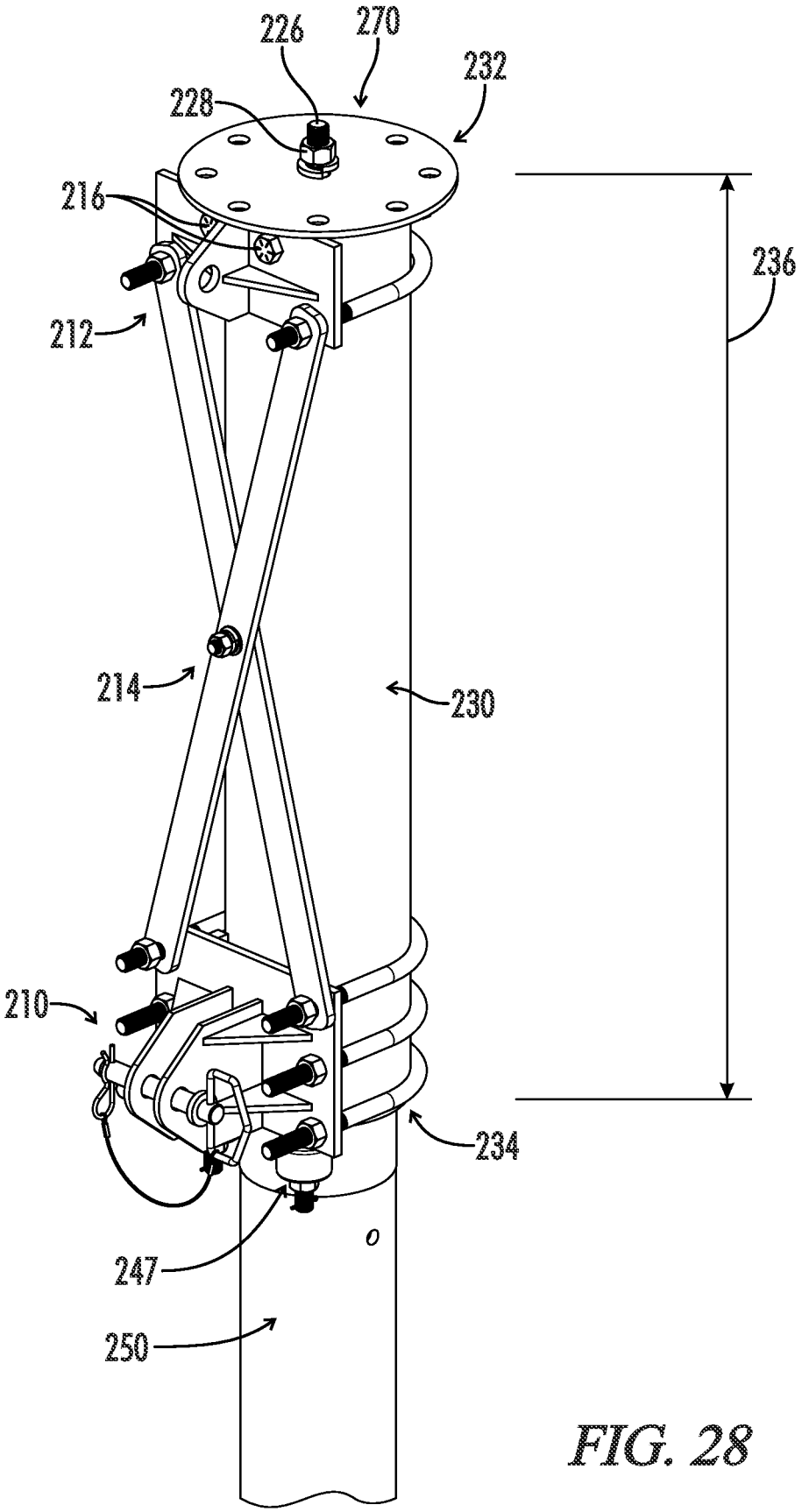
FIG. 28 illustrates a front top side perspective view of a top section of the mast shown in FIG. 23.
Figure 29:
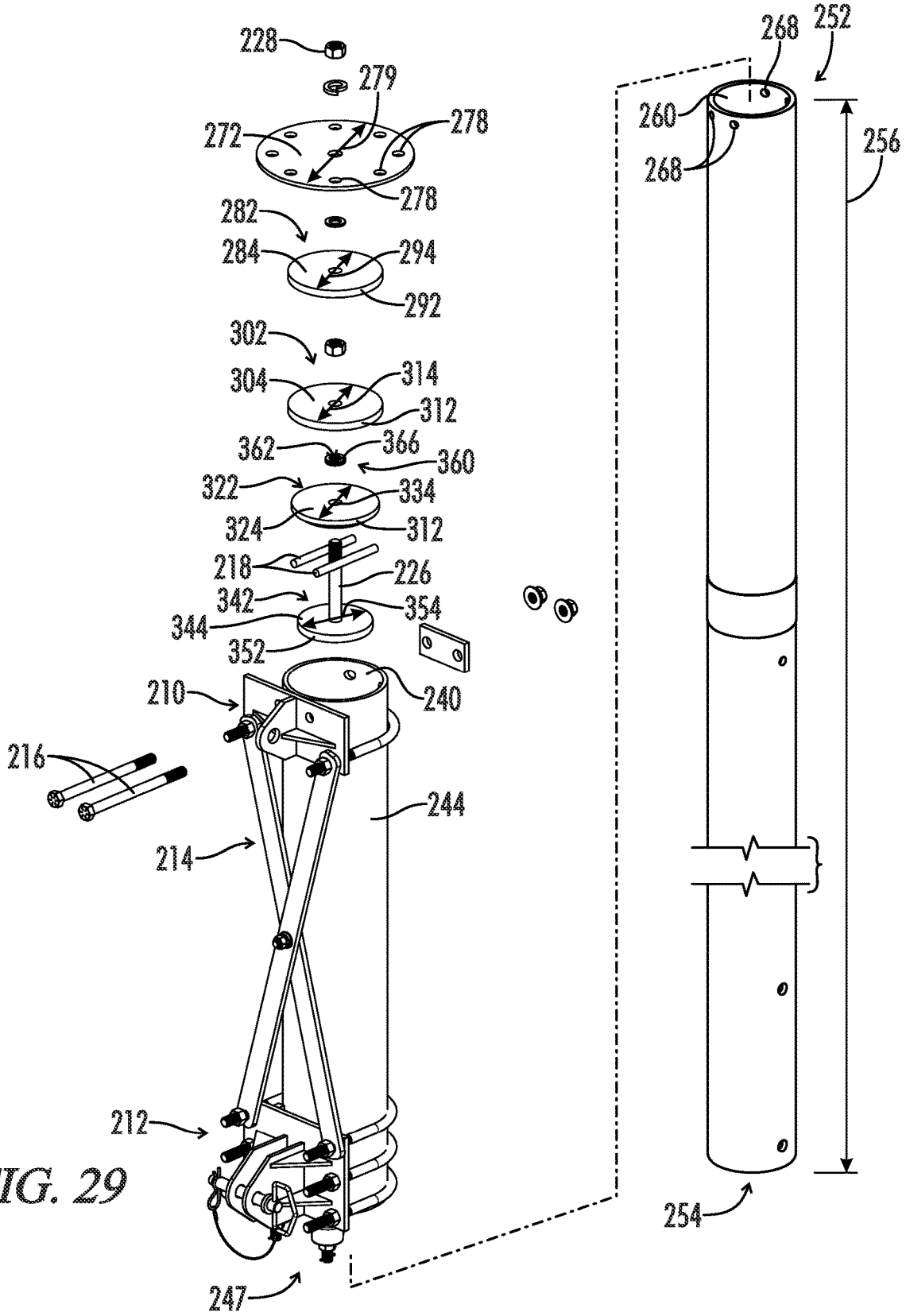
FIG. 29 illustrates an exploded front top side perspective view of the upper portion of the mast shown in FIG. 28.
Figure 29A:
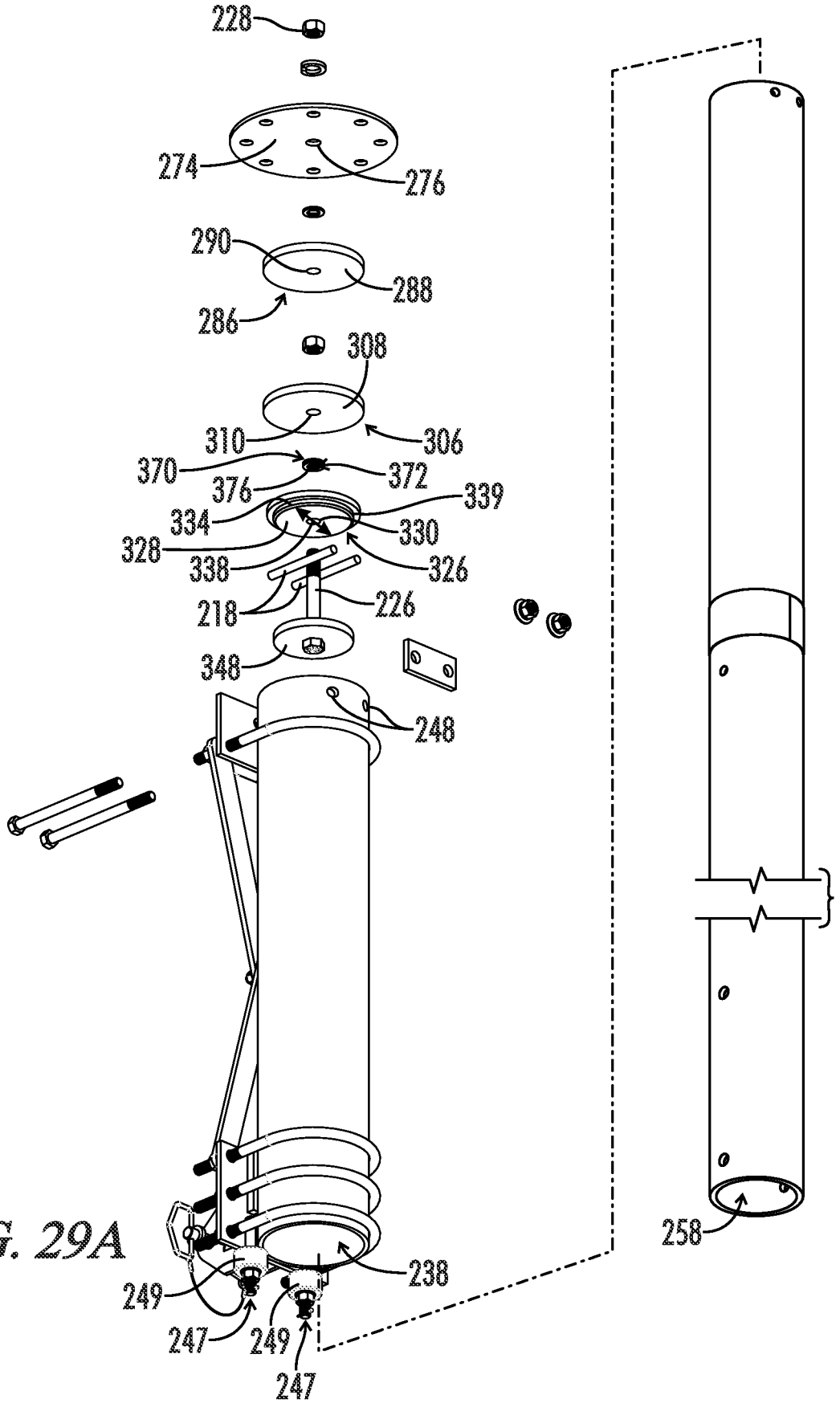
FIG. 29A illustrates an exploded rear bottom side perspective view of the upper portion of the mast shown in FIG. 28.
Figure 30:
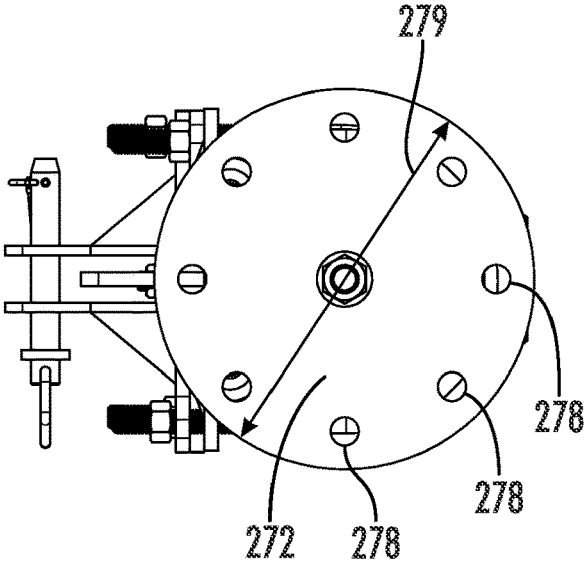
FIG. 30 illustrates a top plan view of the mast upper portion shown in FIG. 28.

As shown in FIGS. 6-8, the hoist 30 may comprise a second mast bracket system 212 that may connect the brace cable upper end 47A to the mast 200. Optionally, the first and second mast bracket systems 210, 212 may be aligned with the second mast bracket system 212 directly above the first mast bracket system 210. In some case, as best seen in FIG. 28, an x-shaped vertical brace 214 may extend between the first and second mast bracket systems 210, 212 to stabilize and maintain alignment of the first and second mast bracket systems 210, 212. At least one bolt 216 may extend from the second mast bracket system 212 into an interior 238, 258 of the mast 200. The at least one bolt 216 may be configured to prevent rotation or other movement of the second mast bracket system 212 around the mast 200.

Optionally, as best seen in FIGS. 28-31A, the mast 200 comprises at least one bearing system 220 configured to allow the mast 200 to rotate relative to a mast central/longitudinal axis 222 which runs generally parallel to the tower pole height 18. Optionally, the bearing system 220 further comprises a brake 224, configured to, when engaged, prevent the mast 200 from rotating relative to the mast central/longitudinal axis 222. Preferably, the bearing system 220 comprises a bearing bolt 226 passing through the at least one bearing 220 and is aligned with the mast central/longitudinal axis 222, a nut 228 is attached to the bearing bolt 226 and forms said brake 224, and tightening of said nut 228 is configured to prevent the mast 200 from rotating relative to the mast central/longitudinal axis 222.

Figure 31:
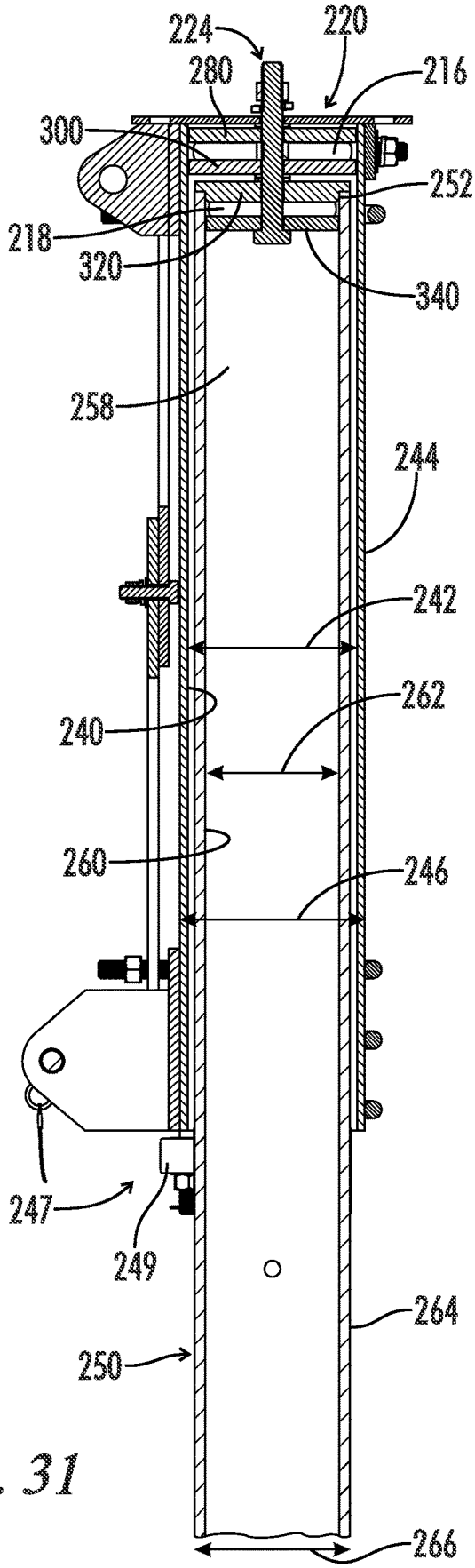
FIG. 31 illustrates a sectional view of the mast upper portion shown in FIG. 28.
Figure 31A:
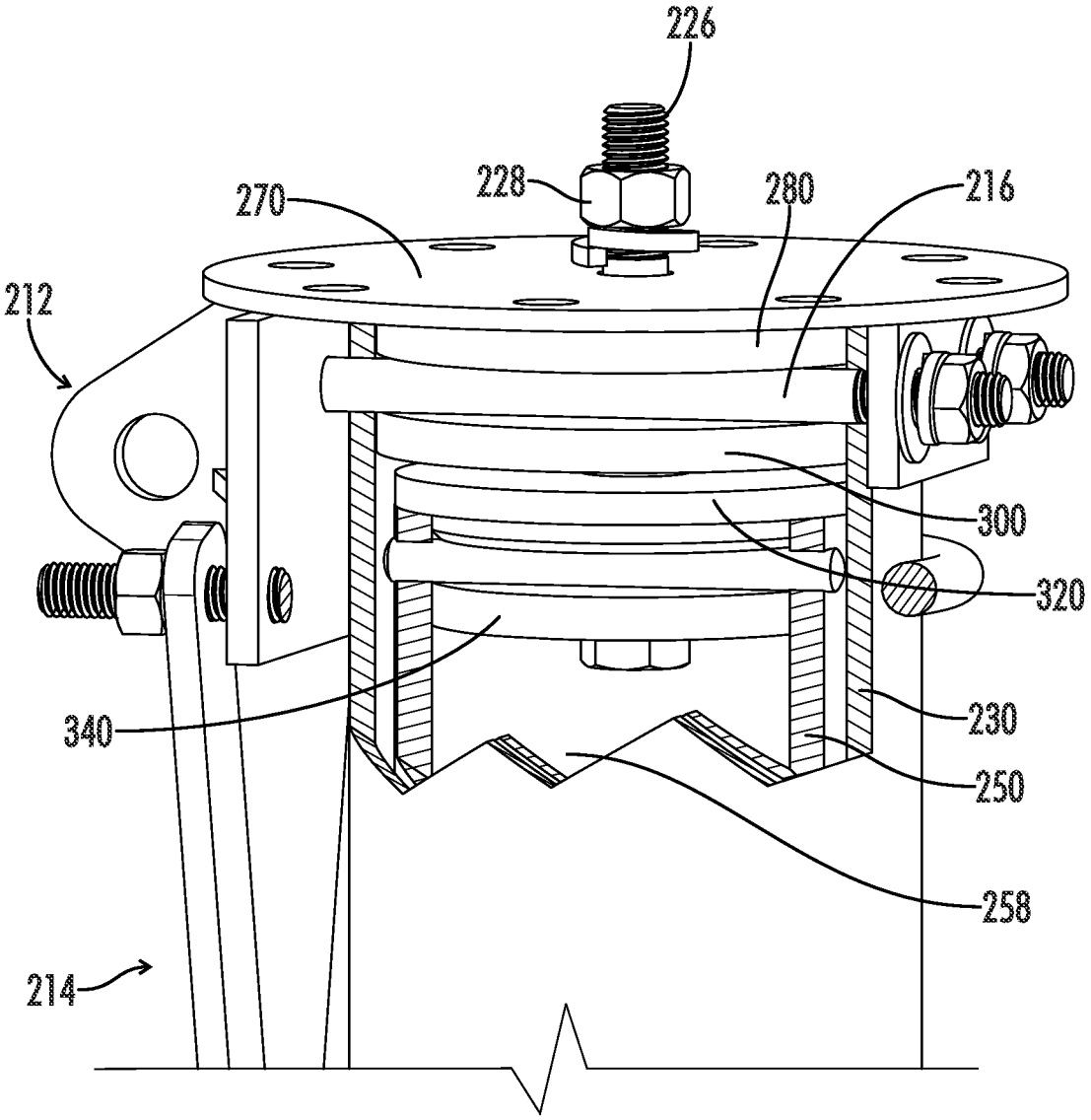
FIG. 31A illustrates a top side perspective view of the mast upper portion shown in with FIG. 28.
Figure 32:
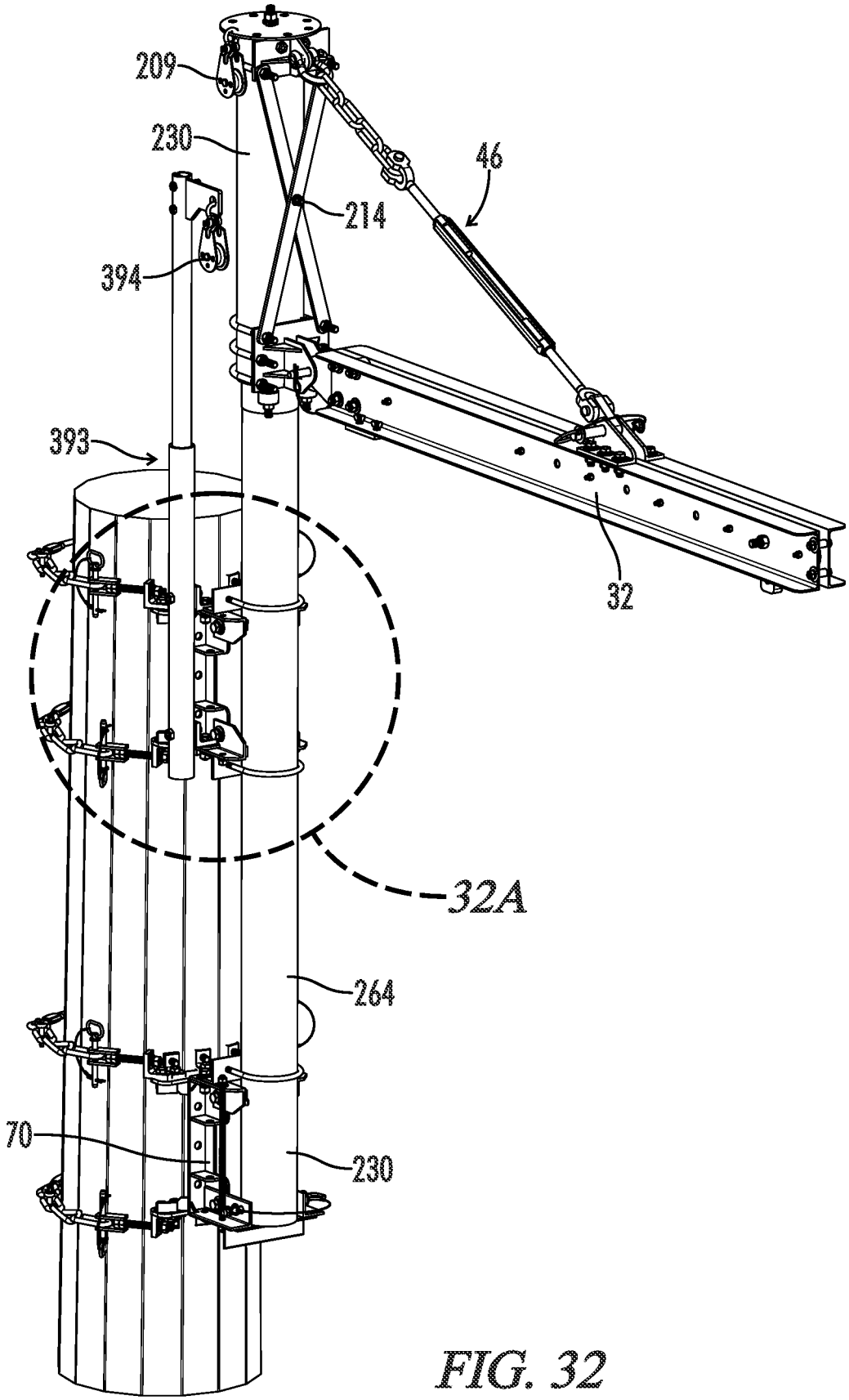
FIG. 32 illustrates a side perspective view of a mast and a davit of one embodiment of the present invention attached to a monopole; the davit may be used to improve safety during installation and removal of the systems described herein.
Figure 32A:
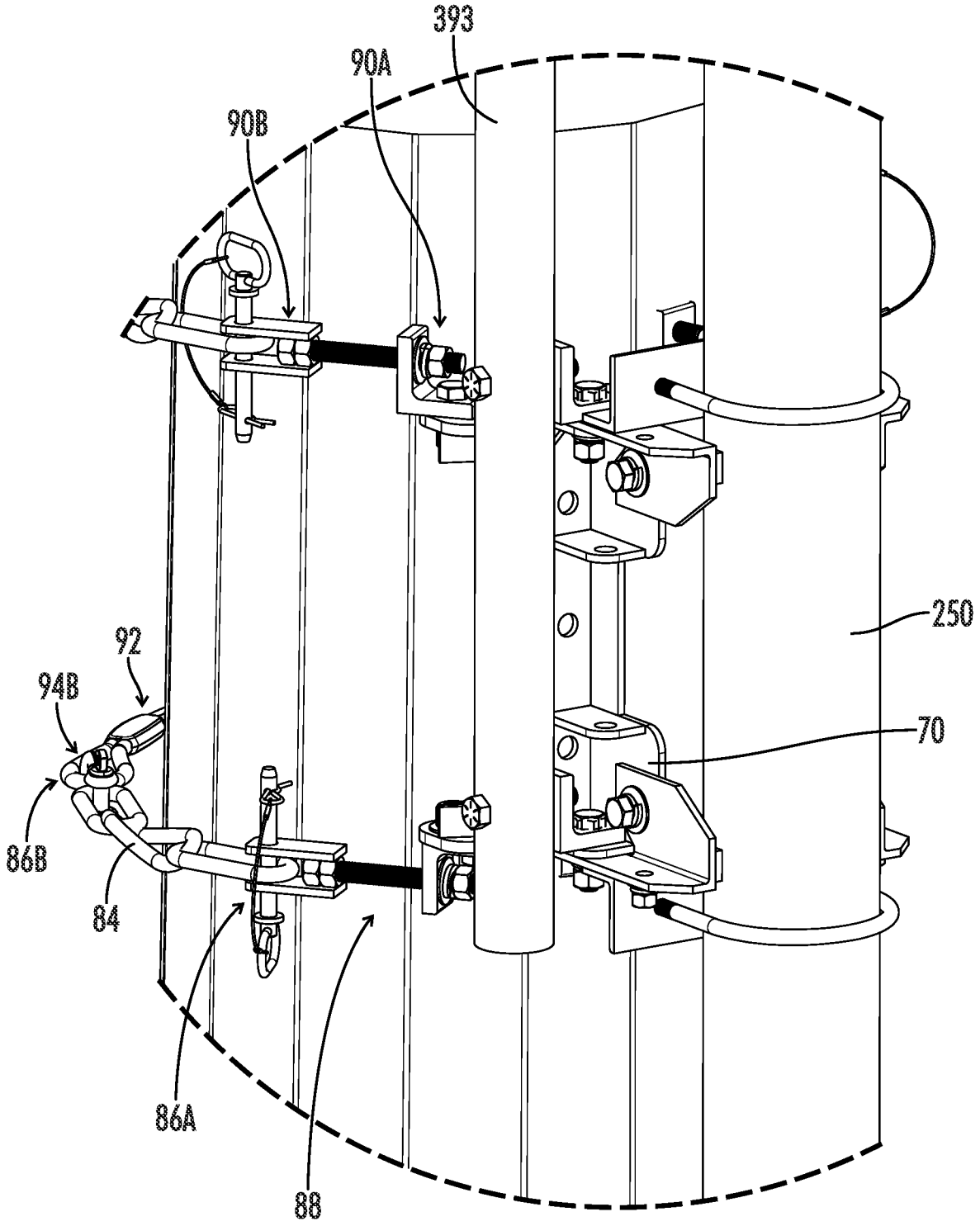
FIG. 32A illustrates a closeup view of the circled area labelled 32A in FIG. 32.

Optionally, as best seen in FIG. 31, the mast 200 is comprised of an upper mast pipe 230 and a lower mast pipe 250.

Optionally, as best seen in FIGS. 28-31A, at least after complete installation of the system, the hoist 30 may have one or more of the features described below: a) a cylindrical upper mast pipe 230 comprising a top 232, a bottom 234, a upper mast pipe height 236 extending from the top 232 to the bottom 234, an interior 238, an interior surface 240, an inner diameter 242, an exterior surface 244, an exterior diameter 246 and/or a plurality of holes 248 optionally adjacent the top 232 configured to allow a bolt 216 to be inserted through the upper mast pipe 230; b) a cylindrical lower mast pipe 250 having a lower mast pipe top 252, a lower mast pipe bottom 254, a height 256 extending from the lower mast pipe top 252 to the lower mast pipe bottom 254, an interior 258, an interior surface 260, an inner diameter 262, an exterior surface 264, an exterior diameter 266, and/or a plurality of holes 268 optionally adjacent the top 252 configured to allow a rod 218 to be inserted through the lower mast pipe 250; c) a circular stabilizer plate 270 having an upper face 272, a lower face 274 opposite the upper face 272, a center hole 276 extending from the upper face 272 through the lower face 274, a plurality of outer holes 278 extending from the upper face 272 through the lower face 274 adjacent to the stabilizer plate perimeter, and/or a stabilizer plate diameter 279; d) a first bearing plate 280 having a top 282 comprising an upper face 284, a bottom 286 comprising a lower face 288 opposite the upper face 284, a center hole 290 extending from the upper face 284 through the lower face 288, an outer edge 292 and/or a first bearing plate diameter 294, wherein, optionally, the first bearing plate diameter 294 is substantially equal to the upper mast pipe inner diameter 242; e) a second bearing plate 300 having a top 302 comprising an upper face 304, a bottom 306 comprising a lower face 308 opposite the upper face 304, a center hole 310 extending from the upper face 304 through the lower face 308, an outer edge 312, and a second bearing plate diameter 314, wherein, optionally the second bearing plate diameter 314 is substantially equal to the upper mast pipe inner diameter 242; f) a third bearing plate 320 having a top 322 comprising an upper face 324, a bottom 326 comprising a lower face 328 opposite the upper face 324, a center hole 330 extending from the upper face 324 through the lower face 328, an upper face edge 332, a lower face edge 334, an upper face diameter 336, a lower face diameter 338, wherein the upper face diameter 336 is less than the upper mast pipe inner diameter 242 and the lower face diameter 338 is substantially equal to the lower mast pipe inner diameter 262, and further wherein the upper face diameter 336 is greater than the lower face diameter 338 so as to create a ledge/recess 339 extending around the lower face edge 334; and/or g) a fourth bearing plate 340 having top 342 comprising an upper face 344, a bottom 346 comprising a lower face 348 opposite the upper face 344, a center hole (not shown without bolt 226 extending through it) extending from the upper face 344 through the lower face 348, an outer edge 352, and a fourth bearing plate diameter 354, wherein the fourth bearing plate diameter 354 is substantially equal to the lower mast pipe inner diameter 262.

Optionally, as best seen in FIGS. 28-31A, at least after complete installation of the system, the hoist 30 may have one or more of the features described below: i) the circular stabilizer plate, first bearing plate, second bearing plate, third bearing plate, and/or fourth bearing plate upper faces 272, 284, 304, 324, 344 face upwards and the circular stabilizer plate, first bearing plate, second bearing plate, third bearing plate, and/or fourth bearing plate upper faces 274, 288, 308, 328, 348 face downwards; ii) the lower mast pipe top 252 is located within the upper mast pipe interior 238 and/or the lower mast pipe exterior surface 264 does not contact the upper mast pipe interior surface 240; iii) the stabilizer plate lower face 274 contacts the upper mast pipe top 232; iv) the first bearing plate 280 is located below the stabilizer plate 270 and/or within the upper mast pipe interior 238, the first bearing plate outer edge 292 contacts the upper mast pipe interior surface 240, and/or the first bearing plate upper face 284 faces the stabilizer plate lower face 274; v) the second bearing plate 300 is located below the first bearing plate 280 and within the upper mast pipe interior, the second bearing plate outer edge contacts the upper mast pipe interior surface 238, and/or the second bearing plate upper face 304 faces the first bearing plate lower face 324; vi) the third bearing plate 320 is located below the second bearing plate 300, the third bearing plate upper face 324 is located within the upper mast pipe interior 238, the third bearing plate lower face 328 is located within the lower mast pipe interior 258, the third bearing plate upper face edge 332 does not contact the upper mast pipe interior surface 240, the third bearing plate ledge/recess 339 contacts the lower mast pipe top 252, the third bearing plate lower face edge 334 contacts the lower mast pipe interior surface 260, and/or the third bearing plate upper face 324 faces the second bearing plate lower face 308; vii) the fourth bearing plate 340 is located below the third bearing plate 320 and/or within the lower mast pipe interior 258, the fourth bearing plate outer edge 352 contacts the lower mast pipe interior surface 260, and/or the fourth bearing plate upper face 344 faces the third bearing plate lower face 328; viii) a top washer 360 is positioned below the third bearing plate 320, the top washer 360 comprising a center hole 362, a lower face 328, and/or an upper face (not shown), wherein the top washer upper face 366 optionally confronts the third bearing plate lower face 328; and/or ix) a bottom washer 370 is positioned below the top washer 360 and comprising a center hole 372, an upper face (not shown) optionally confronting the top washer lower face and/or a lower face 376 confronting the fourth bearing plate upper face 344, wherein the bottom washer 370 is optionally rotatable relative to the top washer 360.

Optionally, the upper mast pipe 230 further comprises a lower bearing system 247. The lower bearing system 247 may be located on the upper mast pipe bottom 234. The lower bearing system 247 may comprise rollers 249 that prevent the upper mast pipe interior surface 240 from contacting the lower mast pipe exterior surface 264.

Without being bound to any particular theory, the configuration of the stabilizer plate 270 and the first, second, third, and fourth bearing plates 280, 300, 320, 340 may increase the stability of the upper mast pipe 230 with respect to the lower mast pipe 250 when the hoist 30 is under load. Further, the bearing system 220 may help reduce the force necessary to rotate the upper mast pipe 230 with respect to the lower mast pipe 250. Additionally, the plurality of holes 278 in stabilizer plate 270 may allow a user to, among other things, correct or change the orientation of the upper mast pipe with respect to the lower mast pipe if, for example, the upper mast pipe rotates under load.

In addition, the system may include one or more features described previously.

In another embodiment, as shown for example in FIGS. 9-13, the hoist 30 may be secured to a tower 10 comprising a left tower leg/pole 22 and a right tower leg/pole 24, the left tower leg/pole 22 connected to the right tower leg/pole 24 by a plurality of tower braces 28, the left tower leg/pole 22 and the right tower leg/pole 24 each having a top 14A, 14B located above the ground, a bottom 16A, 16B that may be connected directly or indirectly to the ground, and a height 18A, 18B extending from the top 14A, 14B to the bottom 16A, 16B. The method further comprising assembling a hoist 30 by performing the one or more of following steps in any suitable order including simultaneously: a) securing a lower right clamp bracket system 380 to the right tower leg/pole 24 by placing the lower right clamp bracket system 380 at least partially around the right tower leg/pole 24; b) securing an upper right clamp bracket system 382 to the right tower leg/pole 24 by placing the upper right clamp bracket system 382 at least partially around the right tower leg/pole 24; c) securing a lower left clamp bracket system 384 to the left tower leg/pole 22 by placing the lower left clamp bracket system 384 at least partially around the left tower leg/pole 22; d) securing an upper left clamp bracket system 386 to the left tower leg/pole 22 by placing the upper left clamp bracket system 386 at least partially around the left tower leg/pole 22; e) providing a hoist 30 comprising a hoist beam 32 comprising a forward end 34, a rear end 36, and a hoist beam length 38 extending from the hoist beam forward end 34 to the hoist rear end 36; and/or 0 providing an upper cross beam 388 and/or a lower cross beam 389.

Optionally, as shown in FIGS. 9-13, the hoist 30 may have one or more of the features described below: i) the lower left clamp bracket system 384 is at substantially the same height as the lower right clamp bracket system 380; ii) the lower cross beam 389 extends between the lower left clamp bracket system 384 and the lower right clamp bracket system 380 and is oriented generally parallel to the ground and perpendicular to the left and right tower pole heights 18A, 18B; iii) the upper left clamp bracket system 386 is at substantially the same height as the upper right clamp bracket system 382; iv) the upper cross beam 388 extends between the upper left clamp bracket system 386 and the upper right clamp bracket system 382 and is oriented generally parallel to the ground and perpendicular to the left and right pole heights 18A, 18B; v) the upper cross beam 388, the upper left clamp bracket system 386 and/or the upper right clamp bracket system 382 are located above the lower cross beam 389, the lower left clamp bracket system 384 and/or the lower right clamp bracket system 380; vi) the hoist beam 32 is connected to the lower cross beam 389 and/or extends laterally from the lower cross beam 389; vii) the hoist 30 further comprises at least one sheave 40, 42 connected to the hoist beam 32 and receiving a load line 44; and/or viii) a brace cable 46 connects the hoist beam 32 to the upper cross beam 388 and extends at an angle relative to the left and right tower pole heights 18A, 18B and comprises an upper end 47A connected to the upper cross beam 388 and/or a lower end 47B connected to the hoist beam 32. In some cases, the tower 10 used in this method is a guyed or self-support tower. The tower 10 of this method may further comprise a rear leg/pole 26 located rearwardly relative to the left tower leg/pole 22 and right tower leg/pole 24 and connected to the left and right tower leg/poles 22, 24 by a plurality of tower braces 28.

Optionally, as shown in FIGS. 9-13, the hoist 30 may further comprise a lower cross beam bracket 390 connected to the lower cross beam 389 between the lower left clamp bracket 384 and the lower right clamp bracket 380, a horizontally-oriented pivot bolt 104 connecting the hoist beam 32 to the lower cross beam bracket 390, and/or a hoist beam 32 configured to rotate clockwise and/or counter-clockwise about a horizontally-oriented pivot bolt pivot axis 105 extending generally perpendicular to the tower pole height 18. In such configuration, the rotation of the hoist beam 32 about the horizontally-oriented pivot bolt pivot axis 105 may allow the hoist beam forward end 34 to move upward and downward and toward and away from the tower pole 12 to allow the hoist beam 32 to move between the raised and lowered positions.

Optionally, as shown in FIGS. 9-13, the hoist 30 may further comprise a lower vertically-oriented pivot bolt 106 connecting the hoist beam 32 to the lower cross beam bracket 390. The lower vertically-oriented pivot bolt 106 may be located rearwardly relative to the horizontally-oriented pivot bolt 104 and/or configured to allow the hoist beam 32 to rotate clockwise and/or counter-clockwise about a lower vertically-oriented pivot bolt pivot axis 107 extending generally parallel to the tower pole height 18. Rotation of the hoist beam 32 about the lower vertically-oriented pivot bolt pivot axis 107 may allow the hoist beam 32 to move toward and away from the lower cross beam 389, i.e., to allow the hoist beam 32 to move in a plane perpendicular to the tower pole height 18.

Figure 9:
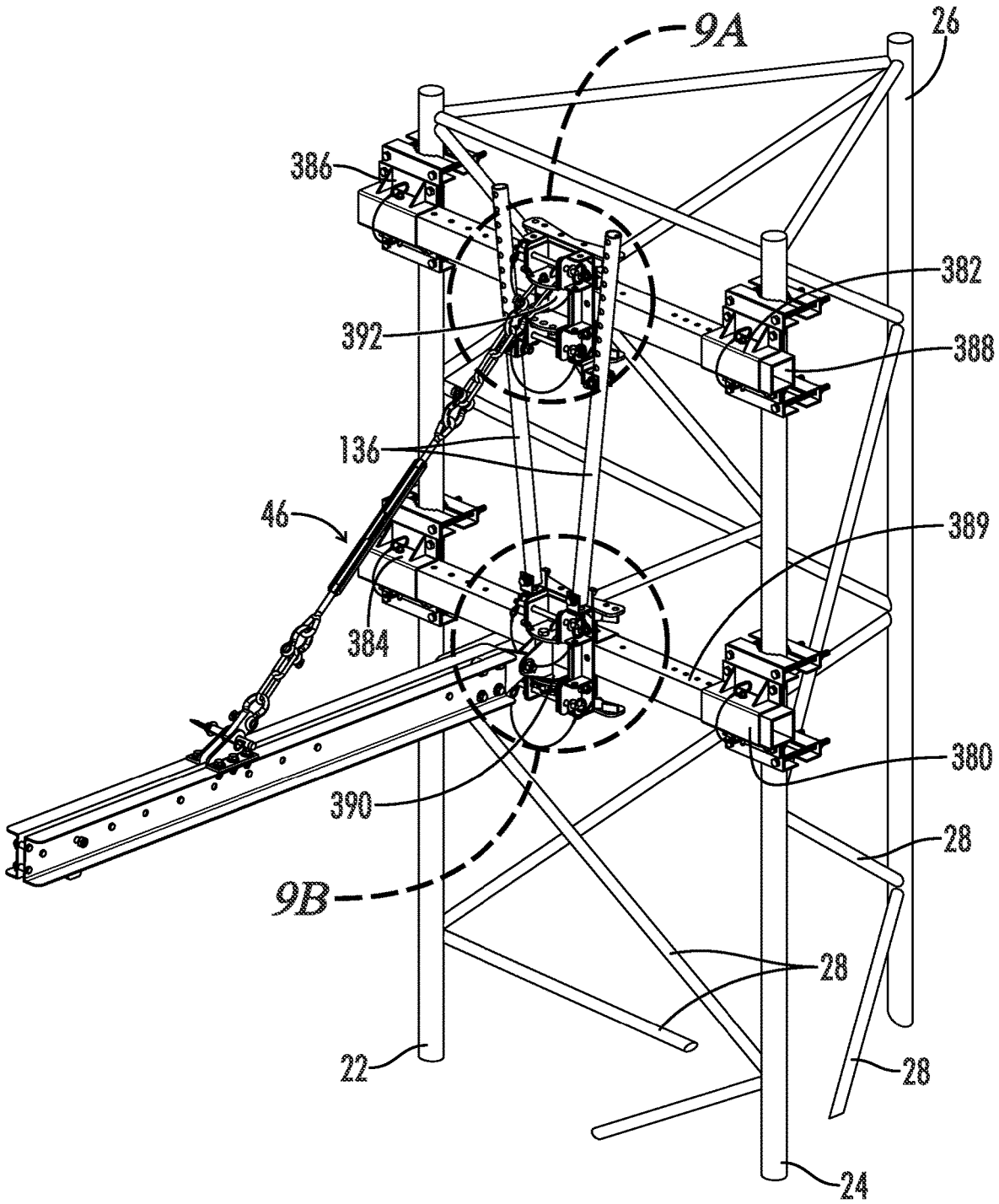
FIG. 9 illustrates a front top side perspective view of a hoist of a third embodiment of the present invention shown attached to the face of a guyed or self-support tower.
Figure 9A:
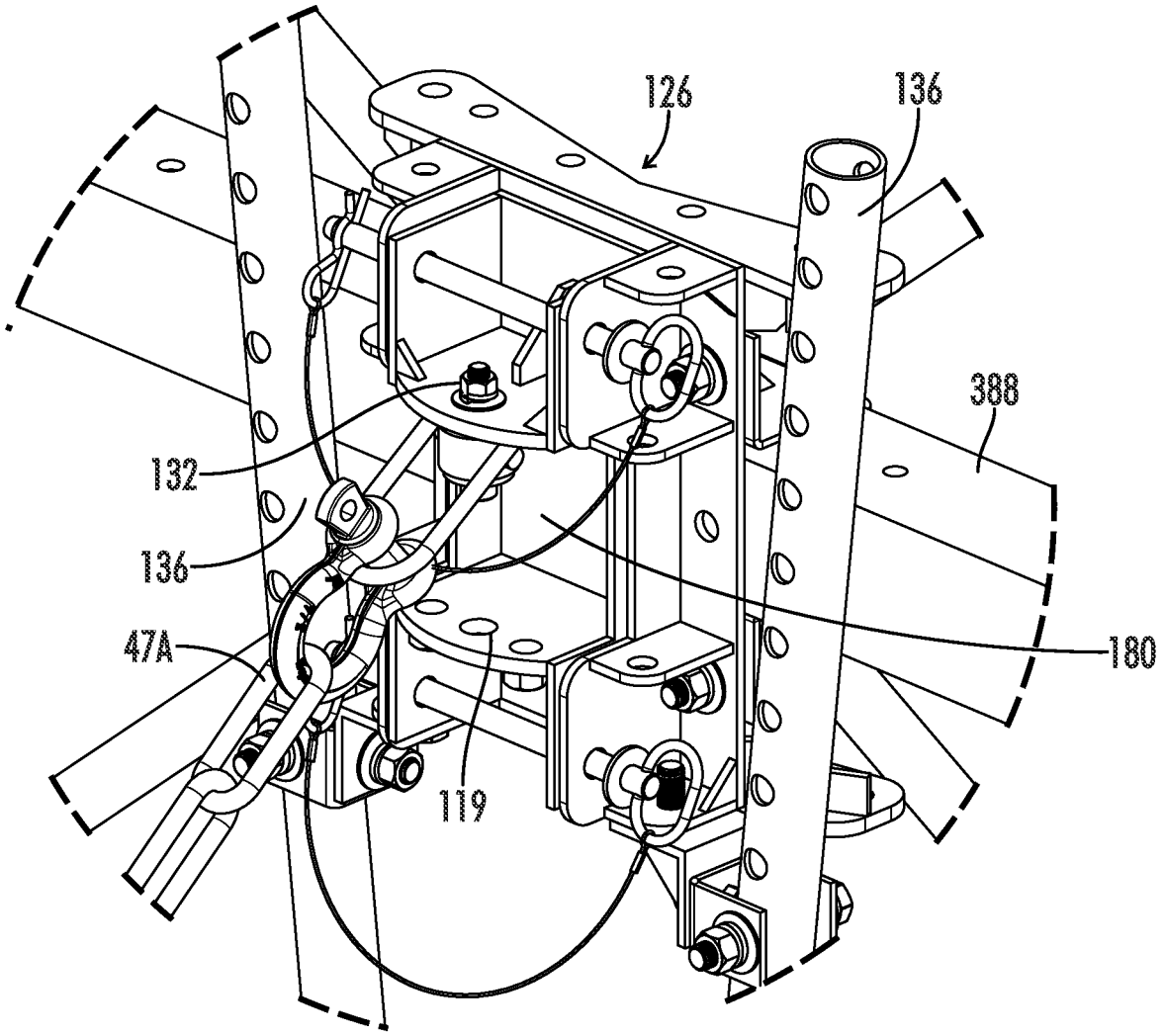
FIG. 9A illustrates a closeup view of the circled area labelled 9A in FIG. 9.
Figure 9B:
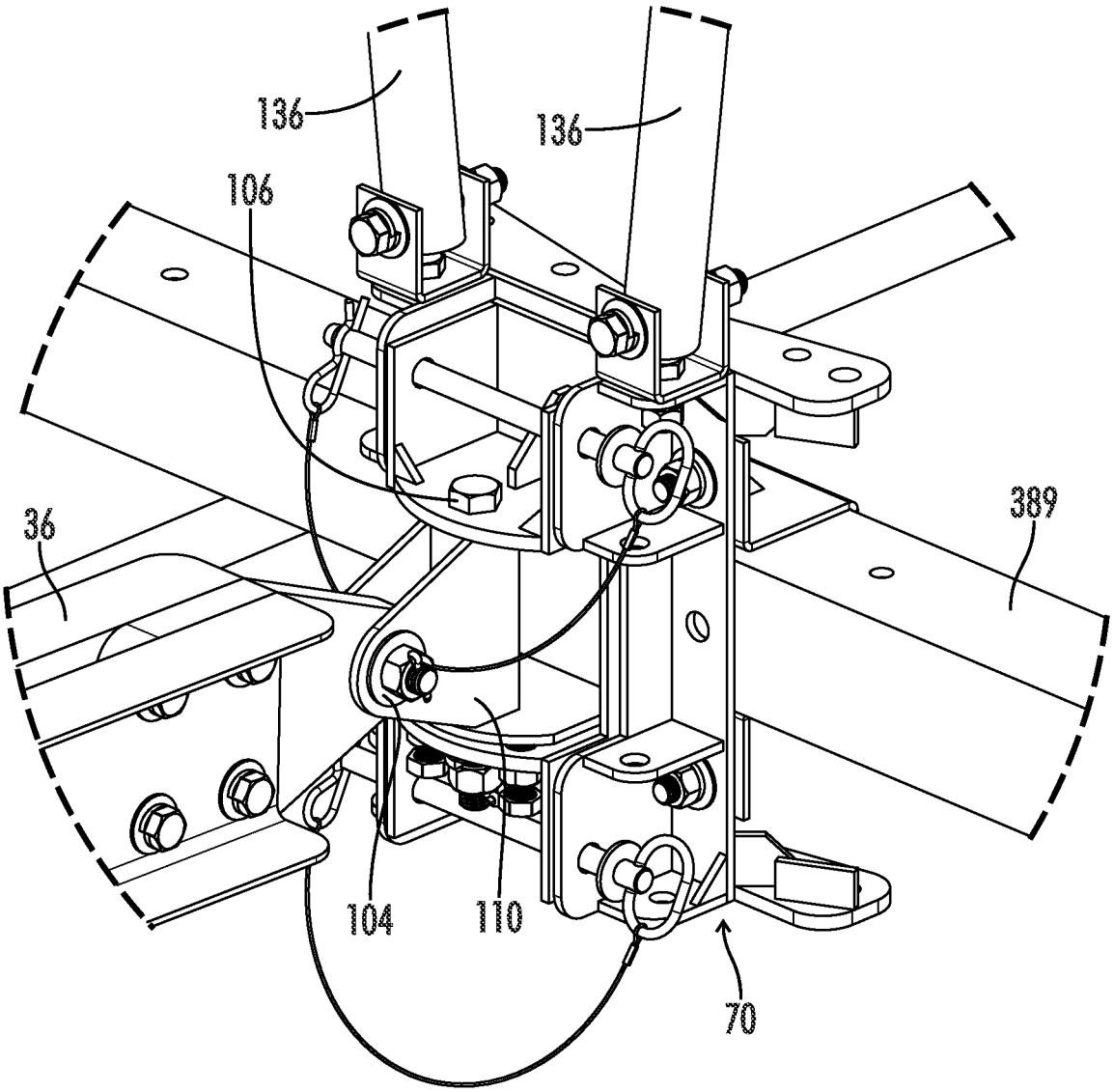
FIG. 9B illustrates a closeup view of the circled area labelled 9B in FIG. 9.
Figure 10:
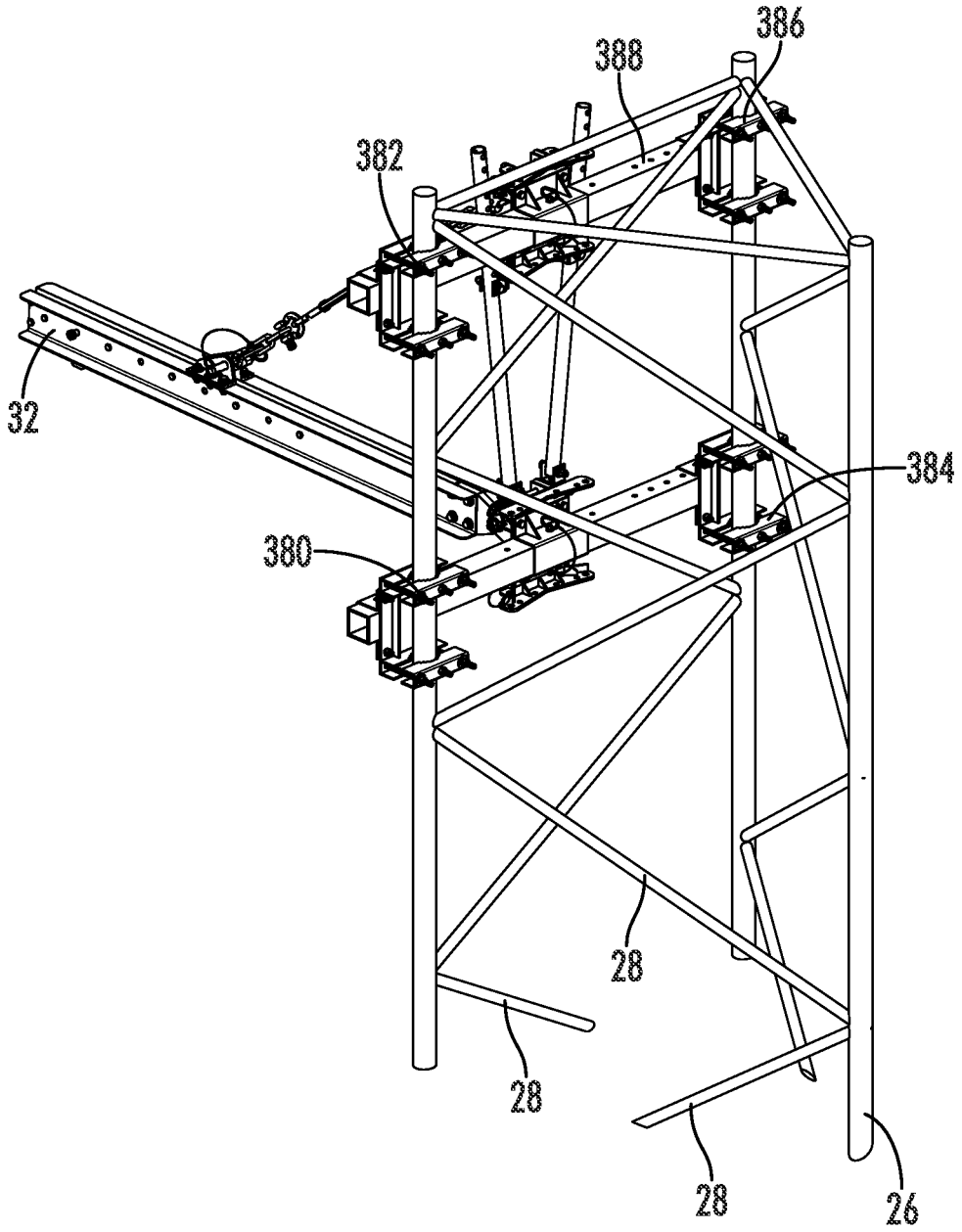
FIG. 10 illustrates a rear top side perspective view of the hoist of FIG. 9.
Figure 11A:
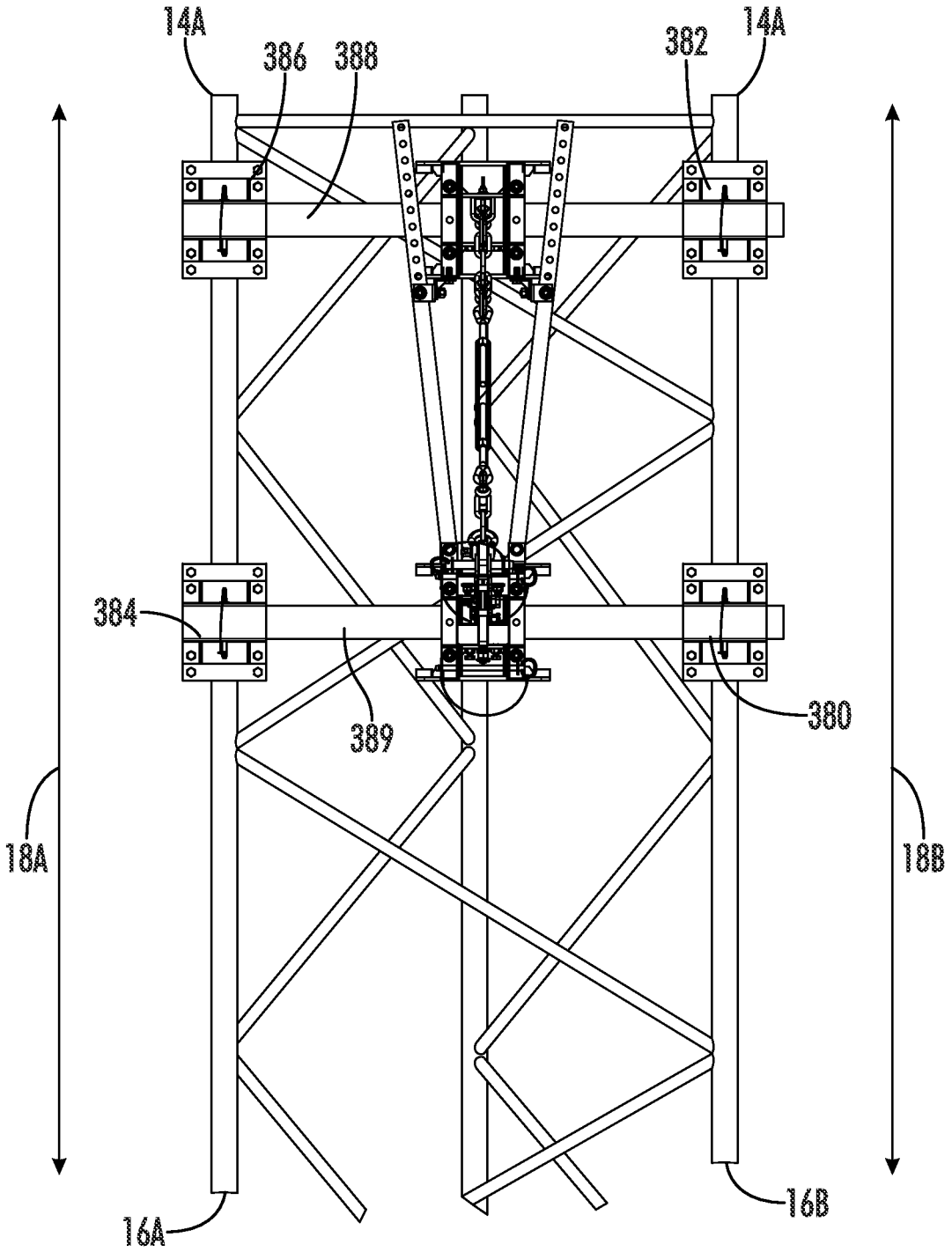
FIG. 11A illustrates a front elevation view of the hoist of FIG. 9.
Figure 11B:
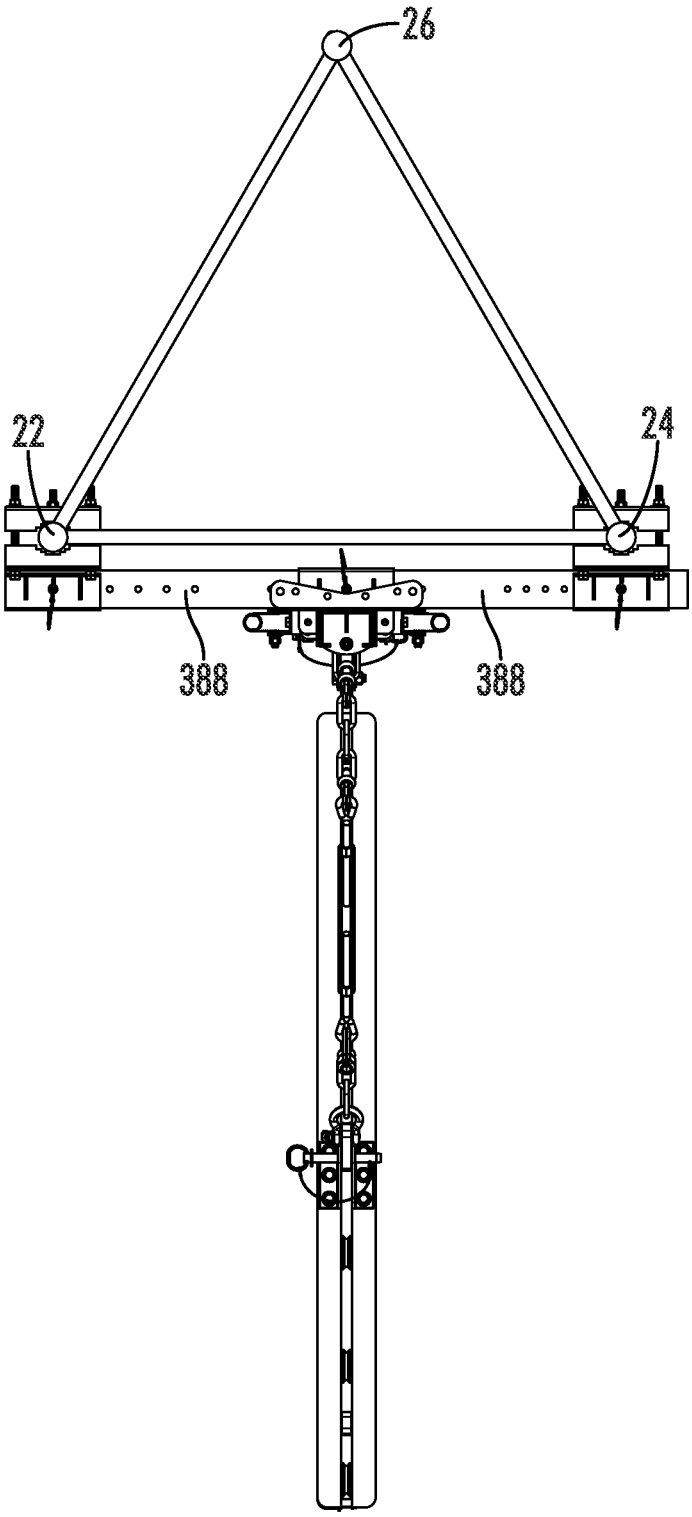
FIG. 11B illustrates a top plan view of the hoist of FIG. 9.
Figure 12:
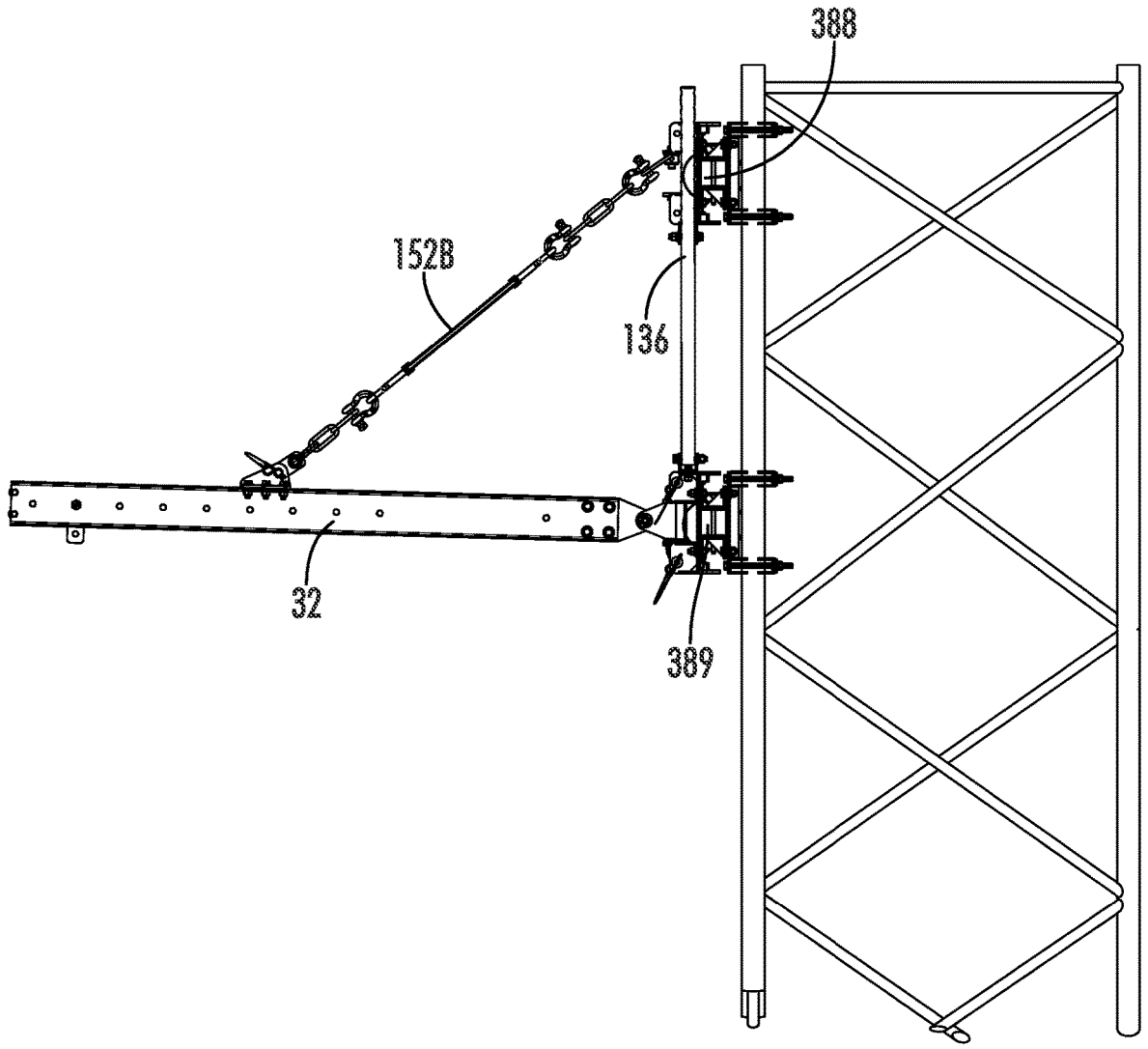
FIG. 12 illustrates a side elevation view of the hoist of FIG. 9 with the hoist beam in a lowered position.
Figure 13:
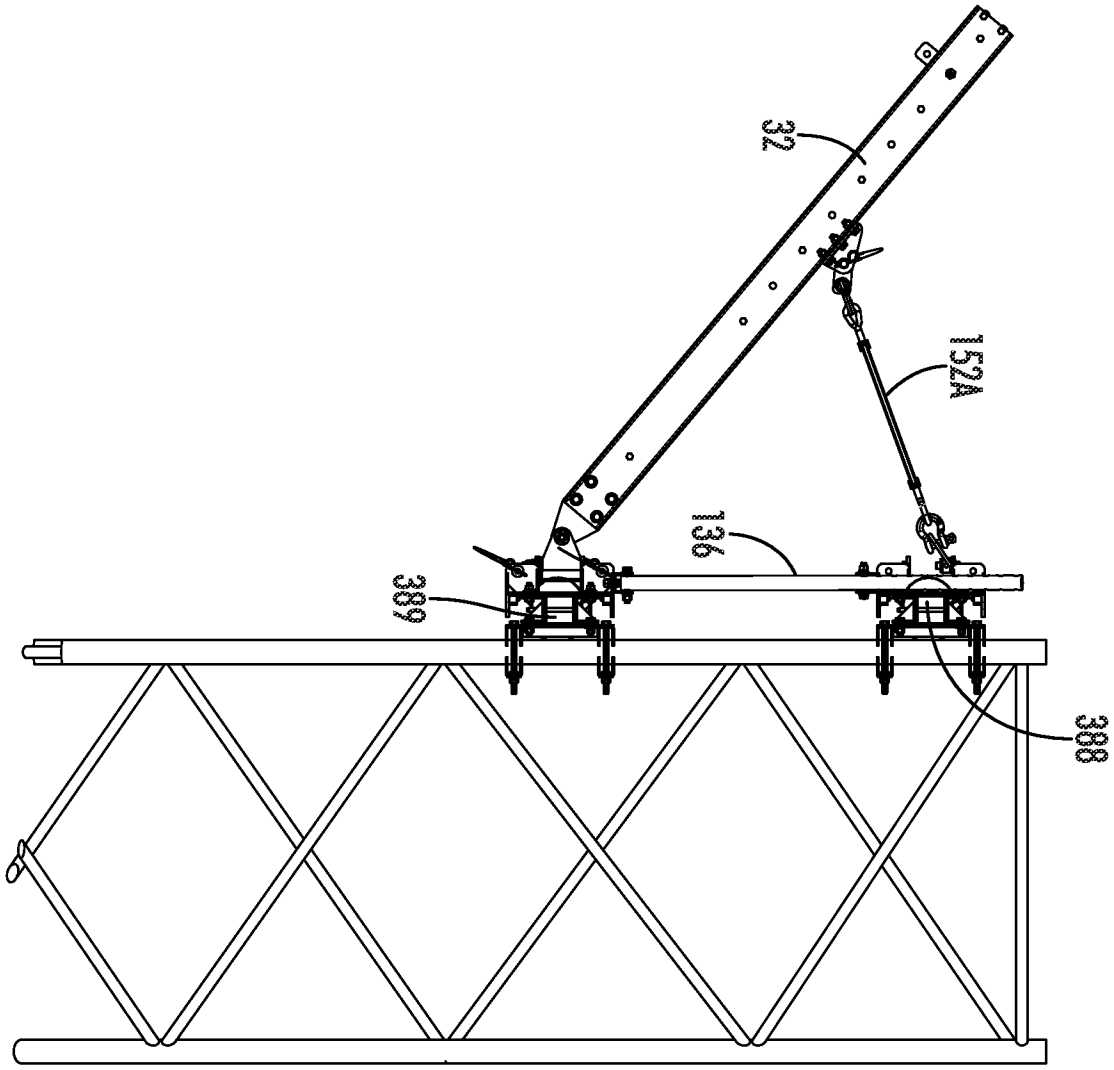
FIG. 13 illustrates a side elevation view of the hoist of FIG. 9 with the hoist beam in a raised position.
Figure 14:
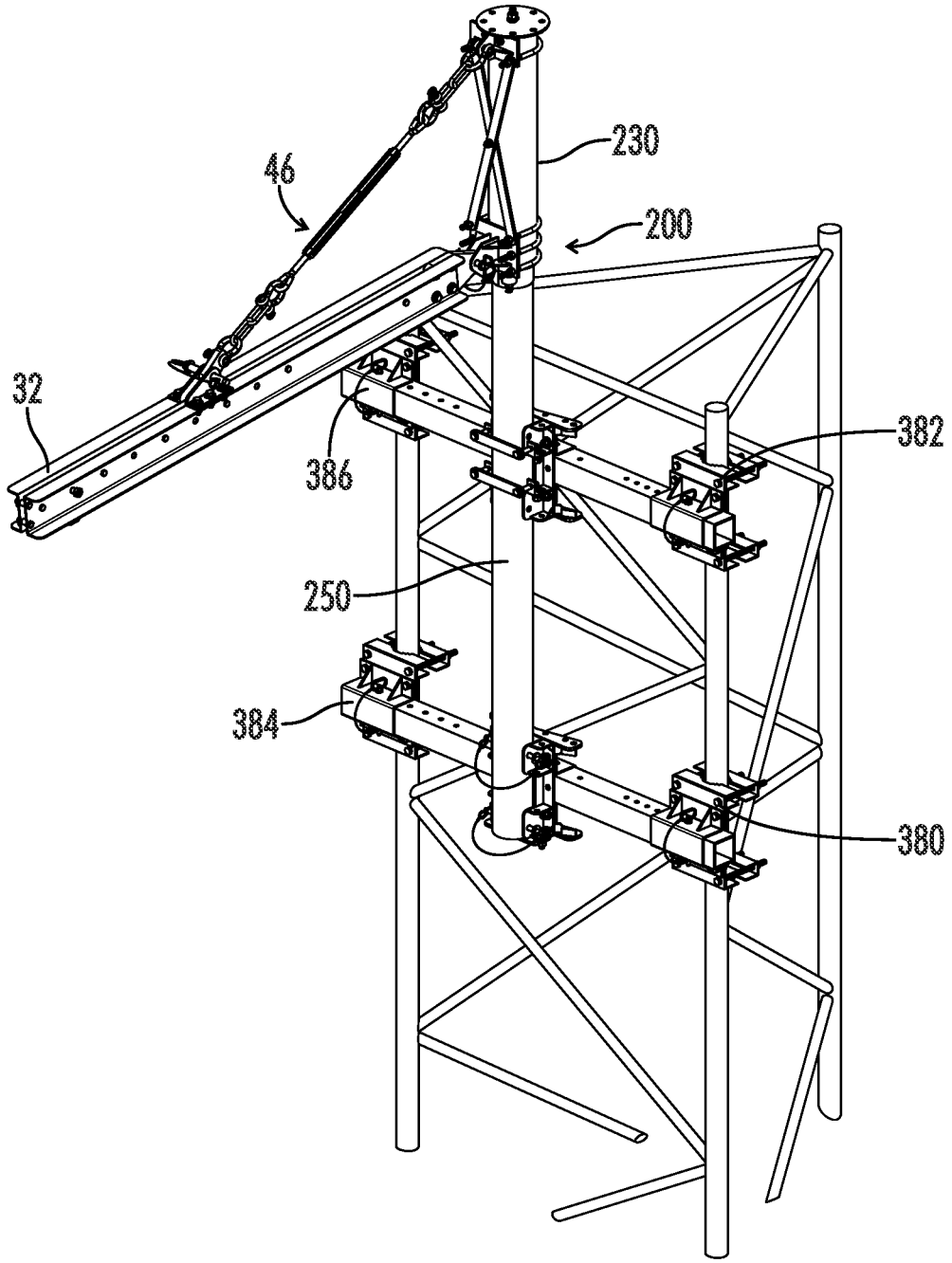
FIG. 14 illustrates a front top side perspective view of a hoist of a fourth embodiment of the present invention shown attached to the face of a guyed or self-support tower.
Figure 15A:
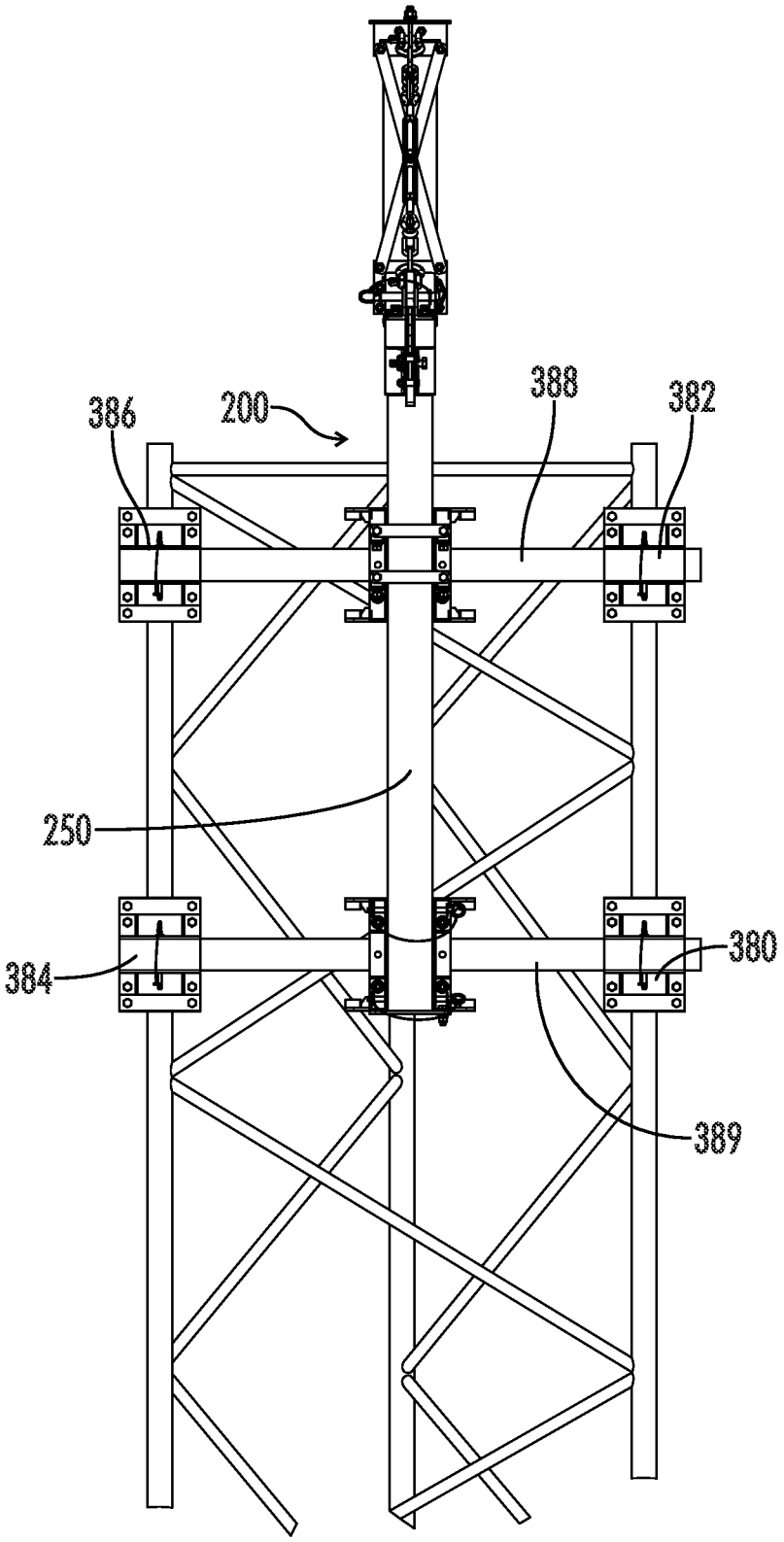
FIG. 15A illustrates a front elevation view of the hoist of FIG. 14.
Figure 15B:
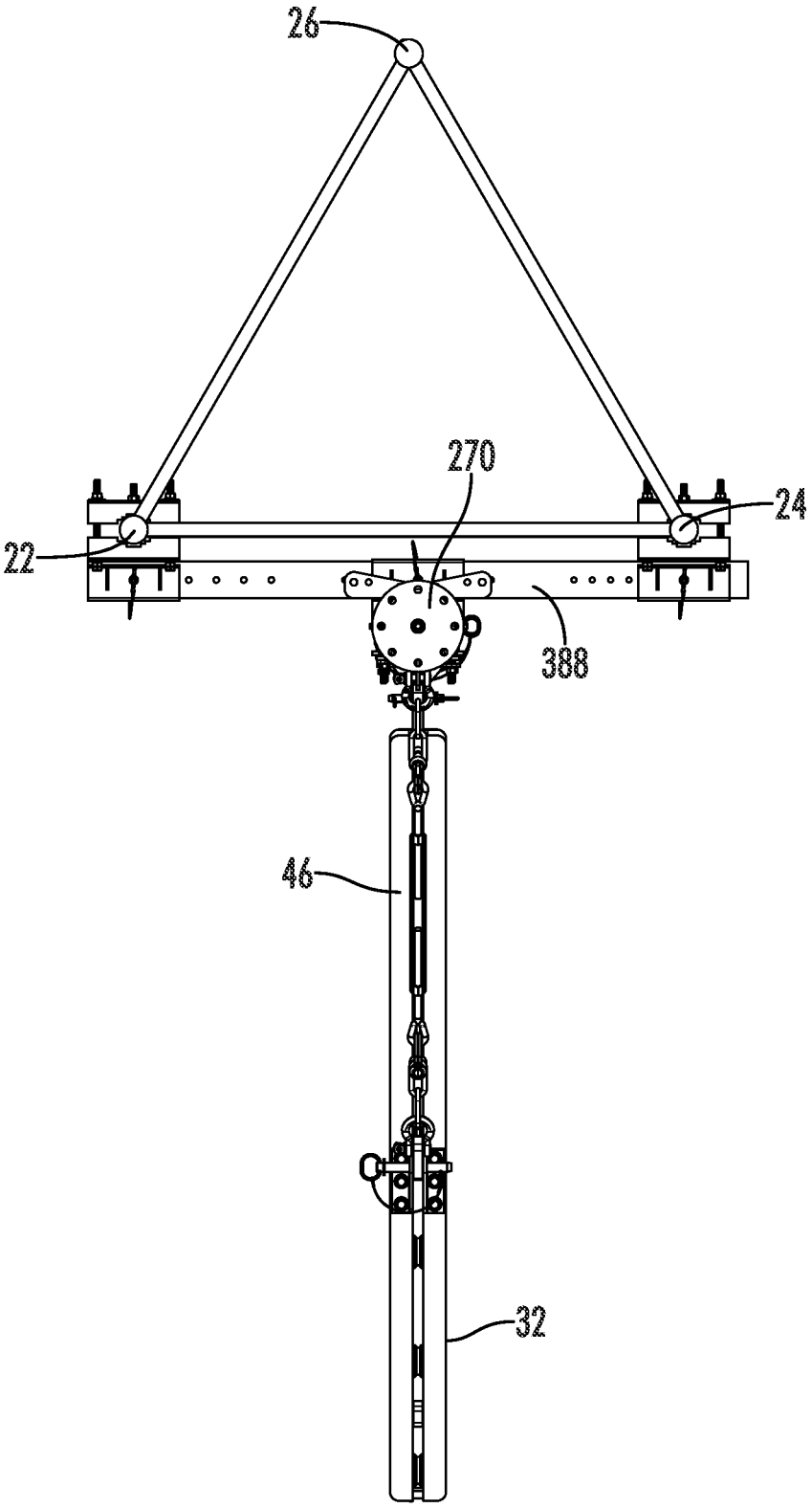
FIG. 15B illustrates a top plan view of the hoist of FIG. 14.
Figure 16:
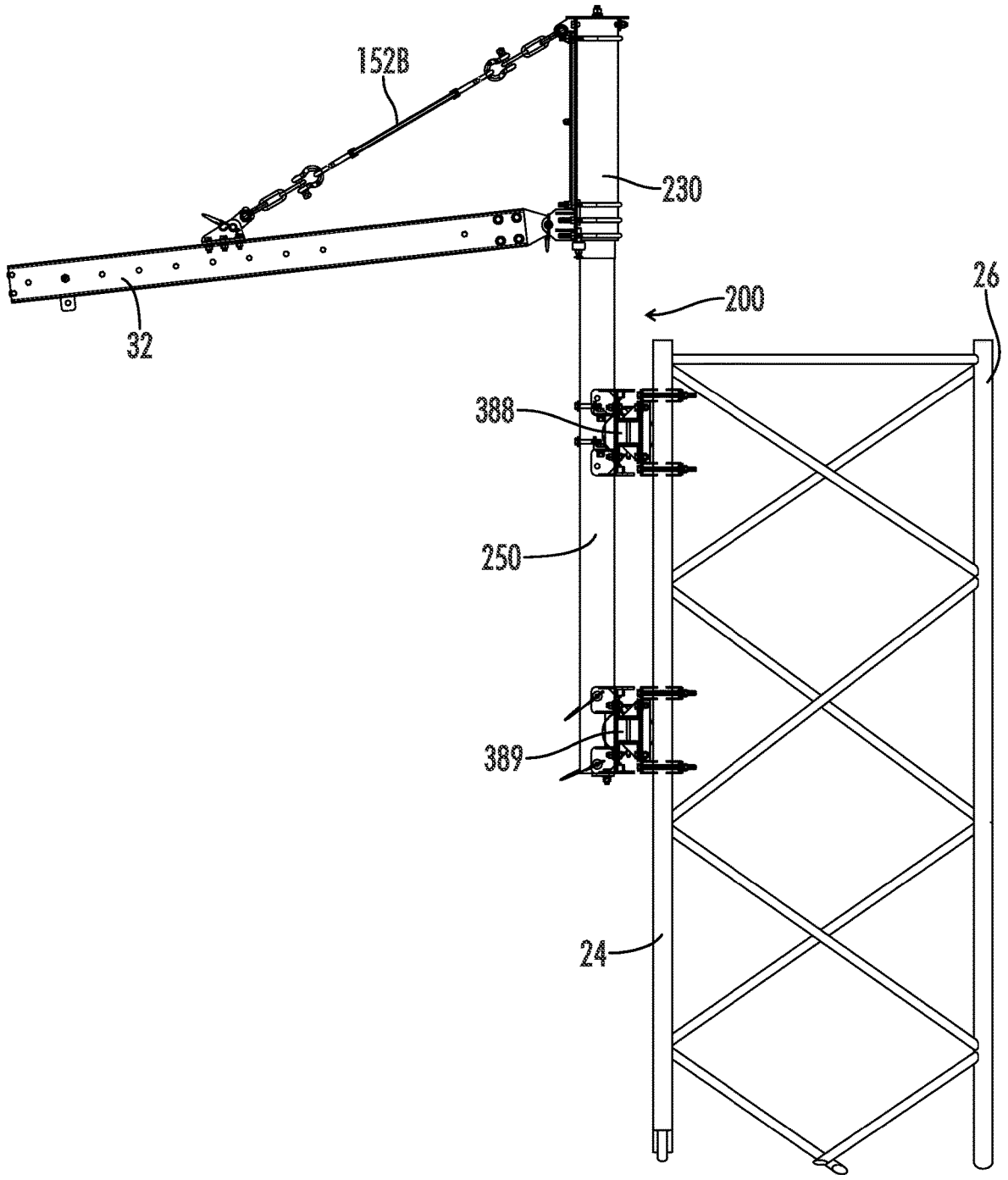
FIG. 16 illustrates a side elevation view of the hoist of FIG. 14 with the hoist beam in a lowered position.
Figure 17:
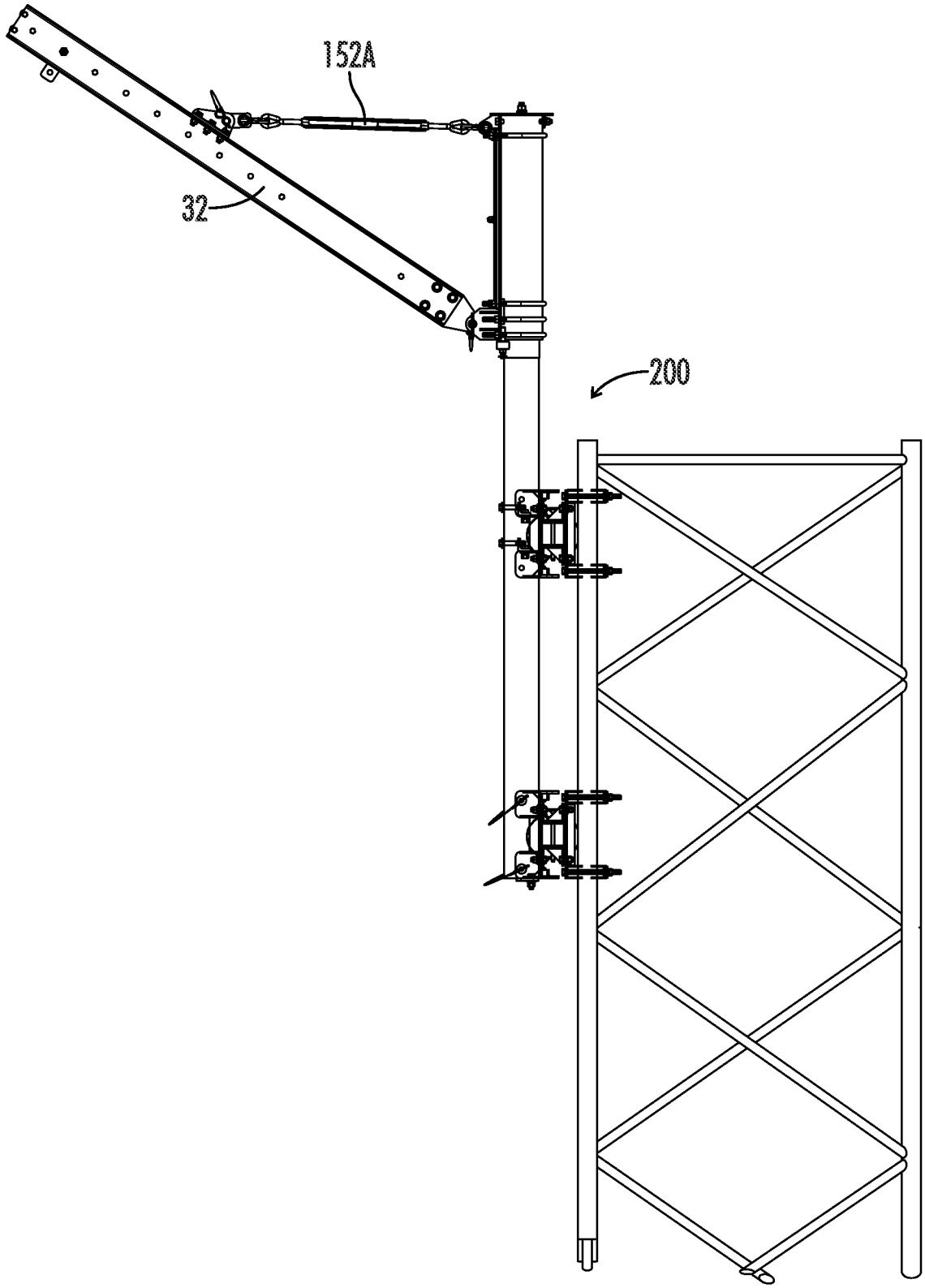
FIG. 17 illustrates a side elevation view of the hoist of FIG. 14 with the hoist beam in a raised position.
Figure 18:
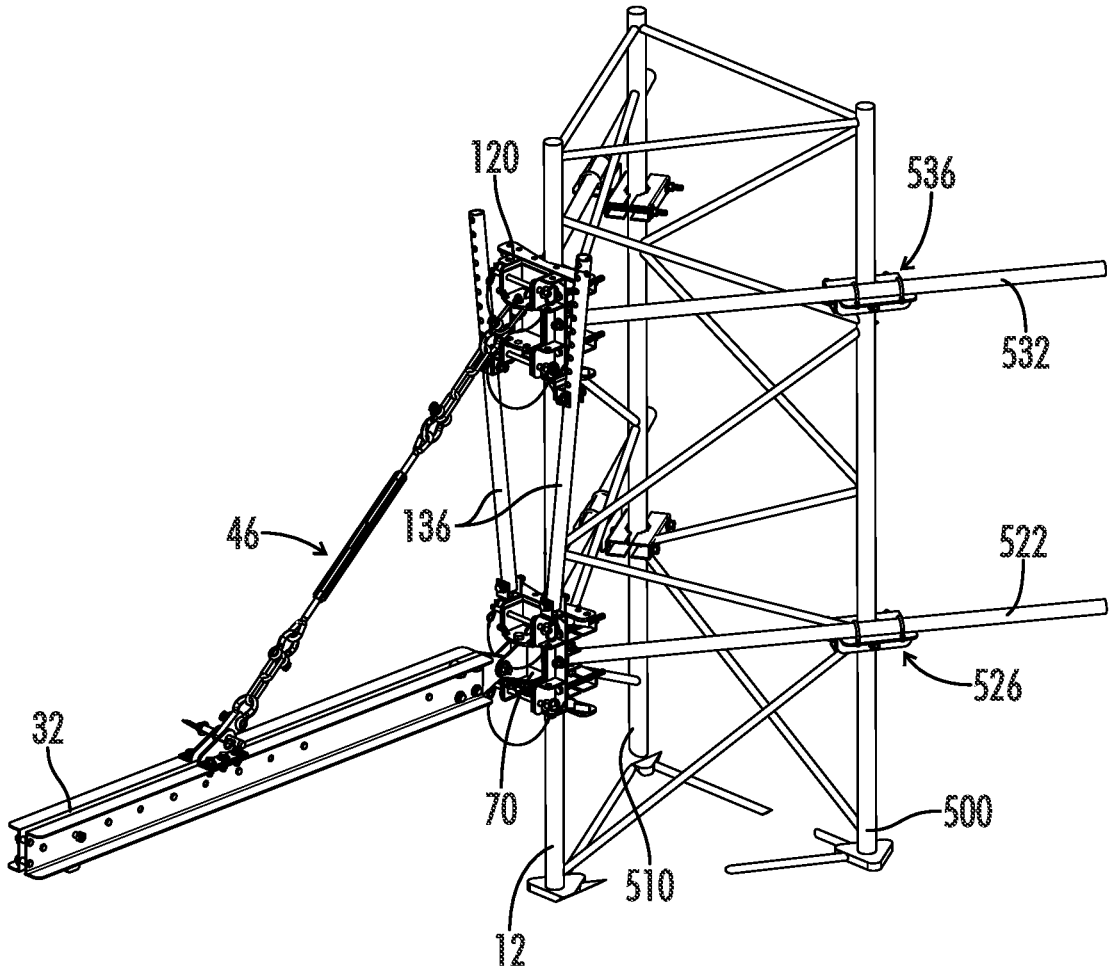
FIG. 18 illustrates a front top side perspective view of a hoist of a fifth embodiment of the present invention shown attached to the leg of a guyed or self-support tower.
Figure 19:
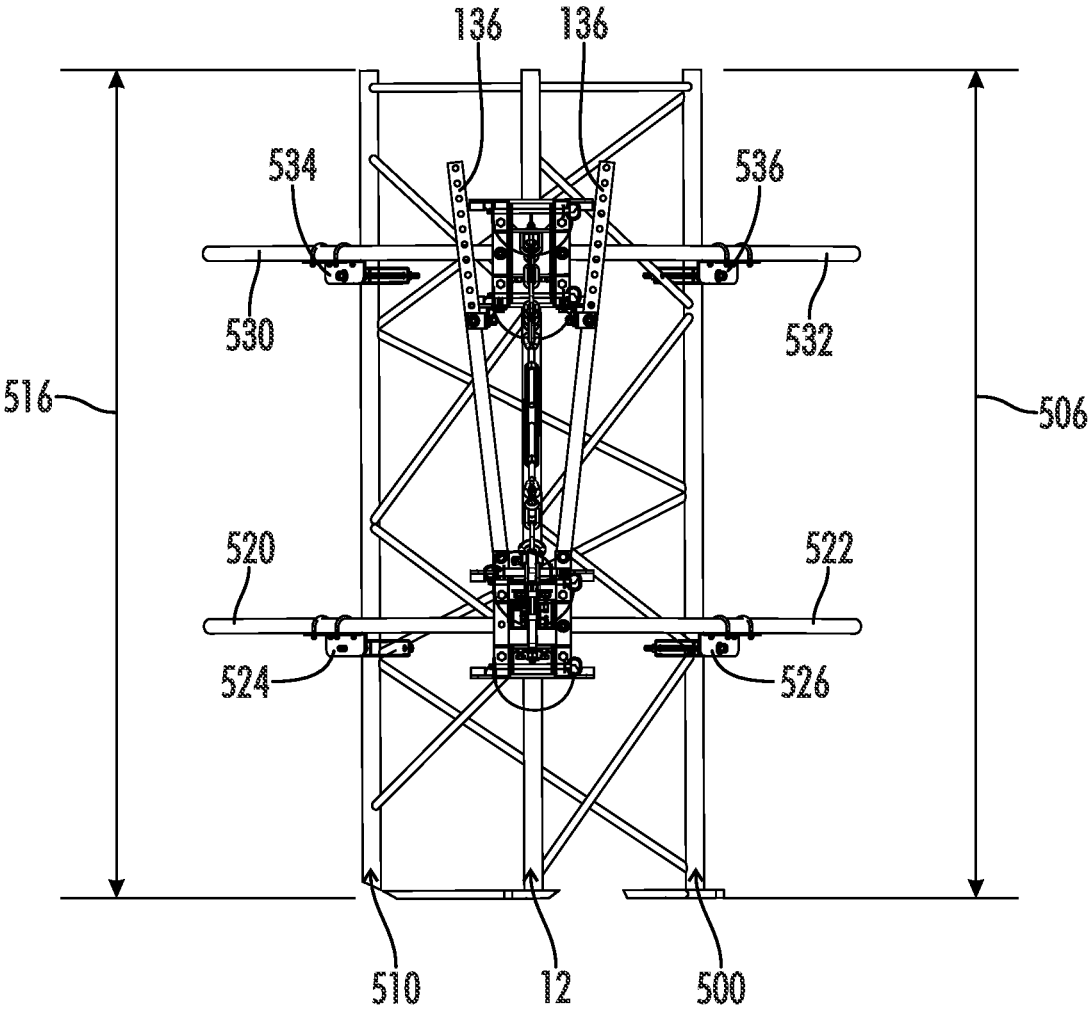
FIG. 19 illustrates a front elevation view of the hoist of FIG. 18.
Figure 20:
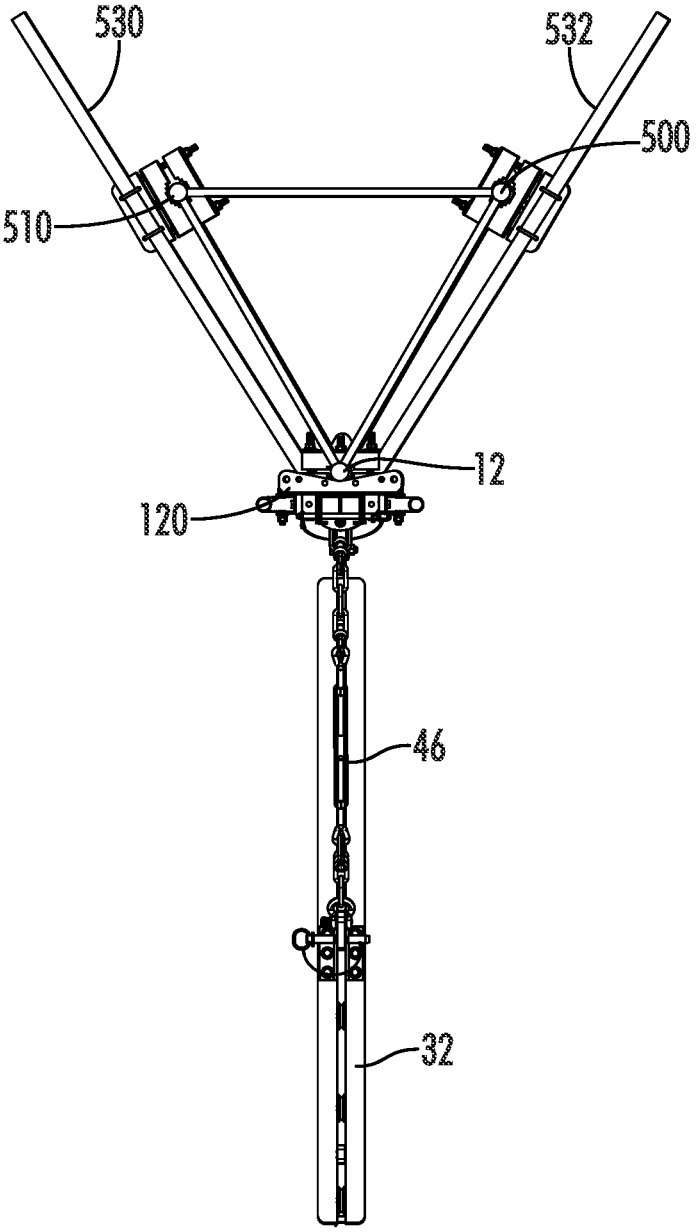
FIG. 20 illustrates a top plan view of the hoist of FIG. 18.
Figure 21:
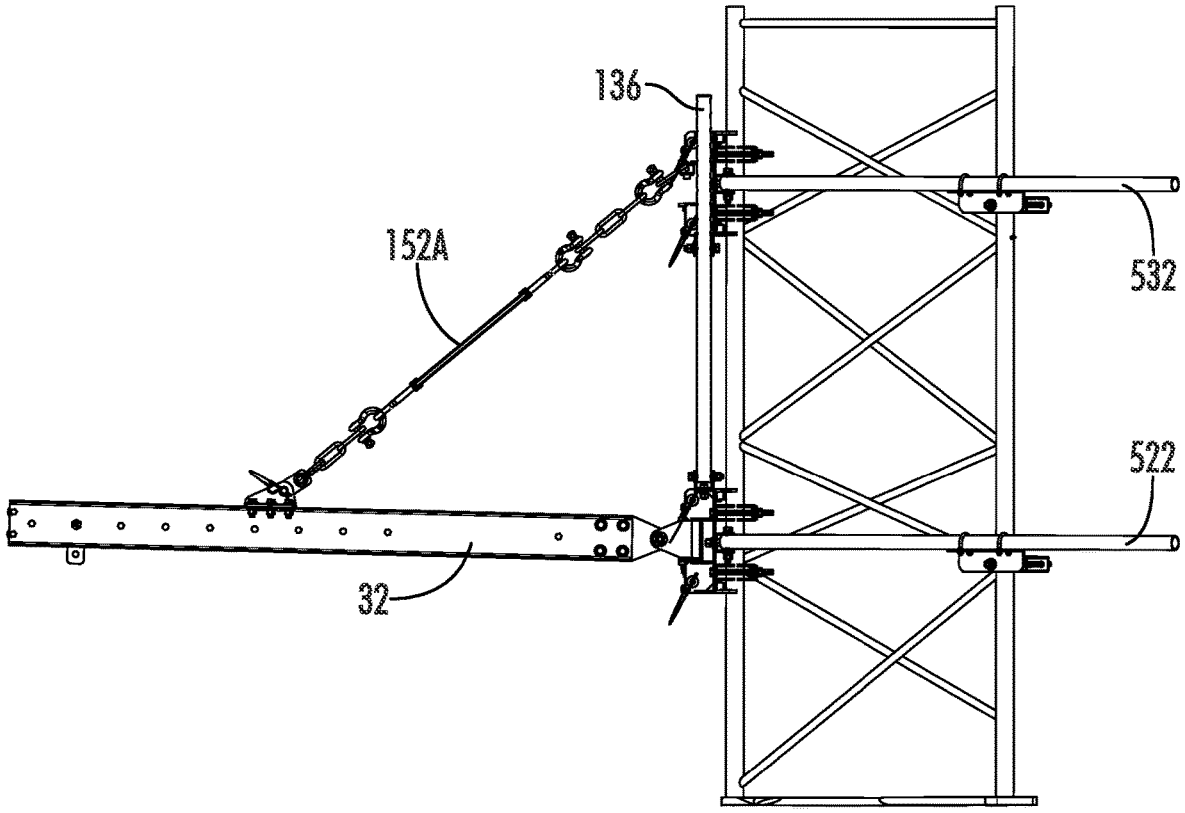
FIG. 21 illustrates a side elevation view of the hoist of FIG. 1.8 with the hoist beam in a lowered position.
Figure 22:
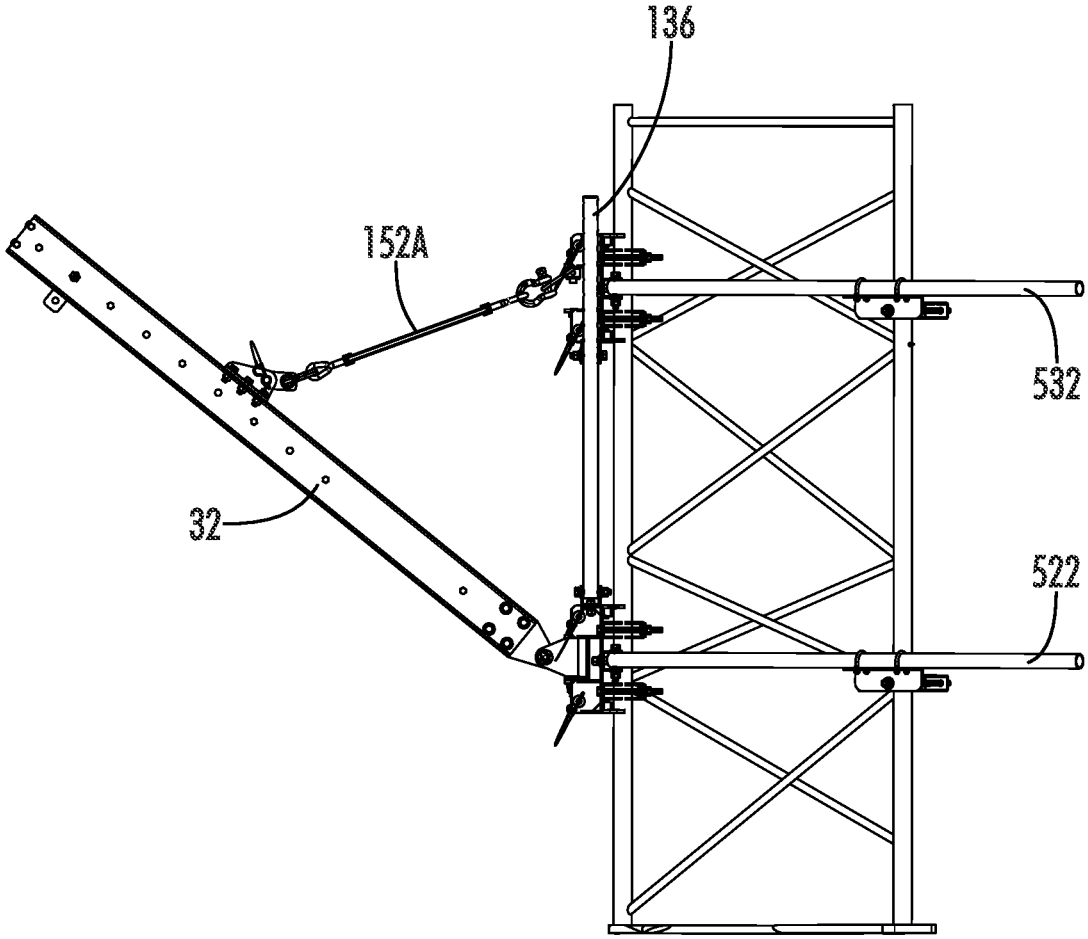
FIG. 22 illustrates a side elevation view of the hoist of FIG. 18 with the hoist beam in a raised position.
Figure 23:
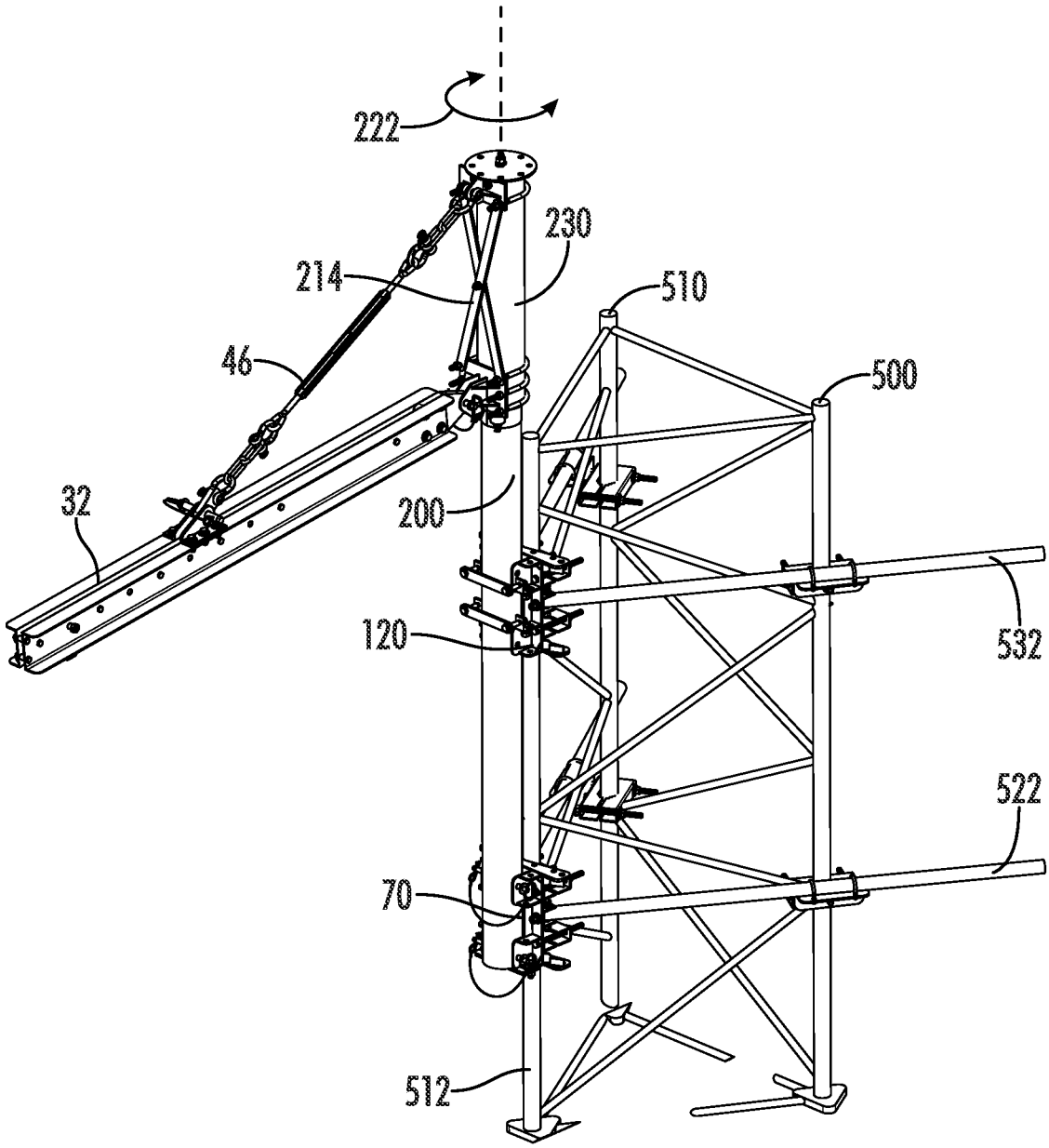
FIG. 23 illustrates a front top side perspective view of a hoist of a sixth embodiment of the present invention shown attached to the leg of a guyed or self-support tower.
Figure 24:
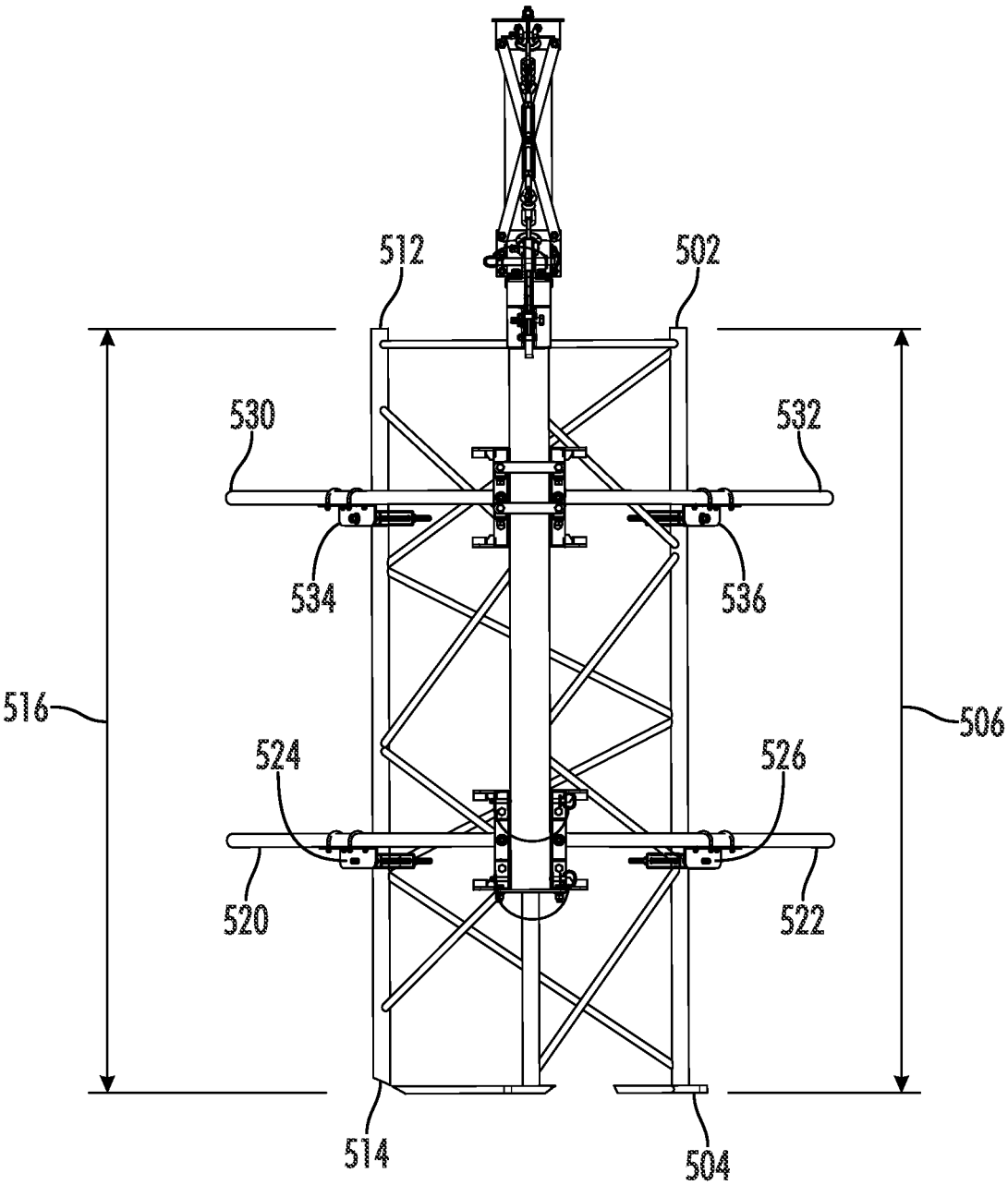
FIG. 24 illustrates a front elevation view of the hoist of FIG. 23.
Figure 25:
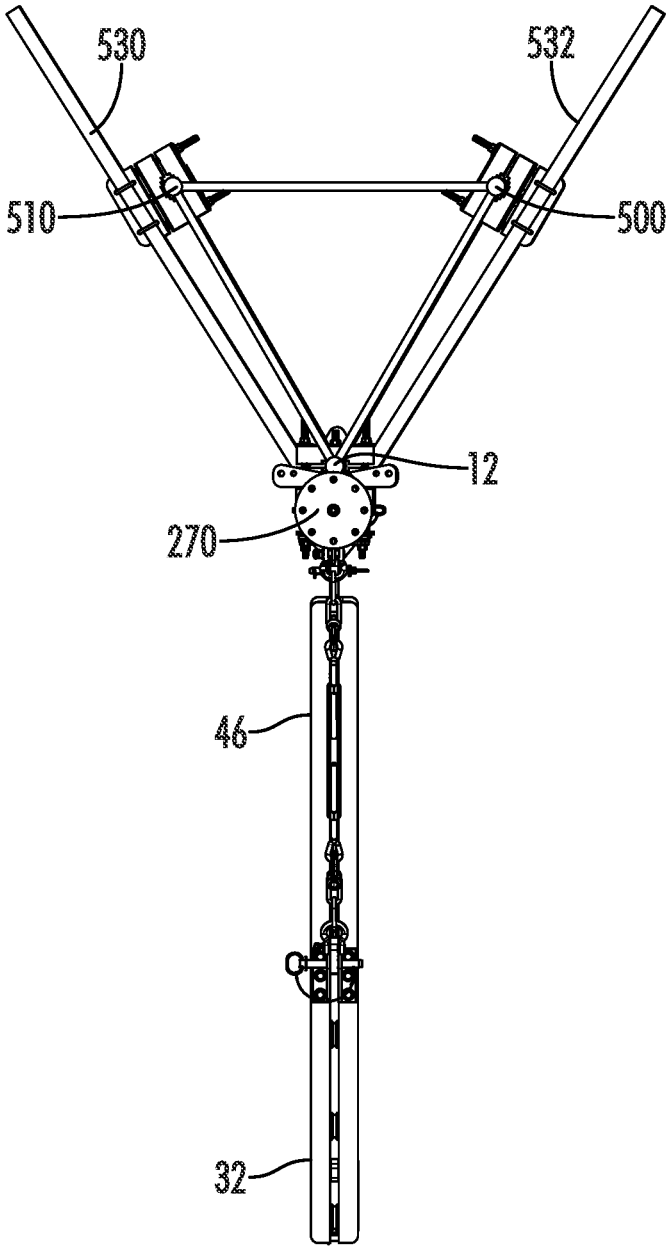
FIG. 25 illustrates a top plan view of the hoist of FIG. 23.
Figure 26:
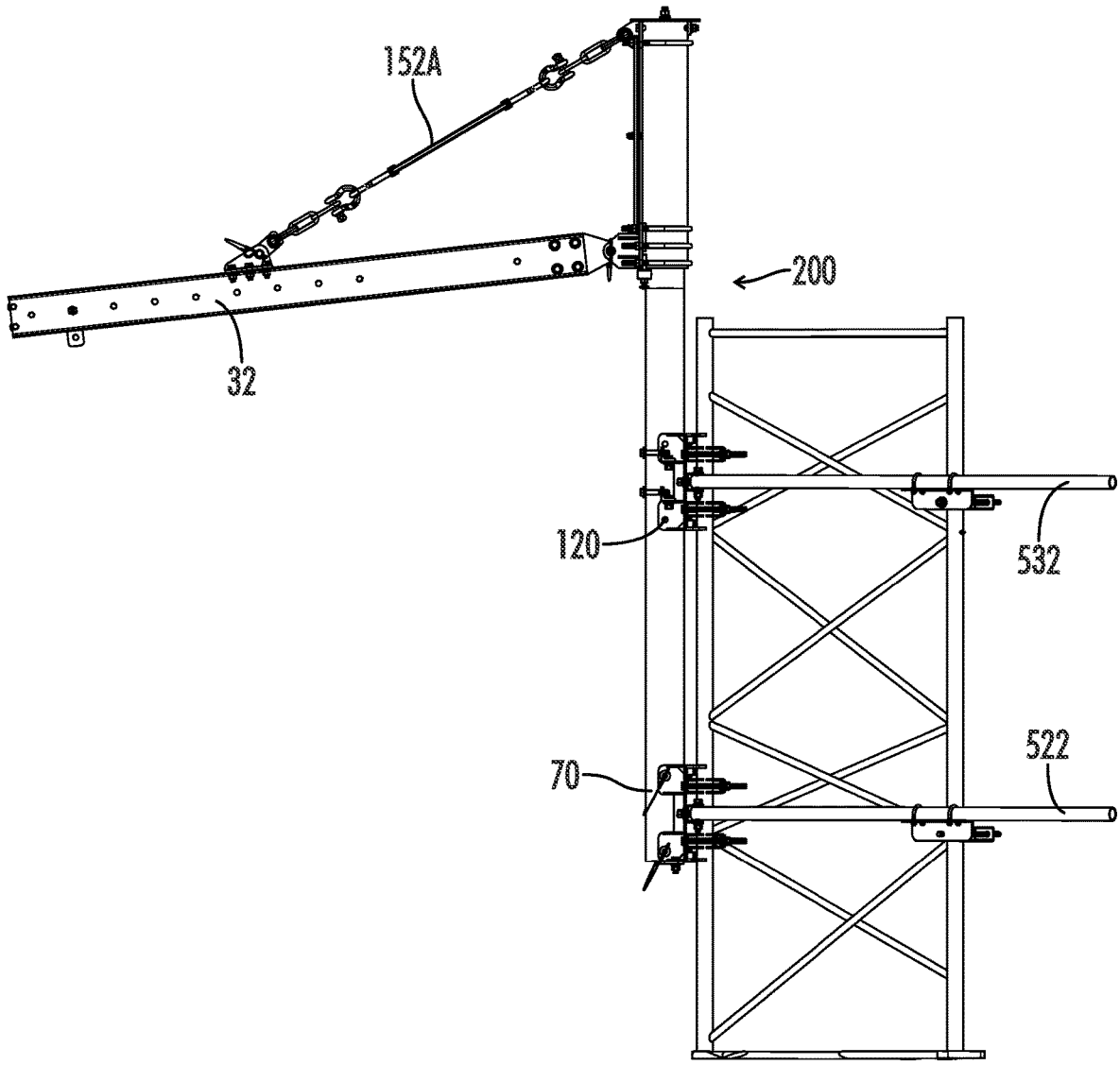
FIG. 26 illustrates a side elevation view of the hoist of FIG. 23 with the hoist beam in a lowered position.
Figure 27:
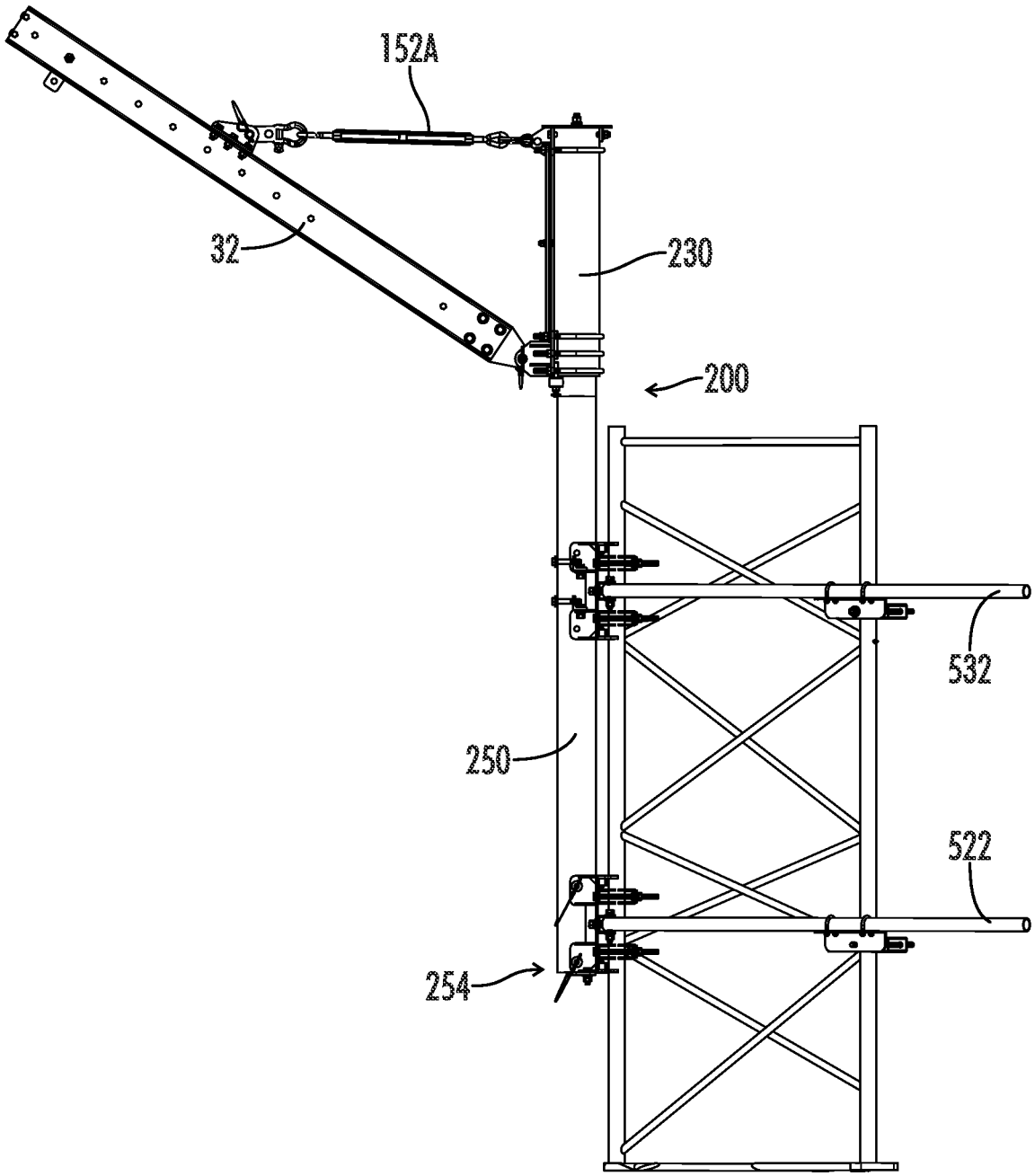
FIG. 27 illustrates a side elevation view of the hoist of FIG. 23 with the hoist beam in a raised position.

The lower cross beam bracket 390 may further comprise a movable bridge 110, as described previously and shown in FIG. 9B.

Optionally, as shown in FIGS. 9-13, an upper cross beam bracket 392 may be connected to the upper cross beam 388 between the upper left clamp bracket system 386 and the upper right clamp bracket system 382. The upper cross beam bracket 392 may be located above the lower cross beam bracket 390. An upper vertically-oriented pivot bolt 132 may connect the brace cable upper end 47A to the upper cross beam bracket 392. Optionally, the brace cable 46 is configured to rotate, in a coordinated fashion with the hoist beam 32, clockwise and/or counter-clockwise about an upper vertically-oriented pivot bolt pivot axis 134 extending generally parallel to the tower pole height 18. Rotation of the brace cable 46 about the upper vertically-oriented pivot bolt pivot axis 134 may allow the hoist beam 32 to move toward and away from the lower cross beam 389 to allow the hoist beam 32 to move in the plane perpendicular to the tower pole height 18.

In addition, the hoist system may optionally comprise include one or more features described previously.

In another embodiment, as shown for example in FIGS. 14-17, the hoist 30 may be secured to a tower 10 using a mast 200. As shown in FIGS. 14-17, the tower 10 may include a left tower leg/pole 22 and a right tower leg/pole 24, the left tower leg/pole 22 connected to the right tower leg/pole 24 by a plurality of tower braces 28, the left tower leg/pole 22 and the right tower leg/pole 24 each having a top 14A, 14B located above the ground, a bottom 16A, 16B that may be connected directly or indirectly to the ground, and a height 18A, 18B extending from the top 14A, 14B to the bottom 16A, 16B. The method further comprising assembling a hoist system 30 by performing the one or more of following steps in any suitable order including simultaneously: a) securing a lower right clamp bracket system 380 to the right tower leg/pole 24 by placing the lower right clamp bracket system 380 at least partially around the right tower leg/pole 24; b) securing an upper right clamp bracket system 382 to the right tower leg/pole 24 by placing the upper right clamp bracket system 382 at least partially around the right tower leg/pole 24; c) securing a lower left clamp bracket system 384 to the left tower leg/pole 22 by placing the lower left clamp bracket system 384 at least partially around the left tower leg/pole 22; d) securing an upper left clamp bracket system 386 to the left tower leg/pole 22 by placing the upper left clamp bracket system 386 at least partially around the left tower leg/pole 22; e) providing a hoist comprising a hoist beam 32 comprising a forward end 34, a rear end 36, a hoist beam length 38 extending from the hoist beam forward end 34 to the hoist rear end 36; 0 providing an upper cross beam 388 and a lower cross beam 389; and g) providing a mast 200.

Optionally, as shown for example in FIGS. 14-17, the hoist 30 may have one or more of the following features: i) the lower left clamp bracket system 384 is at substantially the same height as the lower right clamp bracket system 380; ii) the lower cross beam 389 extends between the lower left clamp bracket system 384 and the lower right clamp bracket system 380 and/or is oriented generally parallel to the ground and perpendicular to the left and right pole heights 18A,18B; iii) the upper left clamp bracket system 386 is at substantially the same height as the upper right clamp bracket system 382; iv) the upper cross beam 388 extends between the upper left clamp bracket system 386 and the upper right clamp bracket system 382 and/or is oriented generally parallel to the ground and perpendicular to the left and right pole heights 18A,18B; v) the upper cross beam 388, the upper left clamp bracket system 386 and/or the upper right clamp bracket system 382 are located above the lower cross beam 389, the lower left clamp bracket system 384 and/or the lower right clamp bracket system 380; vi) the mast 200 is connected to the lower cross beam 389 by a lower cross beam bracket 390 located between the lower left clamp bracket system 384 and the lower right clamp bracket system 380, the mast 200 is connected to the upper cross beam 388 by an upper cross beam bracket 392 located between the upper left clamp bracket system 386 and the upper right clamp bracket 382, and/or the mast 200 comprises a mast height 206 extending generally parallel to the tower pole height 18; vii) the hoist beam 32 is connected to the mast 200 and extends laterally from the mast 200; viii) the hoist 30 further comprises at least one sheave 40, 42 connected to the hoist beam 32 and receiving a pulley cable/load line 44; ix) brace cable 46 connects the hoist beam 32 to the mast 200 and extends at an angle relative to the left and right tower pole heights 18A, 18B and comprises an brace cable upper end 47A connected to the mast 200 and/or a brace cable lower end 47B connected to the hoist beam 32.

Optionally, as shown for example in FIGS. 14-17, first mast clamp bracket 210 may be located above the upper cross beam bracket 392 and connect the hoist beam rear end 36 to the mast 200 and wraps at least partially around the mast 200. Further, the mast top 202 and/or hoist beam rear end 36 may be located above the tower pole top 12. In addition, the mast 200 may also comprise at least one bearing system 220 as previously described.

In addition, the hoist system may optionally comprise include one or more features described previously.

In other embodiments, a hoist 30 comprising one or more components as described herein may be secured to a tower pole 12, and/or a clamp bracket system 70 comprising one or more components described herein may be secured to the tower pole 12.

In still further embodiments, as shown in FIGS. 18-27, the tower 10 may include a right tower leg/pole 500 and a rear left tower leg/pole 510 that are connected by a plurality of tower braces 28. The rear right tower leg/pole 510 may comprise a rear right tower leg/pole top 502, a rear right tower leg/pole bottom 504, a rear right tower leg/pole height 506 extending from the rear right tower leg/pole top 502 and rear right tower leg/pole bottom 504. The rear left tower leg/pole 510 may comprise a rear left tower leg/pole top 512, a rear left tower pole/leg bottom 514, a rear left tower/leg pole height 516 extending from the rear left tower/leg pole top 512 and rear left tower pole/leg bottom 514. Optionally, the first clamp bracket system 70 may be connected to the rear left tower pole/leg 502 by a lower left horizontal brace 520 and/or connected to the rear right tower pole/leg 510 by a lower right horizontal brace 530. The lower left horizontal brace 520 may be connected to the left rear tower pole/leg 502 by a lower left horizontal brace clamp 524. The lower right horizontal brace 522 may be connected to the rear left tower pole/leg 510 by a lower right horizontal brace clamp 526. Optionally, the second clamp bracket system 120 may be connected to the rear left tower pole/leg 510 by an upper left horizontal brace 530 and/or connected to the rear right tower pole 500 by an upper right horizontal brace 532. The upper left horizontal brace 530 may be connected to the rear tower pole 510 by an upper left horizontal brace clamp 534. The upper right horizontal brace 532 may be connected to the rear right tower pole 500 by an upper right horizontal brace clamp 536.

In addition, the system may optionally comprise include one or more features described previously.

Figure 33:
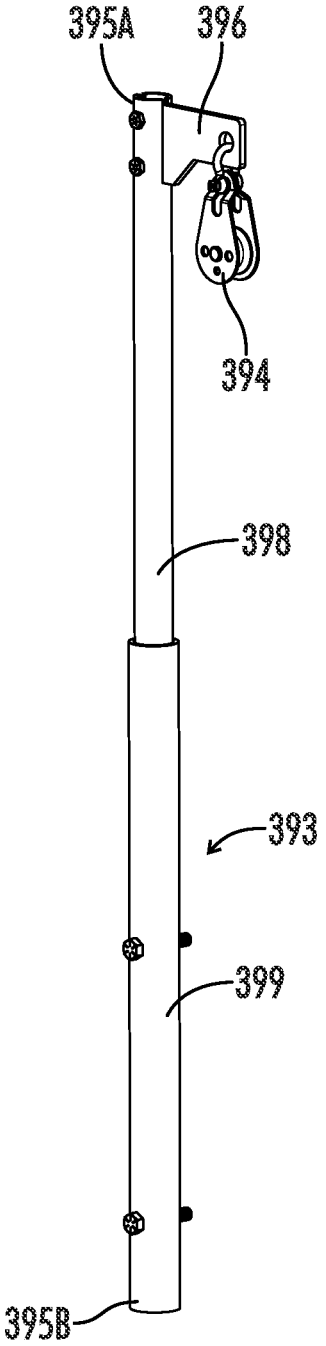
FIG. 33 illustrates a side perspective view of the davit of FIG. 32.
Figure 34:
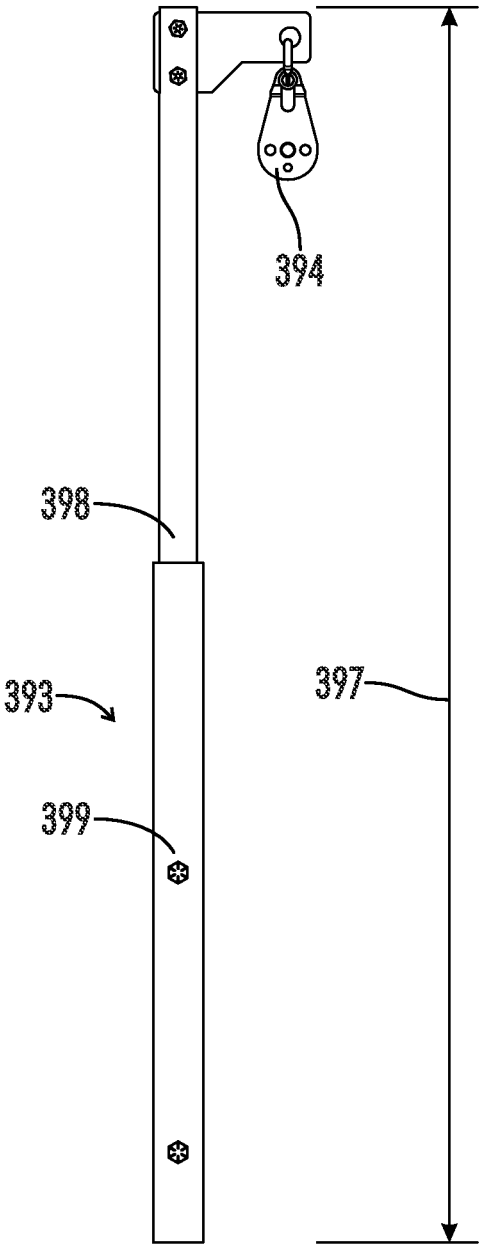
FIG. 34 illustrates a side elevation view of the davit of FIG. 33.

In a further embodiment, as shown in FIGS. 33-34, the hoist may be secured to a tower pole 12 using a davit 293. More particularly, the method may involve providing a tower pole 12 comprising a tower pole top 14, a tower pole bottom 16 and a tower pole height 18 extending from the top 14 to the bottom 16. The hoist 30 may be secured to the tower pole 12 by performing one or more steps in any suitable order including simultaneously: a) securing a davit 393 comprising a davit sheave 394, a davit top 395A, a davit bottom 395B, a davit height 397 extending from the top 395A to the bottom 395B, wherein the davit 393 is optionally secured to the tower 12, for example, by a clamp bracket system 70,120, so that the davit 393 comprises a davit height 397 generally parallel to the tower pole height 18 and/or b) securing a mast 200 to the tower 12 using the clamp bracket system 70,120. At least after complete installation of the system, the mast 200 may connect to a hoist 30 comprising a hoist beam 32 and the hoist beam 32 may extend downward along the mast 200 (as opposed to laterally). Optionally, the hoist beam 32 is connected to the mast 200 as described above. Additionally, the davit 393 of this method may optionally comprise an upper davit pole 398 partially nested in an interior of a lower davit pole 399. Optionally, the davit sheave 394 may be adjacent to the davit top 395A and/or located on a davit flange 396.

In addition, the system may optionally comprise include one or more features described previously.

Figure 40:
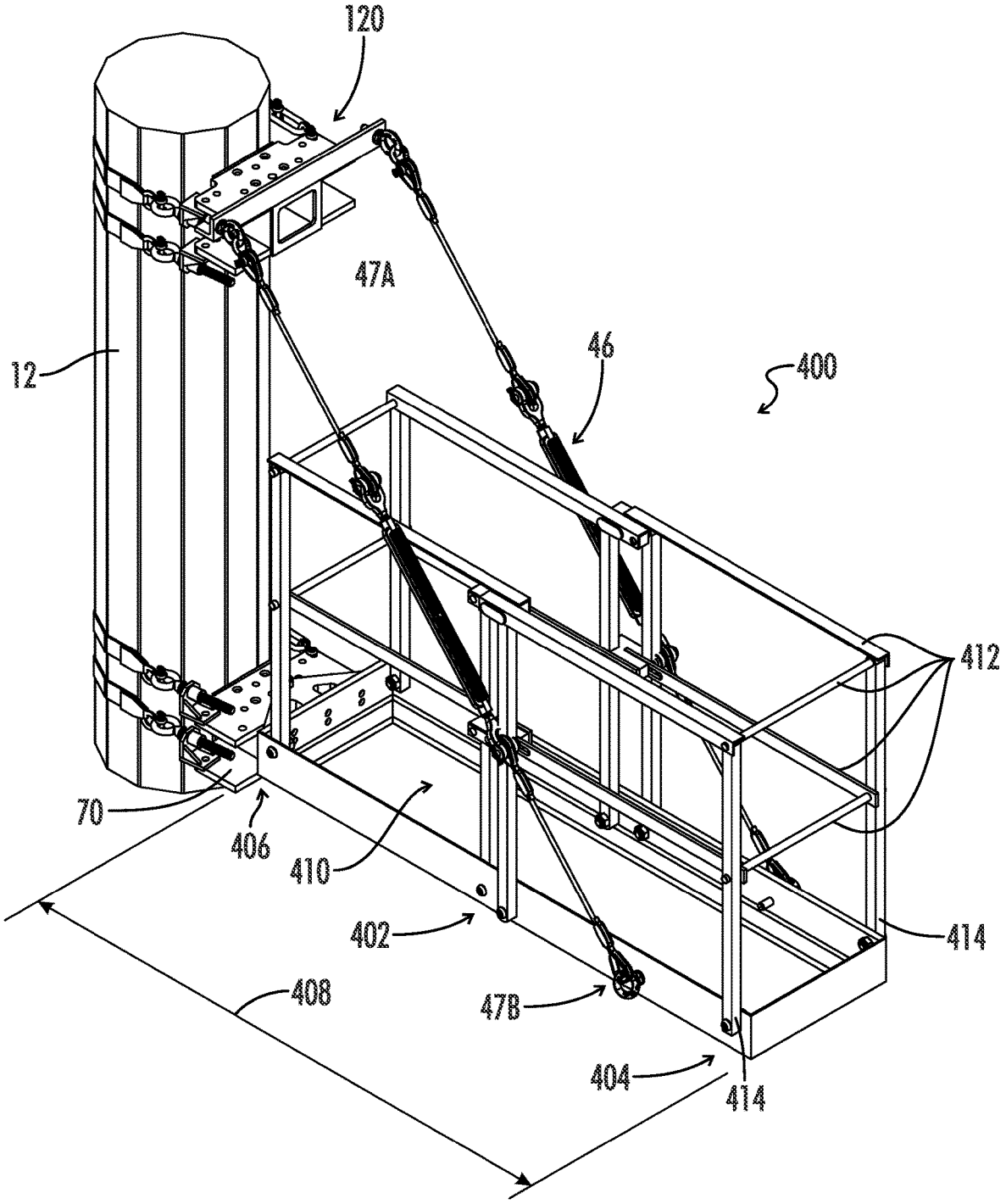
FIG. 40 illustrates a front side perspective view of a platform of one embodiment of the present invention attached to a monopole.

In a further embodiment, as shown in FIG. 40, a platform 400 may be secured a tower pole 12 comprising a tower pole top 14 located above the ground, a tower pole bottom 16 and a tower pole height 18 extending from the tower pole top 14 to the tower pole bottom 16. Optionally, the platform 400 may be secured to the tower pole 12 by performing one or more of the following steps in any suitable order including simultaneously: a) securing a first clamp bracket system 70 to the tower pole 12 by placing the first clamp bracket system 70 at least partially around the tower pole 12; and/or b) providing a platform 400 comprising a platform beam 402 comprising a forward end 404, a rear end 406, a platform beam length 408 extending from the forward end 404 to the rear end 406.

Optionally, as shown in FIG. 40, the platform 400 may comprise one or more of the following features: i) the first clamp bracket system 70 connects the platform beam rear end 406 to the tower pole 12; ii) the platform beam 402 extends laterally from the tower pole 12 and the first clamp bracket system 70; and/or iii) a brace cable 46 connects the platform beam 402 to the tower pole 12 and extends at an angle relative to the tower pole height 18 and/or comprises an upper end 47A connected to the tower pole 12 and a lower end 47B connected to the platform beam 402. Optionally, the platform 400 may further comprise a substantially solid floor 410 which may be configured to allow a human to stand thereon. In some cases, the platform 400 may comprise a horizontal rail 412 and a vertical rail 414. Optionally, the horizontal rail 412 is located generally perpendicular to the tower pole height 18 and/or the vertical rail 414 is located generally parallel to the tower pole height 18. Optionally, the platform beam length 408 is generally perpendicular to the tower pole height 18, and the method may further comprise walking on the platform 400. The platform beam 402 may be located on a bottom of the platform 400.

Optionally, as shown in FIG. 40, the platform 400 may comprise two parallel platform beams 402. The platform beams 402 may optionally extend laterally from the tower pole 12. Optionally, the first clamp bracket system 70 and two parallel brace cables 46 connect the two platform beams 402 to the tower pole 12 and extend at an angle relative to the tower pole height 18. Further, the two parallel brace cables 46 further comprise an upper end 47A connected to the tower pole 12 and a lower end 47B connected to a platform beam 402.

In addition, the system may optionally comprise include one or more features described previously.

The platform 400 also may be secured to a tower 10 (e.g., guyed or self-support tower) comprising a left tower leg/pole 22 and a right tower leg/pole 24, the left tower leg/pole 22 connected to the right tower leg/pole 24 by a plurality of tower braces 28, the left tower leg/pole 22 and the right tower leg/pole 24 each having a top 14A, 14B located above the ground, a bottom 16A, 16B that may be connected directly or indirectly to the ground, and a height 18A, 18B extending from the top 14A, 14B to the bottom 16A, 16B. Optionally, the platform 400 may be secured to the tower 10 by system by performing one or more of the following steps in any suitable order including simultaneously: a) securing a lower right clamp bracket system 380 to the right tower pole 24 by placing the lower right clamp bracket system 380 at least partially around the right tower leg/pole 24; b) securing an upper right clamp bracket system 382 to the right tower leg/pole 24 by placing the upper right clamp bracket system 382 at least partially around the right tower pole 24; c) securing a lower left clamp bracket system 384 to the left tower leg/pole 22 by placing the lower left clamp bracket system 384 at least partially around the left tower leg/pole 22; d) securing an upper left clamp bracket system 386 to the left tower pole 22 by placing the upper left clamp bracket system 386 at least partially around the left tower leg/pole 22; e) providing a platform 400 comprising a platform beam 402 comprising a forward end 404, a rear end 406, a platform beam length 408 extending from the platform beam forward end 404 to the platform rear end 406; and/or 0 providing an upper cross beam 388 and a lower cross beam 389.

In addition, the system may optionally comprise include one or more features described previously.

Optionally, i) the lower left clamp bracket system 384 may be at substantially the same height as the lower right clamp bracket system 380; ii) the lower cross beam 389 may extend between the lower left clamp bracket system 384 and the lower right clamp bracket system 380 and may be oriented generally parallel to the ground and perpendicular to the left and right pole heights 18A,18B; iii) the upper left clamp bracket system 386 is at substantially the same height as the upper right clamp bracket system 382; iv) the upper cross beam 388 may extend between the upper left clamp bracket system 386 and the upper right clamp bracket system 382 and/or may be oriented generally parallel to the ground and perpendicular the left and right pole heights 18A,18B; v) the upper cross beam 388, the upper left clamp bracket system 386 and/or the upper right clamp bracket system 382 may be located above the lower cross beam 389, the lower left clamp bracket system 384 and/or the lower right clamp bracket system 380; vi) the platform beam 402 may be connected to the lower cross beam 389 and/or may extend laterally from the lower cross beam 389; and/or vii) a brace cable 46 may connect the platform beam 402 to the upper cross beam 388, extends at an angle relative to the left and right tower pole heights 18A,18B and/or comprises an upper end 47A connected to the upper cross beam 388 and a lower end 47B connected to the platform beam 402.

Figure 45:
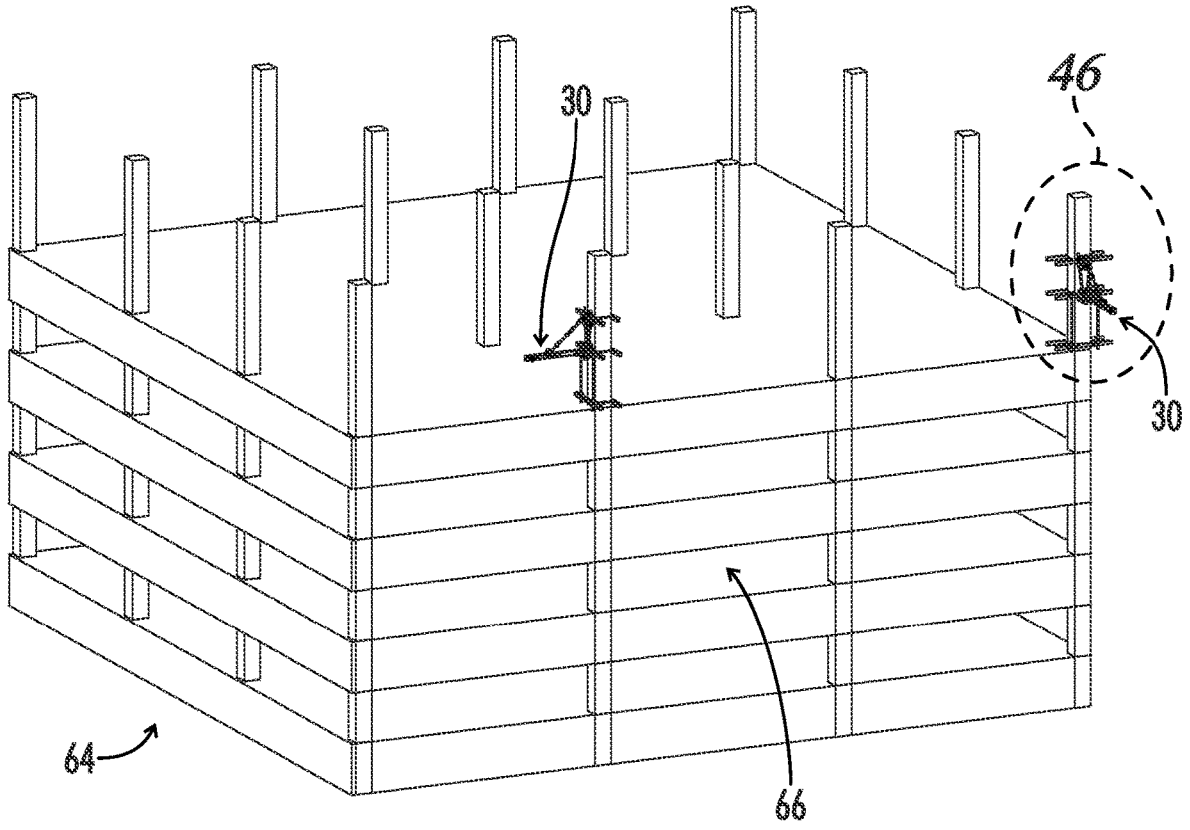
FIG. 45 illustrates a perspective view of two hoists of one embodiment of the present invention of the present invention attached to an interior face and an exterior face of a rectangular tower pole of a building.
Figure 46:
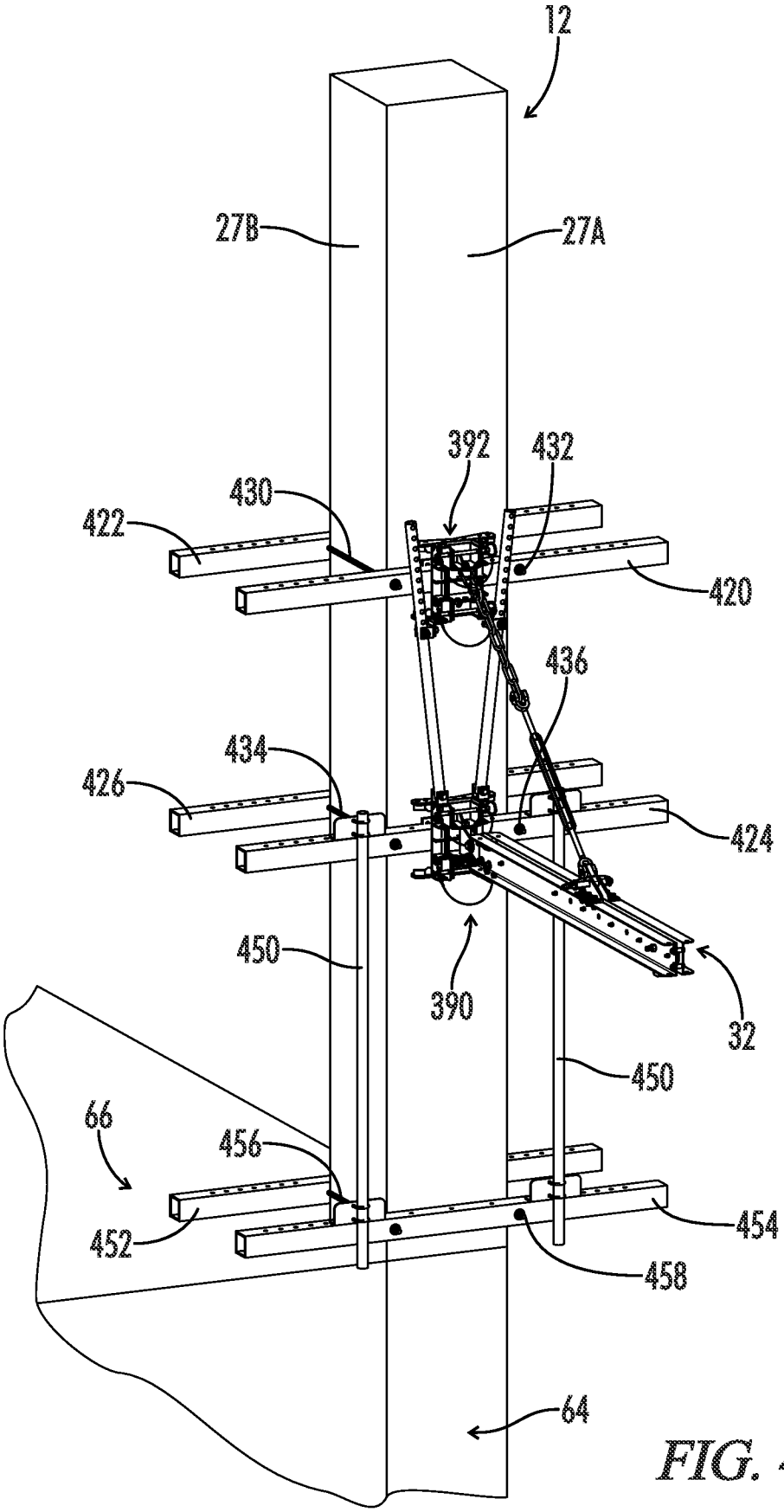
FIG. 46 illustrates a front top side perspective view of a hoist of one embodiment of the present invention attached to a rectangular tower pole of a building.
Figure 47:
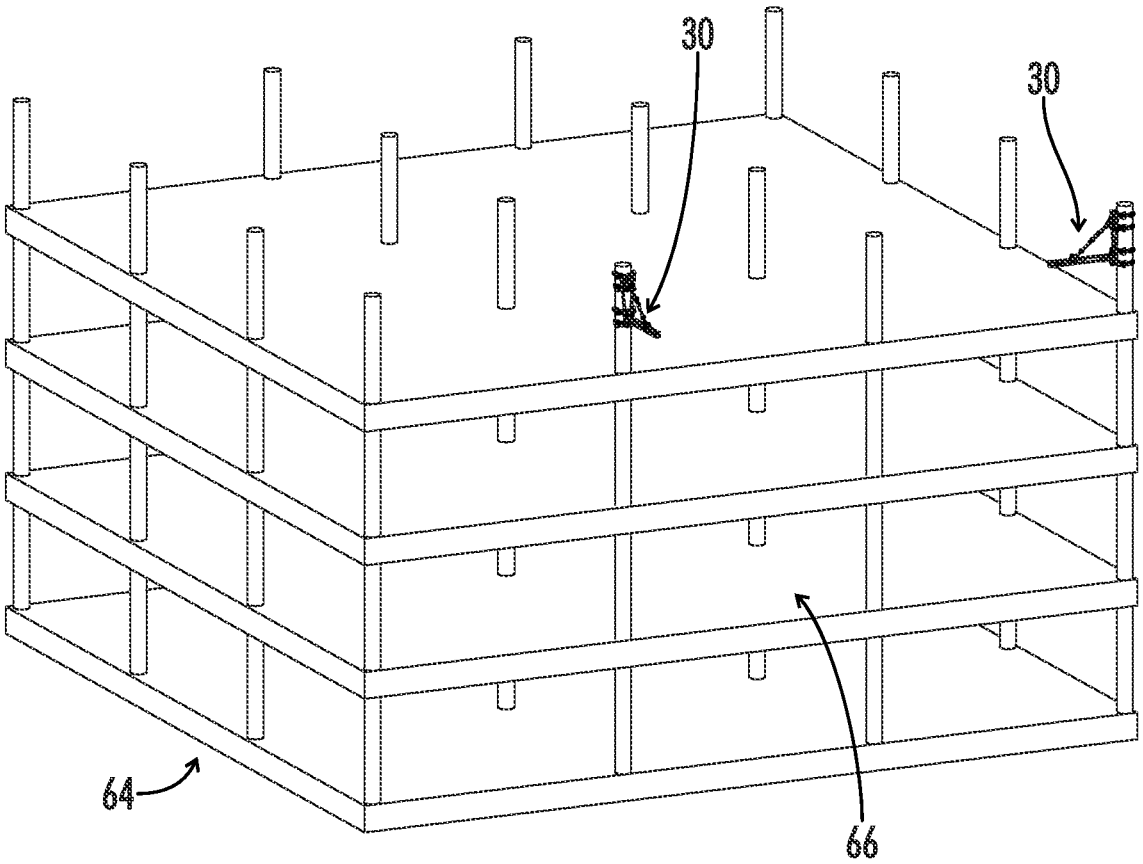
FIG. 47 illustrates a perspective view of two hoists of one embodiment of the present invention of the present invention attached to an interior face and an exterior face of a rectangular tower pole of a building.

In a further embodiment, as best seen in FIGS. 45-46 a hoist 30 may be secured to a tower 10 comprising a rectangular tower pole 12. The rectangular tower pole 12 may have a top 14 located above the ground, a bottom 16, and a height 18 extending from the top to the bottom. Optionally, the hoist 30 may be secured to the tower pole 12 by performing the following steps in any suitable order including simultaneously: a) providing an upper forward cross beam 420, an upper rear cross beam 422, a lower forward cross beam 424, and an lower rear cross beam 426; b) securing the upper forward cross beam 420 and the upper rear cross beam 422 to the rectangular tower pole 12 by having an upper left rod 430 and an upper right rod 432 extend between the upper forward cross beam 420 and the upper rear cross beam 422, wherein the upper left and upper right rods 430,432 are optionally configured to draw the upper forward cross beam 420 toward the upper rear cross beam 422 to compress the tower pole 12 between the upper forward cross beam 420 and the upper rear cross beam 422; c) securing the lower forward cross beam 424 and the lower rear cross beam 426 to the rectangular tower pole 12 by having a lower left rod 434 and a lower right rod 436 extend between the lower forward cross beam 424 and the lower rear cross beam 426, wherein the lower left and lower right rods 434,436 are optionally configured to draw the lower forward cross beam 424 toward the lower rear cross beam 426 to compress the tower pole 12 between the lower forward cross beam 424 and the lower rear cross beam 426; and/or d) providing a hoist 30 comprising a hoist beam 32 comprising a forward end 34, a rear end 36, a hoist beam length 38 extending from the hoist beam forward end 34 to the hoist rear end 36.

Optionally, as best seen in FIG. 46, i) the upper rear cross beam 422 and upper forward cross beam 420 are at substantially the same height; ii) the lower rear cross beam 426 and lower forward cross beam 424 are at substantially the same height; iii) the upper rear cross beam 422 and/or the upper forward cross beam 420 are above the lower rear cross beam 426 and/or lower forward cross beam 424; iv) the upper forward cross beam 420 and lower forward cross beam 424 extended laterally out from the tower pole 12 on at least one side; v) the upper rear cross beam 422, the upper forward cross beam 420, the lower rear cross beam 426, and/or lower forward cross beam 424 are oriented substantially parallel to the ground and perpendicular to the tower pole 12; vi) the hoist beam 32 is connected to the lower forward cross beam 424 on an end of the lower forward cross beam 424 extending to the side of the tower pole 12, wherein the hoist beam 32 optionally extends forward from the lower cross beam 389; vii) the hoist beam 32 comprises at least one sheave connected to the hoist beam 32 and configured to receive a pulley cable/load line 44; and/or viii) a brace cable 46 connects the hoist beam 32 to the upper forward cross beam 420 on an end of the upper forward cross beam 420 extending to the side of the tower pole 12, wherein the brace cable 46 optionally extends at an angle relative to the left and right tower pole heights 18A,18B and comprises an upper end 47A connected to the upper forward cross beam 420 and a lower end 47B connected to the hoist beam 32.

Optionally, similar to the embodiments previously described, a lower cross beam bracket 438 may be connected to the lower cross beam 389 on the outside of, as opposed to between, the left and right lower rods 434,436. Further, a horizontally-oriented pivot bolt 104 may optionally connect the hoist beam 32 to the lower cross beam bracket 438. The hoist beam 32 may be configured to rotate clockwise and/or counter-clockwise about a horizontally-oriented pivot bolt pivot axis 105 extending generally perpendicular to the tower pole height 18. Optionally, a horizontally-oriented pivot bolt 104 allows the hoist beam 32 to rotate clockwise and/or counter-clockwise about a horizontally-oriented pivot bolt pivot axis 105. Preferably, the rotation of the hoist beam 32 about the horizontally-oriented pivot bolt pivot axis 105 allows the hoist beam forward end 34 to move upward and downward and toward and away from the tower pole 12 to allow the hoist beam 32 to move between a raised and lowered positions. Optionally, the hoist 30 may be installed on any face of a rectangular tower pole 12 including exterior faces 27A and interior faces 27B, as best shown in FIG. 45.

Similar to the embodiments previously described, a lower vertically-oriented pivot bolt 106 may connect the hoist beam 32 to the lower cross beam bracket 438. Optionally, the lower vertically-oriented pivot bolt 106 may be located rearwardly relative to the horizontally-oriented pivot bolt 104. The lower vertically-oriented pivot bolt 106 may optionally be configured to allow the hoist beam 32 to rotate clockwise and/or counter-clockwise about a lower vertically-oriented pivot bolt pivot axis 107 extending generally parallel to the tower pole height 18. Preferably, rotation of the hoist beam 32 about the lower vertically-oriented pivot bolt 106 allows the hoist beam 32 to move toward and away from the lower forward cross beam 424 to allow the hoist beam 32 to move in a plane perpendicular to the tower pole height 18. In some cases, the lower cross beam bracket 438 further comprises a movable bridge 110, as described previously.

Optionally, at least after complete installation of the system, an upper cross beam bracket 440 is connected to the upper cross beam 388 on the outside of, as opposed to between, of the left and right upper rods 430, 432. Further, the upper cross beam bracket 440 may be optionally located above the lower cross beam bracket 438. Optionally, an upper vertically-oriented pivot bolt 132 connects the upper end 47A of the brace cable 46 to the upper cross beam bracket 440. Optionally, the brace cable 46 configured to rotate (in a coordinated fashion with the hoist beam 32) clockwise and/or counter-clockwise about an upper vertically-oriented pivot bolt pivot axis 134 extending generally parallel to the tower pole height 18. Preferably, as with the previous embodiments, rotation of the brace cable 46 about the upper vertically-oriented pivot bolt pivot axis 134 allows the hoist beam 32 to move toward and away from the lower cross beam 389 in the plane perpendicular to the tower pole height 18.

In some cases, for example, when the hoist 30 is secured to a rectangular tower pole 12, the hoist 30 may further comprise one or more support cross beam braces 450, a rear support cross beam 452, a forward support cross beam 454, a left support rod 456, and a right support rod 458. Optionally, the a rear support cross beam 452 and a forward support cross beam 454 are secured to the rectangular tower pole 12 by having the left support rod 456 and the right support rod 458 extend between the rear support cross beam 452 and the forward support cross beam 454, wherein the left and right support rods 456, 458 are optionally configured to draw the rear support cross beam 452 toward the forward support cross beam 454 to compress the tower pole 12 between the rear support cross beam 452 and the forward support cross beam 454. Optionally, the support cross beam braces 450 extend between and secure to the forward support cross beam 454 and the lower forward cross beam 424. Without being bound to any particular theory, such configuration provides vertical support to the hoist 30 to prevent it from slipping down the tower pole 12 under load.

Optionally, i) the rear support cross beam 452 and the forward support cross beam 454 are at substantially the same height; ii) the rear support cross beam 452 and/or the forward support cross beam 454 are oriented substantially parallel to the ground and perpendicular to the tower pole; and/or iii) the rear support cross beam 452 and the forward support cross beam 454 are below the lower rear cross beam 426, lower forward cross beam 424, the upper rear cross beam 422, and/or the upper forward cross beam 420.

In addition, the system may optionally comprise include one or more features described above.

In some cases, the hoist 30 and platform 400 may allow for workers to connect to them with 100% tie-off. Thus, in some embodiments, a worker may position a tie-off cable (not shown) around a component of the hoist 30 or platform 400 for example. The hoist 30 may also be used to raise and lower a man basket 182 configured to carry a human, as shown in FIGS. 41-42. For example, a man basket 182 may be attached to the hoist beam 32 via a trolley 184 so that a worker may move from the tower 10 to work on the antennas 8 feet away, similar to how a worker may use the platform 400 described. The trolley 184 may ride on a bottom flange 188 or bottom flanges 188 of the hoist beam 32.

The brackets that connect components to the tower poles are preferably clamps, meaning that they are wrapped tightly at least partially around the perimeter/outer wall/outer surface of the tower poles—e.g., using tension chains or straps in addition to a central bracket—and use tension to hold the brackets in place, as opposed to using bolts to connect the brackets to the towers. Preferably, the clamps are adjustable so that they may be used on towers of different dimensions. However, other configurations are possible.

Although the hoist and platform has principally been illustrated in conjunction with telecommunications towers, it will be appreciated that the design may be used with other towers. For example, if a piece of bulky heavy equipment is housed on an upper floor of a building, it may be impractical to use an elevator to remove the equipment from the building. In such a scenario, movers may choose to open a side of the building to remove the object. The hoist could be installed on a structural column near an alley or street to facilitate lowering/raising equipment.

| Part List | |
|---|---|
| Tower | 10 |
| Tower Pole | 12 |
| Tower Pole Top | 14 |
| Left Tower Pole Top | 14A |
| Right Tower Pole Top | 14B |
| Tower Pole Bottom | 16 |
| Left Tower Pole Bottom | 16A |
| Right Tower Pole Bottom | 16B |
| Tower Pole Height | 18 |
| Left Tower Pole Height | 18A |
| Right Tower Pole Height | 18B |
| Tower Pole Surface | 20 |
| Tower Pole Flat Side | 21 |
| Left Tower Pole | 22 |
| Right Tower Pole | 24 |
| Rear Tower Pole | 26 |
| Tower Pole Exterior Face | 27A |
| Tower Pole Interior Face | 27B |
| Tower Braces | 28 |
| Hoist | 30 |
| Hoist Beam | 32 |
| Hoist Beam Forward End | 34 |
| Hoist Beam Rear End | 36 |
| Hoist Beam Length | 38 |
| At Least One Load-End Sheave | 40 |
| At Least One Return Sheave | 42 |
| Pulley Cable/Load Line | 44 |
| Brace Cable | 46 |

-continued

| Part List | |
|---|---|
| Brace Cable Upper End | 47A |
| Brace Cable Lower End | 47B |
| Hoist Beam Top | 51A |
| Hoist Beam Bottom | 51B |
| Hoist Beam Height | 52 |
| Hoist Beam Channel | 54 |
| Hoist Beam Left Side | 55A |
| Hoist Beam Right Side | 55B |
| Termination Bracket | 56 |
| Termination Bracket Upper End | 57A |
| Termination Bracket Lower End | 57B |
| Termination Bracket Hole | 58 |
| Rope Guides | 62 |
| Building | 64 |
| Interior | 66 |
| First Clamp Bracket System | 70 |
| First Clamp Central Bracket | 72 |
| First Clamp Central Bracket Front Side | 74 |
| First Clamp Central Bracket Rear Side | 76 |
| First Clamp Central Bracket Left Side | 77A |
| First Clamp Central Bracket Right Side | 77B |
| U-shaped/Circular Cable System | 78 |
| Cable System First End | 80 |
| Cable System Second End | 82 |
| Left Chain | 84 |
| Left Chain Forward End | 86A |
| Left Chain Rear End | 86B |
| Left Chain Tensioner | 88 |
| Left Chain Tensioner Forward End | 90A |
| Left Chain Tensioner Rear End | 90B |
| Flexible Clamp Cable | 92 |
| Flexible Clamp Cable Right End | 94A |
| Flexible Clamp Cable Left End | 94B |
| Right Chain Tensioner | 96 |
| Right Chain Tensioner Forward End | 98A |
| Right Chain Tensioner Rear End | 98B |
| Right Chain | 100 |
| Right Chain Forward End | 102A |
| Right Chain Rear End | 102B |
| Horizontally-Oriented Pivot Bolt | 104 |
| Horizontally-Oriented Pivot Bolt Pivot Axis | 105 |
| Lower Vertically-Oriented Pivot Bolt | 106 |
| Lower Vertically-Oriented Pivot Bolt Pivot Axis | 107 |
| First Clamp Central Bracket Brake | 108 |
| Movable Bridge | 110 |
| Movable Bridge ForwardSection | 112 |
| Movable Bridge Rear Section | 114 |
| First/Second Clamp Central Bracket Upper Plate | 116 |
| First/Second Clamp Central Bracket Lower Plate | 118 |
| First/Second Clamp Central Bracket Lower Plate Bolt Hole | 119 |
| Second Clamp Bracket System | 120 |
| Second Clamp Central Bracket | 122 |
| Second Clamp Central Bracket Front Side | 124 |
| Second Clamp Central Bracket Rear Side | 126 |
| Second Clamp Central Bracket Left Side | 128 |
| Second Clamp Central Bracket Right Side | 130 |
| Upper Vertically-Oriented Pivot Bolt | 132 |
| Upper Vertically-Oriented Pivot Bolt Pivot Axis | 134 |
| Vertical Brace | 136 |
| Vertical Brace Upper End | 138 |
| Vertical Brace Lower End | 140 |
| Vertical Brace Difference | 142 |
| Brace Cable Upper Chain | 144 |
| Brace Cable Upper Chain Upper End | 146A |
| Brace Cable Upper Chain Lower End | 146B |
| Brace Cable Lower Chain | 148 |
| Brace Cable Lower Chain Upper End | 150A |
| Brace Cable Lower Chain Lower End | 150B |
| Brace Cable Turnbuckle | 152 |
| Brace Cable Turnbuckle in Shortened Configuration | 152A |
| Brace Cable Turnbuckle in Lengthened Configuration | 152B |
| Brace Cable Turnbuckle Upper End | 154A |
| Brace Cable Turnbuckle Lower End | 154B |
| Removable Bolt/Lug | 156 |
| Jack Bolt | 160 |
| Jack Bolt Proximal End | 162 |

-continued

| Part List | |
|---|---|
| Jack Bolt Distal End | 164 |
| First Clamp Central Bracket Top | 168 |
| First Clamp Central Bracket Bottom | 170 |
| Second Clamp Central Bracket Top | 172 |
| Second Clamp Central Bracket Bottom | 174 |
| Jack Bracket | 176 |
| Removable Insert | 180 |
| Man Basket | 182 |
| Man Basket Cable | 183 |
| Trolley | 184 |
| Trolley Forward End | 185A |
| Trolley Rear End | 185B |
| Basket Hoist | 186 |
| Bottom Flange (s) | 188 |
| Mast | 200 |
| Mast Top | 202 |
| Mast Bottom | 204 |
| Mast Height | 206 |
| Mast Sheave | 209 |
| First Mast Bracket System | 210 |
| Second Mast Bracket System | 212 |
| X-shaped Vertical Brace | 214 |
| Mast Bolt | 216 |
| Mast Rod | 218 |
| At Least One Bearing System | 220 |
| Mast Central/Longitudinal Axis | 222 |
| Bearing System Brake | 224 |
| Bearing Bolt | 226 |
| Bearing Nut | 228 |
| Upper Mast Pipe | 230 |
| Upper Mast Pipe Top | 232 |
| Upper Mast Pipe Bottom | 234 |
| Upper Mast Pipe Height | 236 |
| Upper Mast Pipe Interior | 238 |
| Upper Mast Pipe Interior Surface | 240 |
| Upper Mast Pipe Inner Diameter | 242 |
| Upper Mast Pipe Exterior Surface | 244 |
| Upper Mast Pipe Exterior Diameter | 246 |
| Lower Bearing System | 247 |
| Upper Mast Pipe Plurality of Holes | 248 |
| Lower Bearing System Rollers | 249 |
| Lower Mast Pipe | 250 |
| Lower Mast Pipe Top | 252 |
| Lower Mast Pipe Bottom | 254 |
| Lower Mast Pipe Height | 256 |
| Lower Mast Pipe Interior | 258 |
| Lower Mast Pipe Interior Surface | 260 |
| Lower Mast Pipe Inner Diameter | 262 |
| Lower Mast Pipe Exterior Surface | 264 |
| Lower Mast Pipe Exterior Diameter | 266 |
| Lower Mast Pipe Plurality of Holes | 268 |
| Stabilizer Plate | 270 |
| Stabilizer Plate Upper Face | 272 |
| Stabilizer Plate Lower Face | 274 |
| Stabilizer Plate Center Hole | 276 |
| Stabilizer Plate Plurality of Outer Holes | 278 |
| Stabilizer Plate Diameter | 279 |
| First Bearing Plate | 280 |
| First Bearing Plate Top | 282 |
| First Bearing Plate Upper Face | 284 |
| First Bearing Plate Bottom | 286 |
| First Bearing Plate Lower Face | 288 |
| First Bearing Plate Center Hole | 290 |
| First Bearing Plate Outer Edge | 292 |
| First Bearing Plate Diameter | 294 |
| Second Bearing Plate | 300 |
| Second Bearing Plate Top | 302 |
| Second Bearing Plate Upper Face | 304 |
| Second Bearing Plate Bottom | 306 |
| Second Bearing Plate Lower Face | 308 |
| Second Bearing Plate Center Hole | 310 |
| Second Bearing Plate Outer Edge | 312 |
| Second Bearing Plate Diameter | 314 |
| Third Bearing Plate | 320 |
| Third Bearing Plate Top | 322 |
| Third Bearing Plate Upper Face | 324 |
| Third Bearing Plate Bottom | 326 |

-continued

| Part List | |
|---|---|
| Third Bearing Plate Lower Face | 328 |
| Third Bearing Plate Center Hole | 330 |
| Third Bearing Plate Upper Face Edge | 332 |
| Third Bearing Plate Lower Face Edge | 334 |
| Third Bearing Plate Upper Face Diameter | 336 |
| Third Bearing Plate Lower Face Diameter | 338 |
| Third Bearing Plate Ledge/Recess | 339 |
| Fourth Bearing Plate | 340 |
| Fourth Bearing Plate Top | 342 |
| Fourth Bearing Plate Upper Face | 344 |
| Fourth Bearing Plate Bottom | 346 |
| Fourth Bearing Plate Lower Face | 348 |
| Fourth Bearing Plate Outer Edge | 352 |
| Fourth Bearing Plate Diameter | 354 |
| Top Washer | 360 |
| Top Washer Center Hole | 362 |
| Top Washer Upper Face | 366 |
| Bottom Washer | 370 |
| Bottom Washer Center Hole | 372 |
| Bottom Washer Lower Face | 376 |
| Lower Right Clamp Bracket System | 380 |
| Upper Right Clamp Bracket System | 382 |
| Lower Left Clamp Bracket System | 384 |
| Upper Left Clamp Bracket System | 386 |
| Upper Cross Beam | 388 |
| Lower Cross Beam | 389 |
| Lower Cross Beam Bracket | 390 |
| Upper Cross Beam Bracket | 392 |
| Davit | 393 |
| Davit Sheave | 394 |
| Davit Top | 395A |
| Davit Bottom | 395B |
| Davit Flange | 396 |
| Davit Height | 397 |
| Upper Davit Pole | 398 |
| Lower Davit Pole | 399 |
| Platform | 400 |
| Platform Beam | 402 |
| Platform Beam Forward End | 404 |
| Platform Beam Rear End | 406 |
| Platform Beam Length | 408 |
| Platform Floor | 410 |
| Platform Horizontal Rail | 412 |
| Platform Vertical Rail | 414 |
| Upper Forward Cross Beam | 420 |
| Upper Rear Cross Beam | 422 |
| Lower Forward Cross Beam | 424 |
| Lower Rear Cross Beam | 426 |
| Upper Left Rod | 430 |
| Upper Right Rod | 432 |
| Lower Left Rod | 434 |
| Lower Right Rod | 436 |
| Lower Cross Beam Bracket | 438 |
| Upper Cross Beam Bracket | 440 |
| Support Cross Beam Brace (s) | 450 |
| Rear Support Cross Beam | 452 |
| Forward Support Cross Beam | 454 |
| Left Support Rod | 456 |
| Right Support Rod | 458 |
| Rear Right Tower Pole | 500 |
| Rear Right Tower Pole Top | 502 |
| Rear Right Tower Pole Bottom | 504 |
| Rear Right Tower Pole Height | 506 |
| Rear Left Tower Pole | 510 |
| Rear Left Tower Pole Top | 512 |
| Rear Left Tower Pole Bottom | 514 |
| Rear Left Tower Pole Height | 516 |
| Lower Left Horizontal Brace | 520 |
| Lower Right Horizontal Brace | 522 |
| Lower Left Horizontal Brace Clamp | 524 |
| Lower Right Horizontal Brace Clamp | 526 |
| Upper Left Horizontal Brace | 530 |
| Upper Right Horizontal Brace | 532 |
| Upper Left Horizontal Brace Clamp | 534 |
| Upper Right Horizontal Brace Clamp | 536 |
| Man Basket Forward Cross Bracket | 540 |
| Man Basket Rear Cross Bracket | 542 |

-continued

| Part List | |
|---|---|
| Man Basket Chains | 543 |
| Man Basket Forward Cross Bracket Left End | 544 |
| Man Basket Forward Cross Bracket Right End | 545 |
| Man Basket Rear Cross Bracket Left End | 546 |
| Man Basket Rear Cross Bracket Right End | 547 |
| Man Basket Floor | 550 |
| Man Basket Horizontal Rail | 552 |
| Man Basket Vertical Rail | 554 |

Those skilled in the art will understand how to make changes and modifications to the disclosed embodiments to meet their specific requirements or conditions. Changes and modifications may be made without departing from the scope and spirit of the invention. It is understood that use of the singular embraces the plural and vice versa. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies. In addition, the steps of the methods described herein can be performed in any suitable order, including simultaneously.

What is claimed is:

1. A method of securing a hoist system to a tower pole comprising a tower pole top located above the ground, a tower pole bottom and a tower pole height extending from the tower pole top to the tower pole bottom, the method comprising assembling a hoist system by performing the following steps in any suitable order including simultaneously:

a) securing a first clamp bracket system to the tower pole by placing the first clamp bracket system at least partially around the tower pole; and b) providing a hoist system comprising a hoist beam comprising a forward end, a rear end, a hoist beam length extending from the forward end to the rear end;

wherein, at least after complete installation, i) the first clamp bracket system connects the hoist beam rear end to the tower pole;

ii) the hoist beam extends laterally from the tower pole and the first clamp bracket system;

iii) the hoist beam further comprises at least one load-end sheave and at least one return sheave located rearwardly relative to the at least one load-end sheave, and further wherein a load line extends from below the hoist beam, at least partially around the at least one load-end sheave and at least partially around the at least one return sheave and then below the hoist beam;

iv) a brace cable connects the hoist beam to the tower pole and extends at an angle relative to the tower pole height and comprises an upper end connected to the tower pole and a lower end connected to the hoist beam; and v) the hoist beam further comprises a top, a bottom, a hoist beam height extending from the top to the rear bottom, a hoist beam channel extending from the hoist beam top to hoist beam bottom, the hoist beam channel dividing the hoist beam into a hoist beam left side and hoist beam right side, and further wherein the at least one load-end sheave, the at least one return sheave and at least a segment of the load line are located in the channel.

2. The method of claim 1 wherein, at least after complete installation, the at least one return sheave is located between the at least one load-end sheave and the hoist beam rear end.

3. The method of claim 1 wherein, at least after complete installation, the at least one load-end sheave and at least one return sheave are each configured to rotate about axes extending generally perpendicular to the hoist beam length.

4. The method of claim 1 wherein, at least after complete installation, the at least one load-end sheave comprises a plurality of load-end sheaves spaced about the hoist beam length, and further wherein the plurality of load-end sheaves and the at least one return sheave are aligned within the channel.

5. The method of claim 1 wherein, at least after complete installation, the hoist beam further comprises a termination bracket, the termination bracket having an upper end located in the hoist beam channel and a lower end extending downward from the hoist beam and comprising a hole.

6. The method of claim 5 wherein, at least after complete installation, the load line runs from below the hoist beam, up through the hoist beam channel between the at least one return sheave and the hoist beam rear end, at least partially around the at least one return sheave and the at least one load-end sheave, and back down through the hoist beam channel between the at least one load-end sheave and the forward end of the hoist beam, and further wherein, the load line runs down toward a load and back up to the termination bracket.

7. The method of claim 1 wherein, at least after complete installation, the first clamp bracket system comprises a first clamp central bracket comprising a front side connected to the rear side of the hoist beam, a rear side facing the tower pole and opposite the front side, a left side and a right side and a cable system extending partially around the tower pole and comprising a first end connected to the left side and a second end connected to the right side.

8. The method of claim 7 wherein, at least after complete installation, the cable system is u-shaped.

9. The method of claim 8, wherein at least after complete installation, the u-shaped cable system is comprised of one or more chain tensioners and one or more chains, said one or more chain tensioners connected to the central bracket and one or more of said chains.

10. The method of claim 9, wherein at least after complete installation, the cable system is comprised of a left chain, a left chain tensioner, a flexible clamp cable, a right chain, and a right chain tensioner, the left chain tensioner having a forward end connected to the first clamp central bracket left side and a rear end connected to a forward end of the left chain, the left chain having a rear end connected to a left end of the flexible clamp cable, the flexible clamp cable having a right end connected to a rear end of the right chain, the right chain having a forward end connected to a rear end of the right chain tensioner, the right chain tensioner having a forward end connected to the right side of the first clamp central bracket.

11. The method of claim 7, wherein, at least after complete installation, the hoist beam is pivotally connected to the first clamp central bracket via at least two pivots such that the hoist beam can at least partially rotate around the tower pole in the plane perpendicular to the tower pole height and the hoist beam forward end can move relative to the hoist beam rear end between a raised position in which the hoist beam forward end is located higher than the hoist beam rear end and a lowered position in which the hoist beam forward end is located at the same height or lower than the hoist beam rear end.

12. The method of claim 11 wherein, at least after complete installation, the two pivots have perpendicular pivot axes so that the hoist beam may simultaneously move in two planes that are perpendicular to each other.

13. The method of claim 7 wherein, at least after complete installation, a horizontally-oriented pivot bolt pivotably connects the hoist beam to the first clamp central bracket, the horizontally-oriented pivot bolt configured to allow the hoist beam to rotate clockwise and/or counter-clockwise about a horizontally-oriented pivot bolt pivot axis extending generally perpendicular to the tower pole height, wherein rotation of the hoist beam about the horizontally-oriented pivot bolt pivot axis allows the hoist beam forward end to move upward and downward and toward and away from the tower pole top.

14. The method of claim 13 wherein, at least after complete installation, a lower vertically-oriented pivot bolt pivotably connects the hoist beam to the first clamp central bracket, the lower vertically-oriented pivot bolt located rearwardly relative to the horizontally-oriented pivot bolt, the lower vertically-oriented pivot bolt configured to allow the hoist beam to rotate clockwise and/or counter-clockwise about a lower vertically-oriented pivot bolt pivot axis extending generally parallel to the tower pole height, wherein rotation of the hoist beam about the lower vertically-oriented pivot bolt pivot axis allows the hoist beam to rotate at least partially around said tower pole in the plane perpendicular to the tower pole height.

15. The method of claim 14 wherein, at least after complete installation, the first clamp bracket system further comprises a brake, the brake, when engaged, configured to prevent rotation of the hoist beam clockwise and/or counter-clockwise about the lower vertically-oriented pivot bolt pivot axis.

16. The method of claim 14 wherein, at least after complete installation, the first clamp central bracket further comprises a movable bridge, the movable bridge comprising a forward section comprising the horizontally-oriented pivot bolt and a rear section comprising the lower vertically-oriented pivot bolt, the movable bridge configured to rotate around the lower vertically-oriented pivot bolt pivot axis with the hoist beam to allow the hoist beam to move in the plane perpendicular to the pole height.

17. The method of claim 16 wherein, at least after complete installation, the first clamp central bracket further comprises an upper plate comprising an upper plate bolt hole and a lower plate comprising a lower plate bolt hole, wherein the movable bridge is positioned between the upper plate and the lower plate and further wherein the lower vertically-oriented pivot bolt extends vertically through the movable bridge and is positioned in and rotates in the upper plate bolt hole and lower plate bolt hole as the hoist beam rotates about the lower vertically-oriented pivot bolt pivot axis.

18. The method of claim 14 wherein, at least after complete installation, the method further comprises securing a second clamp bracket system to the tower pole by placing the second bracket system at least partially around the tower pole, wherein at least after complete installation of the system, the second clamp bracket system is located above the first clamp bracket system and the second clamp bracket system comprises a second clamp central bracket comprising a front side connected to the upper end of the brace cable, a rear side facing the tower pole and opposite the front side, a left side and a right side.

19. The method of claim 18, wherein, at least after complete installation, the upper end of the brace cable is pivotally connected to the second clamp central bracket via at least one pivot such that the hoist beam can at least partially rotate around the tower pole in the plane perpendicular to the pole height.

20. The method of claim 18 wherein at least after complete installation, an upper vertically-oriented pivot bolt pivotably connects the upper end of the brace cable to the second clamp central bracket, the upper vertically-oriented pivot bolt configured to allow the brace cable to rotate clockwise and/or counter clockwise about a upper vertically-oriented pivot bolt pivot axis extending generally parallel to the tower pole height, wherein rotation of the brace cable about the upper vertically-oriented pivot bolt pivot axis allows the hoist beam to rotate at least partially around the tower pole in the plane perpendicular to the pole height, and further wherein the brace cable rotates about the upper vertically-oriented pivot bolt axis in coordination with the hoist beam as the hoist beam rotates about the lower vertically-oriented pivot bolt axis.

21. The method of claim 20 wherein, at least after complete installation, the upper vertically-oriented pivot bolt is located directly above the lower vertically-oriented pivot bolt such that the upper and lower vertically-oriented pivot bolt axes are vertically aligned.

22. The method of claim 20, wherein at least after complete installation, a pair of vertical braces spaced apart by a distance extend between the first and second clamp central brackets and connect the first clamp central bracket to the second clamp central bracket, wherein each vertical brace comprises an upper end and a lower end, and further wherein the distance between the vertical braces is less at the lower end of the vertical braces as compared to the upper end of the vertical braces to form a V-shape.

23. The method of claim 20 wherein, at least after complete installation, the brace cable comprises an upper chain, a turnbuckle, and a lower chain, the upper chain having an upper end connected to the upper vertically-oriented pivot bolt and a lower end connected to an upper end of the turnbuckle and further wherein the lower chain comprises an upper end connected to a lower end of the turnbuckle and a lower end connected to the hoist beam, and further wherein the hoist beam is configured to move into the raised position when the turnbuckle is shortened.

24. The method of claim 20 wherein, at least after complete installation, the first and second clamp brackets are vertically aligned, wherein a plurality of adjustable jack bolts extend through a portion of at least one of the first clamp central bracket and the second clamp central bracket and engage a surface of the tower pole, and said engagement is configured to prevent the first clamp central bracket and/or the second clamp central bracket from rotating or sliding relative to the tower pole.

25. A method of securing a hoist system to a tower pole comprising a tower pole top located above the ground, a tower pole bottom and a tower pole height extending from the tower pole top to the tower pole bottom, the method comprising assembling a hoist system by performing the following steps in any suitable order including simultaneously:

a) securing a first clamp bracket system to the tower pole by placing the first clamp bracket system at least partially around the tower pole; and b) providing a hoist system comprising a hoist beam comprising a forward end, a rear end, a hoist beam length extending from the forward end to the rear end;

wherein, at least after complete installation, i) the first clamp bracket system connects the hoist beam rear end to the tower pole;

ii) the hoist beam extends laterally from the tower pole and the first clamp bracket system;

iii) the hoist beam further comprises at least one load-end sheave and at least one return sheave located rearwardly relative to the at least one load-end sheave;

iv) a brace cable connects the hoist beam to the tower pole and extends at an angle relative to the tower pole height and comprises an upper end connected to the tower pole and a lower end connected to the hoist beam; and v) the first clamp bracket system comprises a first clamp central bracket comprising a front side connected to the rear side of the hoist beam, a rear side facing the tower pole and opposite the front side, a left side and a right side and a cable system extending partially around the tower pole and comprising a first end connected to the left side and a second end connected to the right side, wherein a horizontally-oriented pivot bolt pivotably connects the hoist beam to the first clamp central bracket, the horizontally-oriented pivot bolt configured to allow the hoist beam to rotate clockwise and/or counter-clockwise about a horizontally-oriented pivot bolt pivot axis extending generally perpendicular to the tower pole height, wherein rotation of the hoist beam about the horizontally-oriented pivot bolt pivot axis allows the hoist beam forward end to move upward and downward and toward and away from the tower pole top, a lower vertically-oriented pivot bolt pivotably connects the hoist beam to the first clamp central bracket, the lower vertically-oriented pivot bolt located rearwardly relative to the horizontally-oriented pivot bolt, the lower vertically-oriented pivot bolt configured to allow the hoist beam to rotate clockwise and/or counter-clockwise about a lower vertically-oriented pivot bolt pivot axis extending generally parallel to the tower pole height, wherein rotation of the hoist beam about the lower vertically-oriented pivot bolt pivot axis allows the hoist beam to rotate at least partially around said tower pole in the plane perpendicular to the tower pole height, and wherein the first clamp bracket system further comprises a brake, the brake, when engaged, configured to prevent rotation of the hoist beam clockwise and/or counter-clockwise about the lower vertically-oriented pivot bolt pivot axis.

26. The method of claim 25 wherein a load line extends from below the hoist beam, at least partially around the at least one load-end sheave and at least partially around the at least one return sheave and then below the hoist beam.

27. A method of securing a hoist system to a tower pole comprising a tower pole top located above the ground, a tower pole bottom and a tower pole height extending from the tower pole top to the tower pole bottom, the method comprising assembling a hoist system by performing the following steps in any suitable order including simultaneously:

a) securing a first clamp bracket system to the tower pole by placing the first clamp bracket system at least partially around the tower pole; and b) providing a hoist system comprising a hoist beam comprising a forward end, a rear end, a hoist beam length extending from the forward end to the rear end;

wherein, at least after complete installation, i) the first clamp bracket system connects the hoist beam rear end to the tower pole;

ii) the hoist beam extends laterally from the tower pole and the first clamp bracket system;

iii) the hoist beam further comprises at least one load-end sheave and at least one return sheave located rearwardly relative to the at least one load-end sheave;

iv) a brace cable connects the hoist beam to the tower pole and extends at an angle relative to the tower pole height and comprises an upper end connected to the tower pole and a lower end connected to the hoist beam; and v) the first clamp bracket system comprises a first clamp central bracket comprising a front side connected to the rear side of the hoist beam, a rear side facing the tower pole and opposite the front side, a left side and a right side and a cable system extending partially around the tower pole and comprising a first end connected to the left side and a second end connected to the right side, wherein a horizontally-oriented pivot bolt pivotably connects the hoist beam to the first clamp central bracket, the horizontally-oriented pivot bolt configured to allow the hoist beam to rotate clockwise and/or counter-clockwise about a horizontally-oriented pivot bolt pivot axis extending generally perpendicular to the tower pole height, wherein rotation of the hoist beam about the horizontally-oriented pivot bolt pivot axis allows the hoist beam forward end to move upward and downward and toward and away from the tower pole top, a lower vertically-oriented pivot bolt pivotably connects the hoist beam to the first clamp central bracket, the lower vertically-oriented pivot bolt located rearwardly relative to the horizontally-oriented pivot bolt, the lower vertically-oriented pivot bolt configured to allow the hoist beam to rotate clockwise and/or counter-clockwise about a lower vertically-oriented pivot bolt pivot axis extending generally parallel to the tower pole height, wherein rotation of the hoist beam about the lower vertically-oriented pivot bolt pivot axis allows the hoist beam to rotate at least partially around said tower pole in the plane perpendicular to the tower pole height, wherein the method further comprises securing a second clamp bracket system to the tower pole by placing the second bracket system at least partially around the tower pole, wherein at least after complete installation of the system, the second clamp bracket system is located above the first clamp bracket system and the second clamp bracket system comprises a second clamp central bracket comprising a front side connected to the upper end of the brace cable, a rear side facing the tower pole and opposite the front side, a left side and a right side, an upper vertically-oriented pivot bolt pivotably connects the upper end of the brace cable to the second clamp central bracket, the upper vertically-oriented pivot bolt configured to allow the brace cable to rotate clockwise and/or counter clockwise about a upper vertically-oriented pivot bolt pivot axis extending generally parallel to the tower pole height, wherein rotation of the brace cable about the upper vertically-oriented pivot bolt pivot axis allows the hoist beam to rotate at least partially around the tower pole in the plane perpendicular to the pole height, and further wherein the brace cable rotates about the upper vertically-oriented pivot bolt axis in coordination with the hoist beam as the hoist beam rotates about the lower vertically-oriented pivot bolt axis, and further wherein a pair of vertical braces spaced apart by a distance extend between the first and second clamp central brackets and connect the first clamp central bracket to the second clamp central bracket, wherein each vertical brace comprises an upper end and a lower end, and further wherein the distance between the vertical braces is less at the lower end of the vertical braces as compared to the upper end of the vertical braces to form a V-shape.

* * * * *